US009320318B2

(12) United States Patent
Nurse et al.

(10) Patent No.: US 9,320,318 B2
(45) Date of Patent: Apr. 26, 2016

(54) ARTICULATED SHANK

(71) Applicant: NIKE, Inc., Beaverton, OR (US)

(72) Inventors: Matthew A. Nurse, Lake Oswego, OR (US); John Hurd, Lake Oswego, OR (US); Jennifer Bishop, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 412 days.

(21) Appl. No.: 13/804,714

(22) Filed: Mar. 14, 2013

(65) Prior Publication Data

US 2013/0247417 A1 Sep. 26, 2013

Related U.S. Application Data

(60) Provisional application No. 61/614,268, filed on Mar. 22, 2012.

(51) Int. Cl.
*A43B 13/18* (2006.01)
*A43B 13/12* (2006.01)
(Continued)

(52) U.S. Cl.
CPC ..... *A43B 13/187* (2013.01); *A43B 3/0031* (2013.01); *A43B 3/0073* (2013.01); *A43B 7/14* (2013.01); *A43B 7/141* (2013.01); *A43B 7/144* (2013.01); *A43B 7/148* (2013.01); *A43B 7/1465* (2013.01); *A43B 7/20* (2013.01); *A43B 13/12* (2013.01); *A43B 13/125* (2013.01); *A43B 13/127* (2013.01); *A43B 13/145* (2013.01);
(Continued)

(58) Field of Classification Search
CPC .... A43B 3/0031; A43B 3/0073; A43B 13/12; A43B 13/125; A43B 13/127; A43B 13/145; A43B 13/187; A43B 13/188
USPC ..... 36/92, 108, 148, 149, 72 A, 43, 44
See application file for complete search history.

(56) References Cited

U.S. PATENT DOCUMENTS 643,998 A 2/1900 Batchelor
744,798 A 11/1903 Roberts
(Continued)

FOREIGN PATENT DOCUMENTS

DE 3802522 8/1988
DE 3927617 2/1991
(Continued)

OTHER PUBLICATIONS

International Preliminary Report on Patentability in PCT/US2013/033148 issued Sep. 23, 2014.
(Continued)

*Primary Examiner* — Jila M Mohandesi
(74) *Attorney, Agent, or Firm* — Banner & Witcoff, Ltd.

(57) ABSTRACT

Shoes and/or shoe elements facilitate natural foot motion and/or reduce forces tending to fight natural foot motion. In at least some such structures, a wearer's heel is secured to the hindfoot region of a shoe (e.g., by a strap system) in a manner that permits heel/forefoot rotation and that allows the lower leg to remain straight. In other structures, a shoe can include a heel supporting component that is separate from a midsole component, and this heel supporting component can move toward the lateral side and/or medial side of the shoe along an interface between the heel supporting component and the midsole component. Other suitable shoe and shoe component structures also are described.

33 Claims, 66 Drawing Sheets

(51) Int. Cl.

| | |
|---|---|
| ***A43B 7/14*** | (2006.01) |
| ***A43B 3/00*** | (2006.01) |
| ***A43B 7/20*** | (2006.01) |
| ***A43B 13/14*** | (2006.01) |
| ***A43B 23/22*** | (2006.01) |
| ***A43C 11/14*** | (2006.01) |
| ***A43B 23/02*** | (2006.01) |

(52) U.S. Cl.

CPC ..... *A43B 13/188* (2013.01); *A43B 23/0265* (2013.01); *A43B 23/22* (2013.01); *A43C 11/14* (2013.01)

(56) References Cited

U.S. PATENT DOCUMENTS 1,155,506 A 10/1915 Osaki
1,328,333 A 1/1920 Mann
1,920,112 A 7/1933 Shaft
1,982,357 A 11/1934 Sebastiani
2,424,609 A 7/1947 Friedmann, Jr.
2,508,318 A 5/1950 Wallach
2,763,071 A 9/1956 Kingsley
2,767,487 A 10/1956 Friedmann, Jr.
2,897,611 A 8/1959 Schaller
3,067,752 A 12/1962 Schaller et al.
3,613,273 A 10/1971 Marquis
D252,836 S 9/1979 Picker
4,282,657 A 8/1981 Antonious
4,364,189 A 12/1982 Bates
4,492,046 A 1/1985 Kosova
4,534,124 A 8/1985 Schnell
4,547,981 A 10/1985 Thais et al.
4,566,206 A 1/1986 Weber
4,592,153 A 6/1986 Jacinto
4,608,970 A 9/1986 Marck et al.
4,766,681 A 8/1988 O'Rourke et al.
4,776,111 A 10/1988 Crowley
4,783,910 A * 11/1988 Boys, II ..... A43B 7/14 36/107
4,811,498 A 3/1989 Barret
4,856,209 A 8/1989 Kenyon
4,878,504 A 11/1989 Nelson
4,922,631 A 5/1990 Anderie
4,972,613 A 11/1990 Loveder
4,989,350 A 2/1991 Bunch et al.
5,052,130 A 10/1991 Barry et al.
5,138,776 A 8/1992 Levin
5,175,947 A 1/1993 Parracho
5,187,883 A * 2/1993 Penney ..... A43B 21/26 36/27
5,195,258 A 3/1993 Loader
D346,686 S 5/1994 Hatfield
D346,894 S 5/1994 Hatfield
5,325,611 A 7/1994 Dyer et al.
5,363,570 A 11/1994 Allen et al.
5,435,079 A 7/1995 Gallegos
5,672,156 A 9/1997 Jimenez Ramos
D386,895 S 12/1997 Hatfield
5,701,686 A 12/1997 Herr et al.
5,771,608 A 6/1998 Peterson
5,778,563 A 7/1998 Ahlbaumer
2,447,603 A 8/1998 Snyder
5,819,439 A 10/1998 Sanchez
5,822,887 A 10/1998 Turner
5,826,350 A 10/1998 Wallerstein
5,832,634 A * 11/1998 Wong ..... A43B 13/026 36/107
5,836,094 A 11/1998 Figel
5,875,567 A 3/1999 Bayley
5,946,827 A 9/1999 Okajima
6,115,941 A 9/2000 Ellis, III
6,237,254 B1 5/2001 Rork et al.
6,295,741 B1 10/2001 Kita
6,295,743 B1 10/2001 Brooks
6,341,432 B1 1/2002 Muller
6,374,515 B1 * 4/2002 Davis ..... A43B 13/16 36/103
6,449,878 B1 9/2002 Lyden
6,467,058 B1 * 10/2002 Chakradhar ... G01R 31/318335 714/738
6,557,271 B1 5/2003 Weaver, III
6,606,804 B2 8/2003 Kaneko et al.
6,629,376 B1 10/2003 Ellis, III
6,675,498 B1 1/2004 Ellis, III
6,701,644 B2 3/2004 Oorei et al.
6,711,834 B1 3/2004 Kita
6,715,218 B2 4/2004 Johnson
6,775,929 B2 8/2004 Katz et al.
6,779,282 B2 8/2004 Grohringer
6,782,643 B2 8/2004 Brown
6,860,034 B2 3/2005 Schmid
D507,094 S 7/2005 Lyden
6,928,756 B1 8/2005 Haynes
6,964,119 B2 11/2005 Weaver, III
6,968,637 B1 * 11/2005 Johnson ..... A43B 3/0063 36/108
7,013,586 B1 3/2006 Hatfield et al.
7,100,308 B2 9/2006 Aveni
7,143,529 B2 12/2006 Robinson, Jr. et al.
7,171,766 B2 2/2007 Bouche et al.
7,243,444 B2 7/2007 Selner
7,334,354 B2 2/2008 Foxen et al.
7,337,558 B2 3/2008 Terlizzi et al.
7,370,442 B2 5/2008 Jung et al.
7,650,707 B2 1/2010 Campbell et al.
7,690,133 B2 * 4/2010 Olivieri ..... A43B 3/26 36/112
7,818,897 B2 10/2010 Geer
8,099,880 B2 1/2012 Brewer et al.
8,245,419 B2 8/2012 Echols
8,250,783 B2 * 8/2012 Luthi ..... A43B 7/142 36/155
8,365,440 B2 * 2/2013 Rivas ..... A43B 3/0036 36/107
8,776,397 B2 * 7/2014 Borel ..... A43B 13/026 36/103
2001/0020341 A1 9/2001 Rork et al.
2001/0022041 A1 9/2001 Gebhard
2002/0050078 A1 5/2002 Dietrich et al.
2002/0088144 A1 7/2002 Katz et al.
2003/0172548 A1 * 9/2003 Fuerst ..... A43B 13/026 36/28
2004/0168350 A1 9/2004 Mathieu et al.
2004/0194344 A1 * 10/2004 Tadin ..... A43B 7/141 36/44
2004/0221487 A1 11/2004 Fried
2005/0102859 A1 5/2005 Yen
2005/0268485 A1 12/2005 Sakai
2006/0010715 A1 1/2006 Tseng et al.
2006/0107553 A1 * 5/2006 Clark ..... A43B 3/26 36/97
2006/0130362 A1 6/2006 Juan
2007/0107264 A1 5/2007 Meschter
2007/0295451 A1 12/2007 Willis
2008/0034613 A1 2/2008 Wilkenfeld
2009/0077831 A1 3/2009 Mazzarolo
2009/0100717 A1 4/2009 Cabanis
2009/0113758 A1 5/2009 Nishiwaki et al.
2009/0300947 A1 12/2009 Babolat
2009/0307925 A1 12/2009 Pfister
2010/0122472 A1 5/2010 Wilson, III et al.
2010/0154258 A1 6/2010 Scholz et al.
2010/0170106 A1 7/2010 Brewer et al.
2010/0242305 A1 9/2010 Liu
2011/0000101 A1 1/2011 Nakano
2011/0197469 A1 8/2011 Nishiwaki et al.
2012/0011744 A1 1/2012 Bell et al.
2012/0198720 A1 8/2012 Farris et al.

FOREIGN PATENT DOCUMENTS

EP 1092358 4/2001
EP 1447019 8/2004

(56) References Cited

FOREIGN PATENT DOCUMENTS

| | | |
|---|---|---|
| EP | 1714624 | 10/2006 |
| WO | 9404049 | 3/1994 |
| WO | 9834508 | 8/1998 |
| WO | 03073882 | 9/2003 |
| WO | 03075698 | 9/2003 |
| WO | 2005004656 | 1/2005 |
| WO | 2006108660 | 10/2006 |
| WO | 2007024523 | 3/2007 |
| WO | 2008003771 | 1/2008 |

OTHER PUBLICATIONS

International Preliminary Report on Patentability in PCT/US2013/033129 issued Sep. 23, 2014.
International Preliminary Report on Patentability in PCT/US2013/033116 issued Sep. 23, 2014.
International Preliminary Report on Patentability in PCT/US2013/033119 issued Sep. 23, 2014.
Pesca, "Basketball Shoes May Reduce Ankle Injuries", <http://www.npr.org/2011/08/15/139652117/basketball-shoes-may-reduce . . . >, Aug. 15, 2011, 3 pages.
EKTIO-Technology, http://www.ektio.com/>, first date of publication unknown but, prior to Aug. 17, 2011, 1 page.
EKTIO-Technology, "Booty", http://www.ektio.com/>, first date of publication unknown but, prior to Aug. 17, 2011, 1 page.
EKTIO-Technology, "Strap", http://www.ektio.com/>, first date of publication unknown but, prior to Aug. 17, 2011, 1 page.
EKTIO-Technology, "Bumper", http://www.ektio.com/>, first date of publication unknown but, prior to Aug. 17, 2011, 1 page.
U.S. Appl. No. 13/804,724, filed Mar. 14, 2013.
U.S. Appl. No. 13/804,742, filed Mar. 14, 2013.
U.S. Appl. No. 13/804,759, filed Mar. 14, 2013.
International Search Report and Written Opinion in PCT/US2013/033148 mailed Jun. 28, 2013.
International Search Report and Written Opinion in PCT/US2013/033116 mailed Jun. 25, 2013.
International Search Report and Written Opinion in PCT/US2013/033129 mailed Jun. 25, 2013.
International Search Report and Written Opinion in PCT/US2013/033119 mailed Jun. 25, 2013.
First Office Action in CN201380026446.5 dated Aug. 20, 2015, with English translation.

* cited by examiner

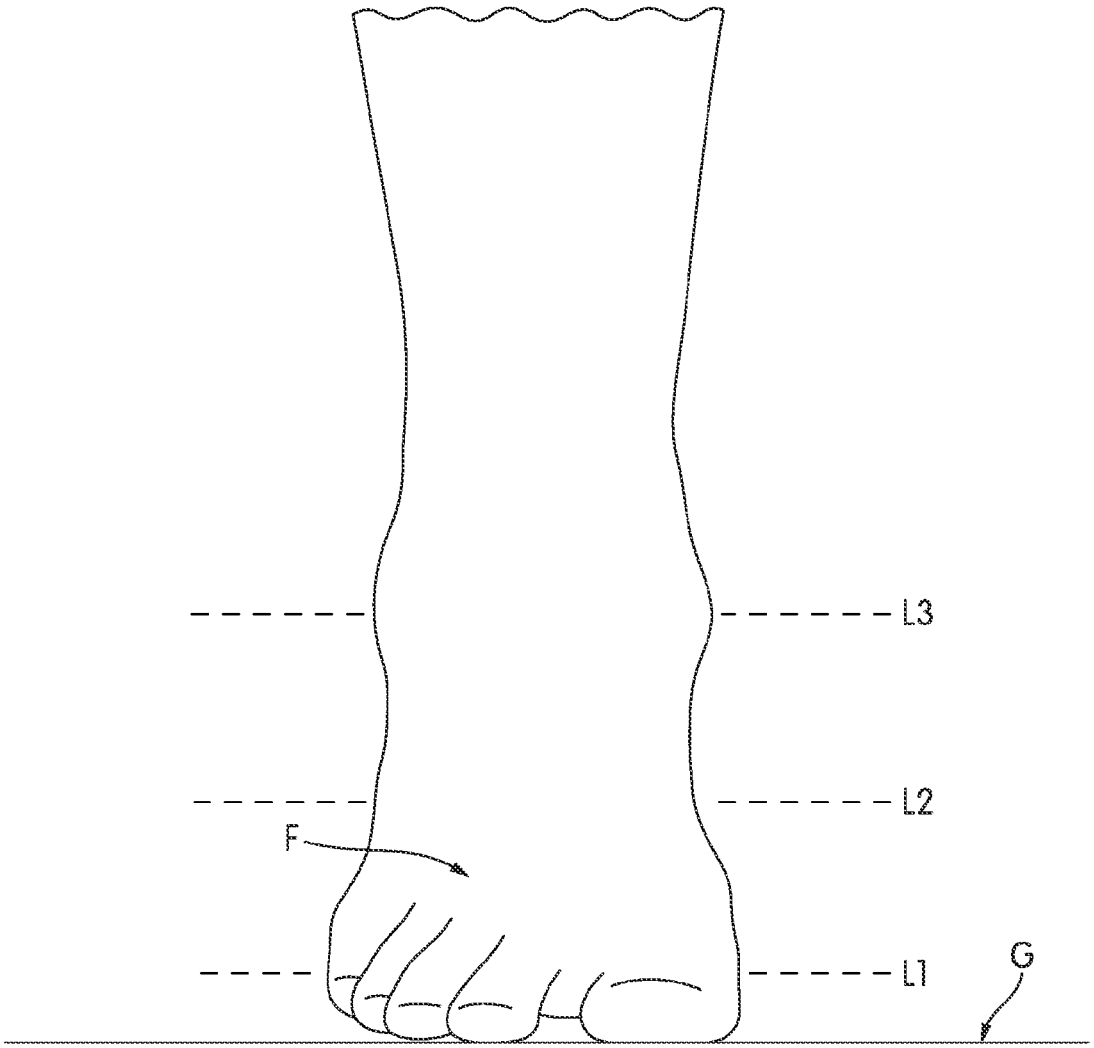
FIG. 1A1

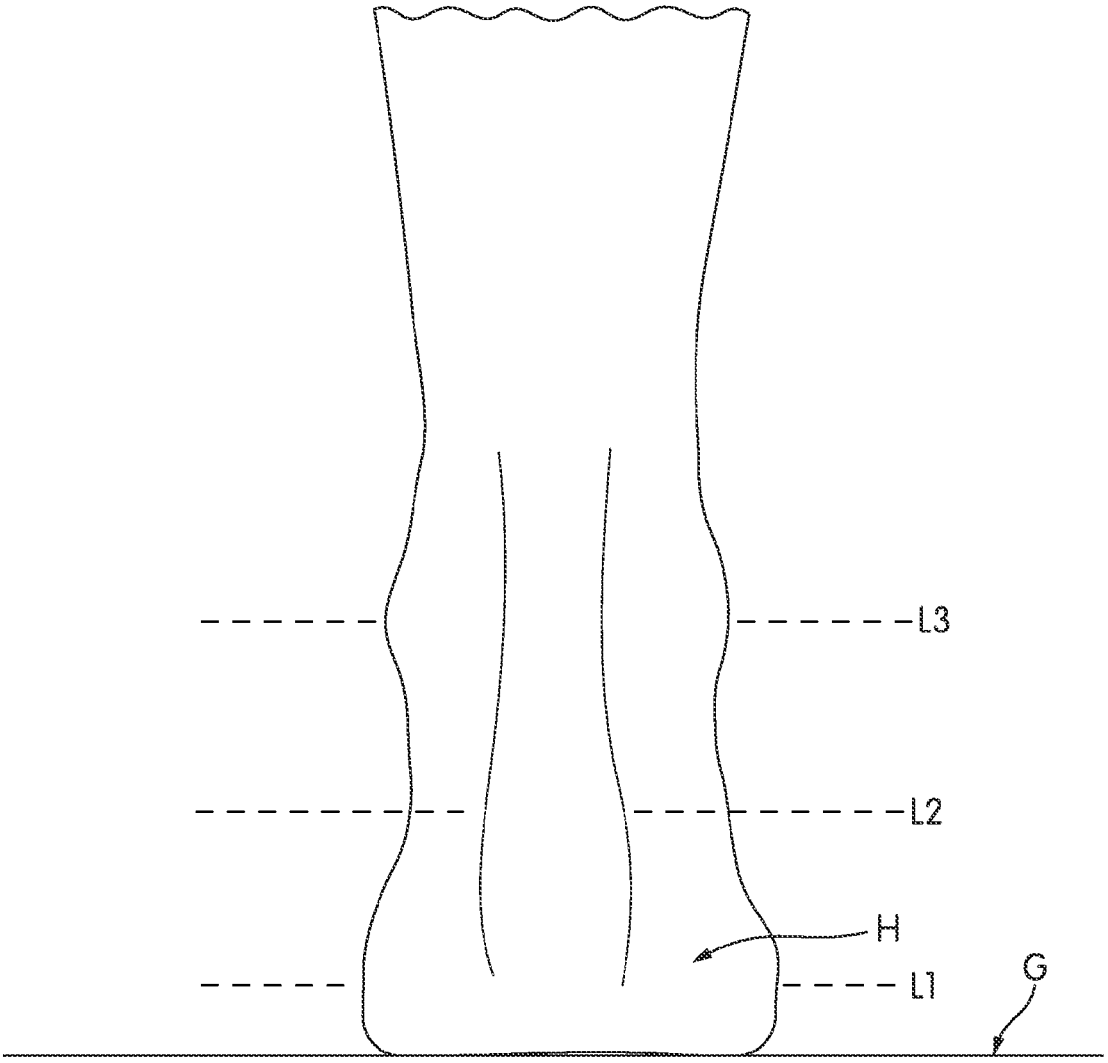
FIG. 1A2

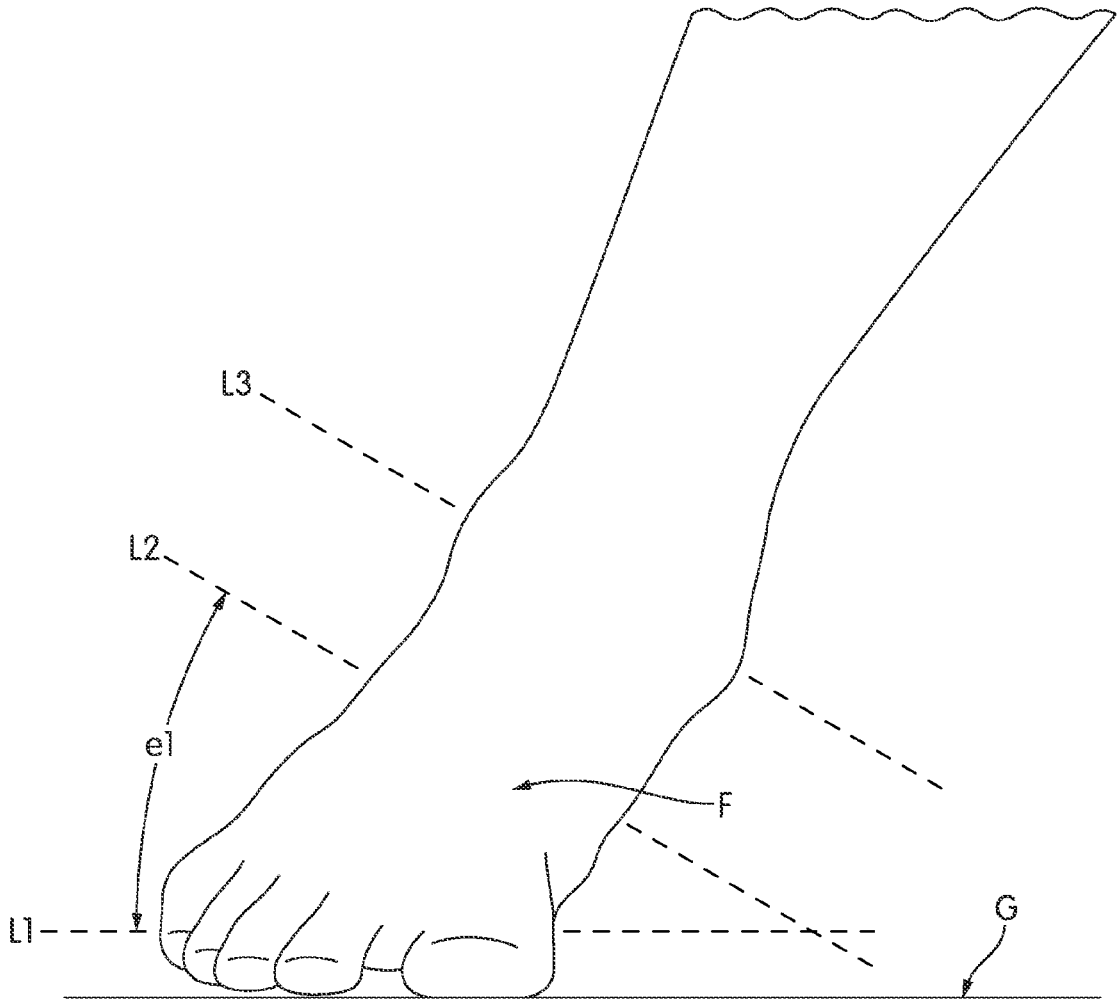
FIG. 1B1

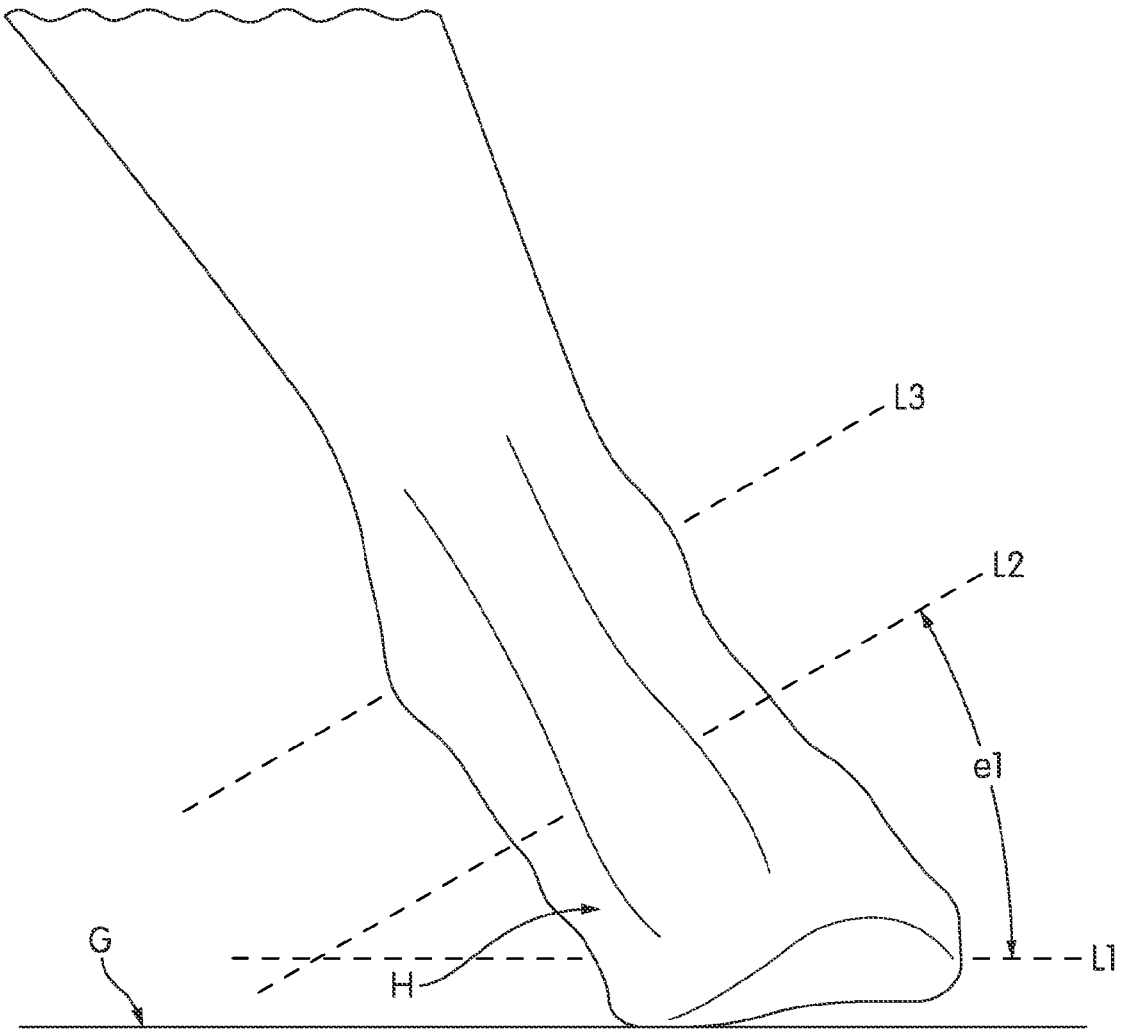
FIG. 1B2

ARTICULATED SHANK

CROSS-REFERENCE TO RELATED APPLICATION

This application claims priority to U.S. provisional patent application Ser. No. 61/614,268, titled "Footwear Configured to Allow Relative Heel/Forefoot Motion" and filed Mar. 22, 2012. Provisional patent application 61/614,268, in its entirety, is incorporated by reference herein.

BACKGROUND

In many athletic and other types of activities, a person may rapidly move to the side. One well-known example is a "cut" maneuver performed by a forward moving player in basketball. During these and other types of events, a person's foot can experience significant forces and motions. Designing footwear to support and/or protect the foot during such activities remains an ongoing challenge.

SUMMARY

This Summary is provided to introduce a selection of concepts in a simplified form that are further described below in the Detailed Description. This Summary is not intended to identify key features or essential features of the invention.

In at least some embodiments, shoes and/or shoe elements facilitate natural foot motion and/or reduce forces tending to fight natural foot motion. In at least some such embodiments, a wearer's heel is secured to the hindfoot region of a shoe in a manner that permits heel/forefoot rotation and that allows the lower leg to remain straight. The heel can be secured in this manner using a strap system.

In further embodiments, a shoe can include a heel supporting component that is separate from a midsole component. The heel supporting component can move toward the lateral side and/or medial side of the shoe (e.g., to rotate, slide and rotate, etc.) along an interface between the heel supporting component and the midsole component.

Other embodiments can include support members for a plantar surface of a foot (and footwear containing such support members) that include: (a) a heel support region; (b) a forefoot support region; (c) a lateral side member extending between and fixed to the heel support region and the forefoot support region; and (d) a medial side member extending between the heel support region and the forefoot support region. The medial side member can be fixed to the heel support region and include a free end not fixed to the forefoot support region and partially overlapping with a major surface of the forefoot support region.

Additional embodiments include sole structures for articles of footwear (and footwear containing such sole structures) that include: (a) a midsole component (optionally made from or containing a foam material) providing support for a plantar surface of a foot; (b) a plate supporting at least a rearfoot region of the midsole component; and (c) a lower foam component supporting the lower rearfoot surface of the plate. The lower foam component may have a curved upper surface (to receive a curved surface of the plate) and a flatter (and even a substantially flat) lower surface. The lower foam component (or at least its medial side) may be softer, less dense, and/or more compressible than the midsole component and the plate so that the lower foam component (or at least a medial side of it) may substantially compress during phases of a direction change or cutting maneuver.

Additional embodiments are described herein.

BRIEF DESCRIPTION OF THE DRAWINGS

Some embodiments are illustrated by way of example, and not by way of limitation, in the figures of the accompanying drawings and in which like reference numerals refer to similar elements.

FIGS. 1A1 and 1A2 are front and rear views, respectively, of an unshod foot when a subject is standing straight.

FIGS. 1B1 and 1B2 show outside foot motion during a cutting maneuver by a barefoot individual.

DETAILED DESCRIPTION

Definitions

Figure 1C:
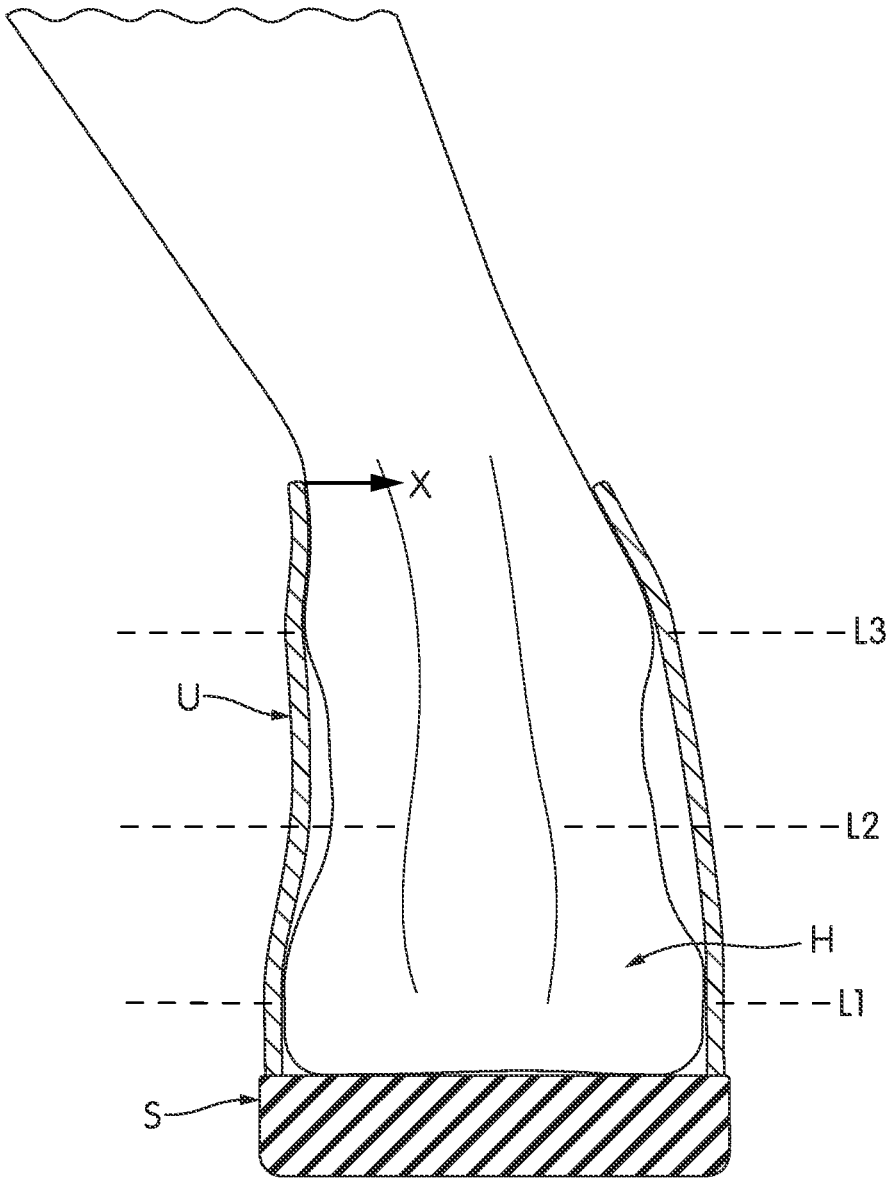
FIG. 1C is a rear view of a shod foot during a cutting maneuver similar to that of FIGS. 1B1 and 1B2.

To assist and clarify subsequent description of various embodiments, various terms are defined herein. Unless context indicates otherwise, the following definitions apply throughout this specification (including the claims). "Shoe" and "article of footwear" are used interchangeably to refer to articles intended for wear on a human foot. A shoe may or may not enclose the entire foot of a wearer. For example, a shoe could include a sandal or other article that exposes large portions of a wearing foot. The "interior" of a shoe refers to space that is occupied by a wearer's foot when the shoe is worn. An "interior side" (or surface) of a shoe element refers to a face of that element that is (or will be) oriented toward the shoe interior in a completed shoe. An "exterior side" (or surface) of an element refers to a face of that element that is (or will be) oriented away from the shoe interior in the completed shoe. In some cases, the interior side of an element may have other elements between that interior side and the interior in the completed shoe. Similarly, an exterior side of an element may have other elements between that exterior side and the space external to the completed shoe.

A longitudinal foot axis refers to a horizontal heel-toe axis along the center of the foot, while that foot is resting on a horizontal surface, that is generally parallel to a line along the second metatarsal and second phalangeal bones. A transverse foot axis refers to a horizontal axis across the foot that is generally perpendicular to the longitudinal axis. A longitudinal direction is parallel to the longitudinal axis or has a primary directional component that is parallel to the longitudinal axis. A transverse direction is parallel to a transverse axis or has a primary directional component that is parallel to a transverse axis.

Shoe elements can be described based on regions and/or anatomical structures of a human foot wearing that shoe, and by assuming that shoe is properly sized for the wearing foot. As an example, a forefoot region of a foot includes the metatarsal and phalangeal bones. A forefoot element of a shoe is an element having one or more portions located over, under, to the lateral and/or medial side of, and/or in front of a wearer's forefoot (or portion thereof) when the shoe is worn. As another example, a midfoot region of a foot includes the cuboid, navicular, medial cuneiform, intermediate cuneiform and lateral cuneiform bones and the heads of the metatarsal bones. A midfoot element of a shoe is an element having one or more portions located over, under and/or to the lateral and/or medial side of a wearer's midfoot (or portion thereof) when the shoe is worn. As a further example, a hindfoot region of a foot includes the talus and calcaneus bones. A hindfoot element of a shoe is an element having one or more portions located over, under, to the lateral and/or medial side of, and/or behind a wearer's hindfoot (or portion thereof) when the shoe is worn. The forefoot region may overlap with the midfoot region, as may the midfoot and hindfoot regions.

Foot Motion During Sideways Body Movements

In many types of athletic and other activities, a person may rapidly move to his or her side. For example, basketball and other sports often require a forward-moving player to rapidly "cut" to the left or right. In these cutting maneuvers, the player typically pushes hard on the outside foot (the right foot when cutting left, and vice versa). As a result, that outside foot can experience significant sideways forces and motions. A person can impose similar forces and motions on a foot when moving quickly to the left or right from a standing position. Other types of activities (e.g., shuttle running, jumping) can also impose these types of forces and movements to varying degrees.

The assignee of this application has conducted research regarding human foot motion during various sideways body movements. For reference purposes, FIGS. 1A1 and 1A2 respectively show front (anterior) and rear (posterior) views of an unshod foot when a subject is standing straight. As seen in these figures, the bottom (plantar) surfaces of the heel H and forefoot F of a subject's foot are both resting on the ground G in a generally flat condition. The talar joint is neutral with respect to the forefoot, as there is minimal plantar or dorsial flexion. The subtalar joint is neutral with respect to the heel. There is no eversion of the heel relative to the ankle, as the calcaneus is not angled toward the lateral side of the talus. There is also no inversion of the heel relative to the ankle, as the calcaneus is not angled toward the medial side of the talus.

Horizontal lines L1, L2 and L3 are included in FIGS. 1A1 and 1A2 for purposes of comparison with later drawing figures. Line L1 is drawn through an arbitrary horizontal transverse axis in forefoot F. Because relative positions of forefoot bones can change during foot movements, line L1 is also assumed to be fixed relative to a single forefoot bone (e.g., the distal end of the first metatarsal). Horizontal line L2 is drawn through an arbitrary transverse axis in heel H and is assumed to be fixed relative to the calcaneus. Horizontal line L3 is drawn through an arbitrary transverse axis in the ankle A and is assumed to be fixed relative to the talus.

FIGS. 1B1 and 1B2 show outside foot motion during a 90-degree cutting maneuver by a barefoot individual. FIGS. 1B1 and 1B2 are not intended as exact reproductions of any specific instance of testing. Instead, FIGS. 1B1 and 1B2 were prepared to generally illustrate the type of motion, observed during the above-mentioned research, that an unshod foot can experience during a cut. FIG. 1B1 is a front view of an unshod outside foot in the later stage of a cut. In particular, FIG. 1B1 depicts a time point in the cut after the outside foot has landed and the subject has completed roughly 50% of the maneuver. FIG. 1B2 is a rear view of that same foot at the same time point. In FIGS. 1B1 and 1B2, lines L1-L3 have the same fixed positions relative to the single forefoot bone, to the calcaneus, and to the talus, respectively, as those lines have in connection with FIGS. 1A1 and 1A2.

As seen in FIG. 1B1, and at least along transverse directions, forefoot F is generally flat relative to the plane of the ground surface G. Line L1 remains generally parallel to the ground surface G. Heel H is now everted relative to forefoot F, however. In particular, and as shown in both FIGS. 1B1 and 1B2, line L2 is now at an eversion angle e1 relative to line L1. During tests involving barefoot cutting maneuvers, heel/forefoot eversion angles (e.g., angle e1) of approximately 20° to 30° were observed. As also seen in FIGS. 1B1 and 1B2, however, the subtalar joint of ankle A remains neutral. A comparison of lines L2 and L3 shows that these lines are generally parallel. Thus, the calcaneus is generally not everted with respect to the talus. As a result, the subject's heel and lower leg remain relatively straight.

The barefoot motions of FIGS. 1B1 and 1B2 reflect natural tendencies of a human foot during extreme sideways maneuvers. Conventional uppers and sole structures can resist normal foot motion. This is illustrated in FIG. 1C, a rear view of a shod foot during a cutting maneuver similar to that of FIGS. 1B1 and 1B2 and at the same time point in the cutting maneuver. As with FIGS. 1B1 and 1B2, FIG. 1C is not intended as an exact reproduction of any specific instance of testing, and was instead prepared to generally illustrate a type of motion observed during the above-mentioned research. Lines L1, L2 and L3 in FIG. 1C have the same fixed positions relative to foot bones as in previous figures.

In the example of FIG. 1C, the subject is wearing a shoe of conventional design. Elements of the shoe are shown in area cross section so that the position of the foot can be seen. The shoe includes a conventional high-top upper U that is secured around the foot by lacing (not shown). Upper U is substantially inelastic and does not appreciably stretch under loads imposed by wearer activity. Upper U is secured to a conventional sole structure S along substantially all of the interface between sole structure S and upper U. A lower edge of upper U is anchored to sole structure S around the entire perimeter of the foot, with the location of that anchoring being generally aligned with (or just to the inside or outside of) that perimeter.

In the scenario of FIG. 1C, tension in the lateral hindfoot portion of upper U is translated to the medial ankle collar region of upper U. This creates a force X that tends to pull the ankle laterally. Consequently, the lower leg is no longer in its naturally straight condition. Instead, and as can be seen by comparing lines L2 and L3, the heel is inverted relative to the ankle. Moreover, the natural heel-forefoot eversion (angle e1 in FIG. 1B2) is reduced or eliminated.

At least some embodiments include shoes and/or shoe elements that facilitate natural foot motion and/or reduce forces tending to fight natural foot motion.

In at least some embodiments, a wearer's heel is secured to the hindfoot region of a shoe in a manner that permits heel/forefoot rotation and that allows the lower leg to remain straight. In some such embodiments, the heel is secured in this manner using a strap system. The strap system can also be incorporated into an upper that includes elastic portions in the hindfoot region.

In at least some additional embodiments, an outer edge of a heel can be rounded.

In further embodiments, a shoe can include a heel supporting component in the heel area (also called the "hindfoot" or "rearfoot" area herein) that is separate from a midsole component also provided in the heel area to allow the heel supporting component to move toward the lateral side and/or medial side of the shoe (e.g., to rotate, slide and rotate, etc.) along an interface (interfacing surfaces) between the heel supporting component and the midsole component. Using this construction, the rearfoot portion of the structure can move relative to the forefoot portion during phases of a cutting or direction change maneuver to maintain a more neutral and natural ankle/foot orientation and/or motion.

Yet other embodiments include support members for a plantar surface of a foot (and footwear containing such support members) that include: (a) a heel support region; (b) a forefoot support region; (c) a lateral side member extending between and fixed to the heel support region and the forefoot support region; and (d) a medial side member extending between the heel support region and the forefoot support region. This medial side member is fixed to the heel support region and includes a free end that is not fixed to the forefoot support region and partially overlaps with a major surface of the forefoot support region. Using this construction, the medial side of the wearer's foot can move more easily with respect to the lateral side of the foot and/or the rear portion of the foot can move with respect to the forefoot portion of the foot during phases of a direction change or cutting maneuver to maintain a more neutral and natural ankle/foot orientation and/or motion.

Still other embodiments include sole structures for articles of footwear (and footwear containing such sole structures) that include: (a) a midsole component (optionally made from or containing a foam material) providing support for a plantar surface of a foot; (b) a plate supporting at least a rearfoot region of the midsole component; and (c) a lower foam component supporting the lower rearfoot surface of the plate. The lower foam component may have a curved upper surface (to receive a curved surface of the plate) and a flatter (and even a substantially flat) lower surface. The lower foam component (or at least its medial side) may be softer, less dense, and/or more compressible than the midsole component and the plate so that the lower foam component (or at least a medial side of it) will substantially compress during phases of a direction change or cutting maneuver. The additional compression of the medial side of the lower foam component helps maintain a more neutral and natural ankle/foot orientation and/or motion during these movements.

Embodiments also comprise shoes that combine features from one or more of the abovementioned embodiments. Although some embodiments are described below in connection with certain specific shoes, and/or by describing certain shapes, sizes and locations of various shoe elements, any specifics are merely examples. Similarly, various examples may include shoes intended for certain activities. Other embodiments include shoes intended for use in activities that may not be explicitly mentioned herein. Embodiments are not limited to complete shoes. Thus, some embodiments include portions of shoes, processes for fabricating shoes or shoe portions, and processes of using shoes or shoe portions.

Hindfoot Strap System Permitting Natural Foot Motion

At least some embodiments include a shoe in which the upper comprises a hindfoot strap system. That strap system can secure a wearer heel to a sole structure while reducing unnatural constraints imposed by many conventional footwear designs. For example, some uppers utilizing such a strap system permit greater eversion of a heel relative to a forefoot and allow a lower leg to remain straighter during cutting maneuvers.

Figure 2A:
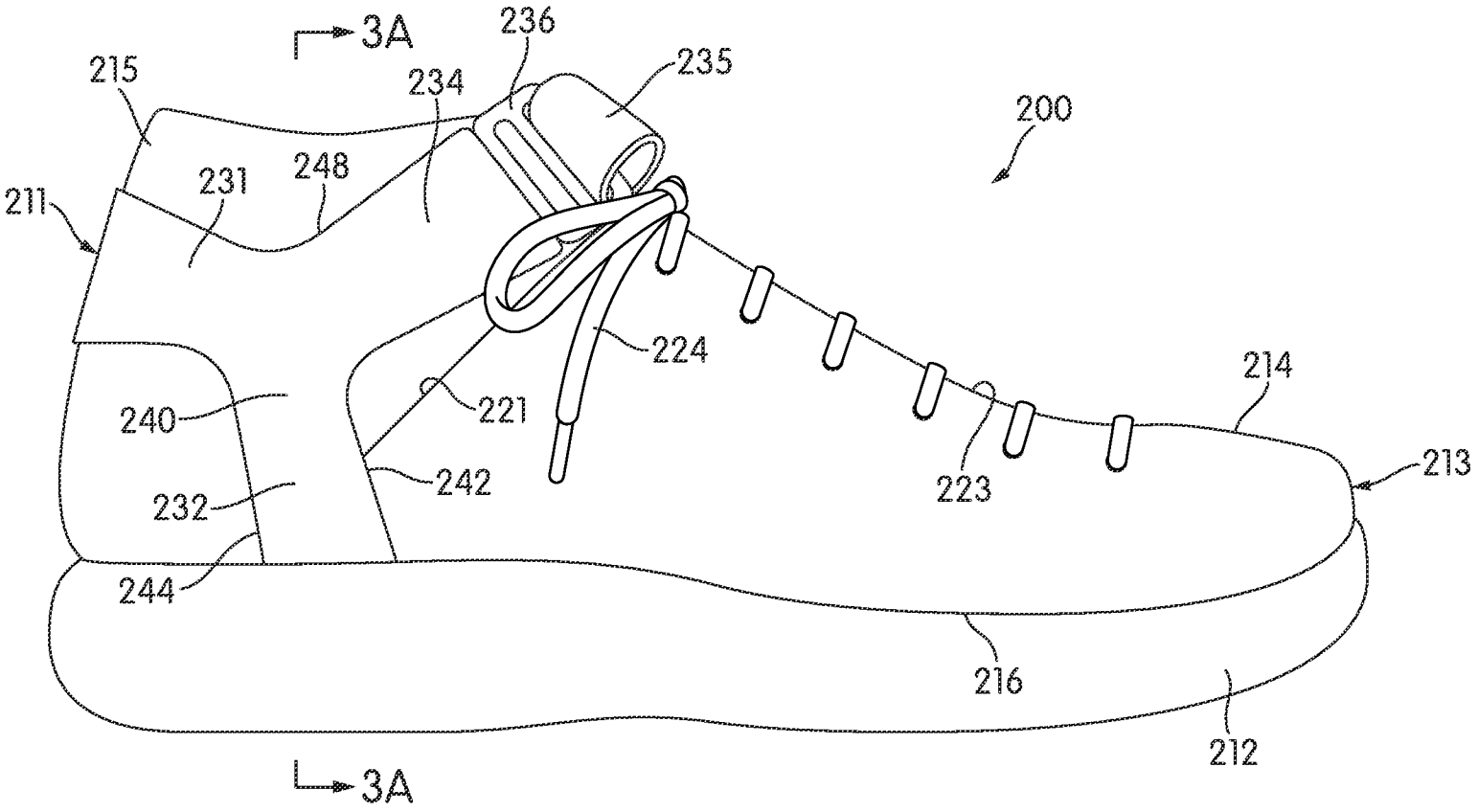
FIGS. 2A, 2B and 2C are lateral, rear and medial views, respectively, of a shoe according to some embodiments.
Figure 2B:
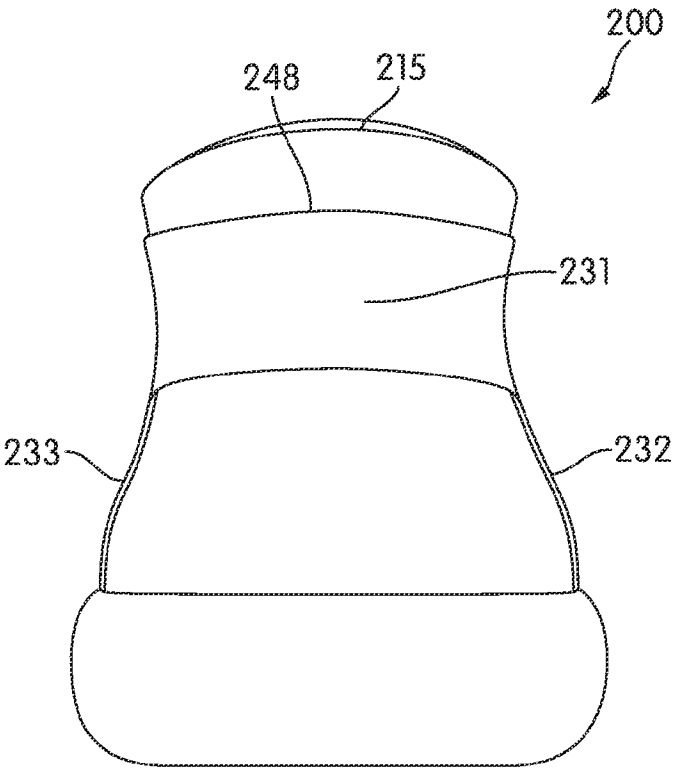
Figure 2C:
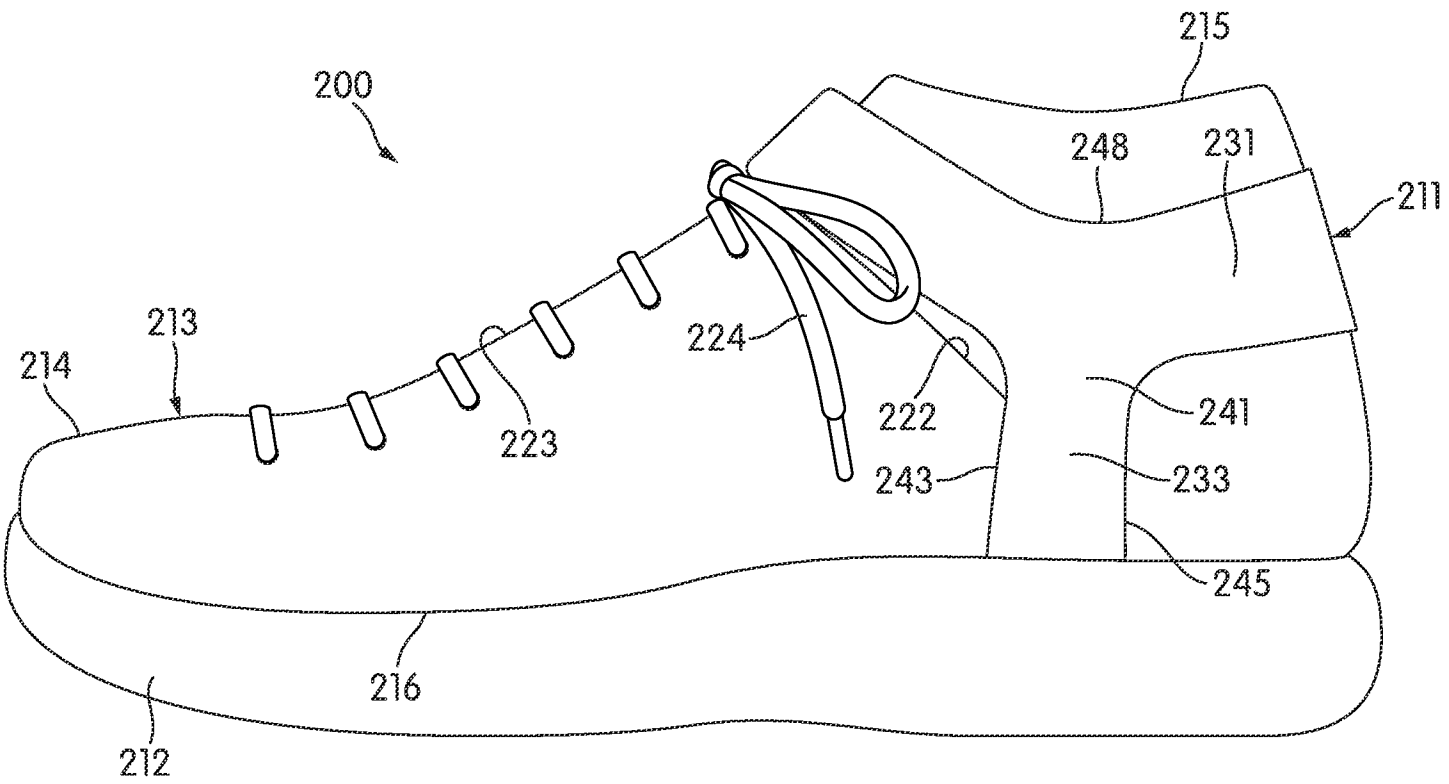

FIGS. 2A through 2C are lateral, rear and medial views of a shoe 200, according to some embodiments, in which an upper includes a hindfoot strap system. Shoe 200 includes a sole structure 212 and an upper 213. Upper 213 includes a forward element 214, a hindfoot strap system 211 and a bootie 215. Sole structure 212 could be any of numerous widely varying types of sole structures. As one example, sole structure 212 could be a single piece molded from synthetic rubber or other material. As another example, sole structure 212 could include multiple components that have been sequentially molded or otherwise bonded together. Such a sole structure could include a midsole formed from a first material (e.g., foamed ethylene vinyl acetate) bonded to an outsole formed from different materials (e.g., synthetic rubber). Sole structure 212 could also include one or more fluid-filled cushions, a stiffening plate or other support element(s), traction elements (e.g., cleats), etc. For convenience, and because of the numerous variations in sole structures that can be included in various embodiments of shoe 200, sole structure 212 is treated as a single unitary component in FIGS. 2A-2C.

Forward element 214 of upper 213 covers a wearer forefoot and includes portions that extend partially into the wearer midfoot and hindfoot regions. A lower edge 216 of forward element 214 is anchored to sole structure 212. An internal cavity between element 214 and sole structure 212 contains a wearer forefoot. Although not visible in FIG. 2A, a lateral side corner of edge 221 is in a location that is approximately aligned with a wearer cuboid and/or with posterior portions of the wearer talus and calcaneus. Similarly, a medial side corner of edge 222, not visible in FIG. 2C, is in a location that is approximately aligned with a wearer navicular and/or with posterior portions of the wearer talus and calcaneus. Lateral rear edge 221 of element 214 extends forward and upward to a lateral side of a tongue opening 403. Tongue opening 403 is not visible in FIGS. 2A-2C, but is visible in FIG. 4. Medial rear edge 222 of element 214 extends forward and upward to a medial side of tongue opening 403. A tongue 402 (FIG. 4) bridges the space of tongue opening 403. Tongue opening 403 can be cinched by a lace 224 so as to secure and conform element 214 to the wearer forefoot. Lace 224 is threaded through eyelets on the lateral and medial sides of tongue opening 403, with the rearmost of those eyelets being approximately located over a wearer's intermediate and lateral cuneiform bones when lace 224 is tied in a normally tight manner. As explained in more detail below, element 214 secures a wearer forefoot to sole structure 212.

Strap system 211 includes an ankle strap 231, a lateral heel strap 232 and a medial heel strap 233. As also explained in more detail below, strap system 211 secures a wearer heel to sole structure 212. The front portion of ankle strap 231 can be connected and unconnected to allow a wearer to don and remove shoe 200. Specifically, a lateral end 234 of ankle strap 231 can be attached to a medial end 235 of ankle strap 231 so as to secure ankle strap 231 around the wearer foot under the lateral (fibular) and medial (tibial) malleoli. In the embodiment shown in FIGS. 2A-2C, lateral end 234 includes a ring 236 attached to its end. Medial end 235 includes panels of hook material and pile material. After passing medial end 235 through ring 236, medial end 235 can be secured to itself by pressing the hook panel onto the pile panel. In other embodiments, ends 234 and 235 can be secured in a different manner. For example, each of ends 234 and 235 could include one or more eyelets through which lace 224 (or a separate lace) can be threaded and then tied. As another example, buckles, snaps or other types of connection mechanisms could be used to attach ends of an ankle strap.

A top portion 240 of lateral heel strap 232 is coupled to ankle strap 231 under the wearer lateral malleolus. Similarly, a top portion 241 of medial heel strap 233 is coupled to ankle strap 231 under the wearer medial malleolus. Top portions 240 and 241 can be coupled to ankle strap 231 by direct attachment or in other ways. In some embodiments, for example, a top portion of a heel strap could be pivotally attached to ankle strap 231 with a rivet. As another example, ankle strap 231 and heel straps 232 and 233 could be cut as a single piece from a larger panel of material. Forward edges 242 and 243 of lateral heel strap 232 and medial heel strap 233 are located in the hindfoot and/or midfoot regions of upper 213. Rear edges 244 and 245 of lateral heel strap 232 and medial heel strap 233 are located in the hindfoot region of upper 213.

In at least some embodiments, ankle strap 231 is asymmetric so as to conform to the asymmetric shape of an ankle region. When the lateral and medial ends 234 and 235 of strap 231 are secured, the front of strap 231 generally rests over the wearer navicular and cuboid and/or over anterior portions of the talus. The lateral side of strap 231 angles downward from the front so that an upper edge 248 of strap 231 is below the lateral malleolus. The lateral side of strap 231 then angles upward behind the lateral malleolus so as to be positioned above the calcaneus tuberosity and approximately aligned with the talus. After the lateral side of ankle strap 231 continues around the rear of the foot and becomes the medial side of ankle strap 231, it angles downward so that upper edge 248 is below the medial malleolus. The medial side of ankle strap 231 then angles upward toward the front. Because the lateral malleolus is below and to the rear of the medial malleolus, ankle strap 231 is thus asymmetric. Indeed, strap system 211 as a whole is asymmetric. Because heel straps 232 and 233 are coupled to ankle strap 231 under the malleoli, lateral heel strap 232 is shorter and more rearward than medial heel strap 233.

Bootie 215 is included in upper 213 to enhance wearer comfort. For example, bootie 215 provides a layer of cushioning between strap system 211 and a wearer's skin to prevent chafing. Bootie 215 also provides abrasion protection to wearer skin in the heel region. In other embodiments, bootie 215 may be omitted. Bootie 215 may be configured so as not to restrict heel movement. For example, bootie 215 may rest within strap system 211, but may be unattached to strap system 211 or to sole structure 212. A forward edge of bootie 215 (not shown) is attached to forward element 214, but the portion of bootie 215 rearward of that attachment may be free to move relative to strap system 211 and sole structure 212. In other embodiments, bootie 215 may be glued to sole structure 212.

In some embodiments, forward element 214 and strap system 211 are substantially inelastic. In other words, neither forward element 214 nor strap system 211 appreciably stretches under loads that might be imposed by a wearer. Because of the way in which these components are attached to sole structure 212, however, natural foot motion is accommodated. Forward element 214 is anchored to sole structure 212 at or around the outer perimeter of a wearer forefoot. Thus, forward element 214 serves to hold the forefoot flat against sole structure 212. Because the forefoot does not rotate relative to the forefoot portion of the sole structure (or only rotates a small amount), the forefoot is thus non-rotationally secured to the forefoot portion of the sole structure. This is not a concern, however. As indicated above in connection with FIG. 1B1, the forefoot remains relatively flat during sideways maneuvers. Thus, forefoot element 214 does not force the forefoot into an unnatural position and does not fight against natural motion tendencies of the foot.

Figure 3A:
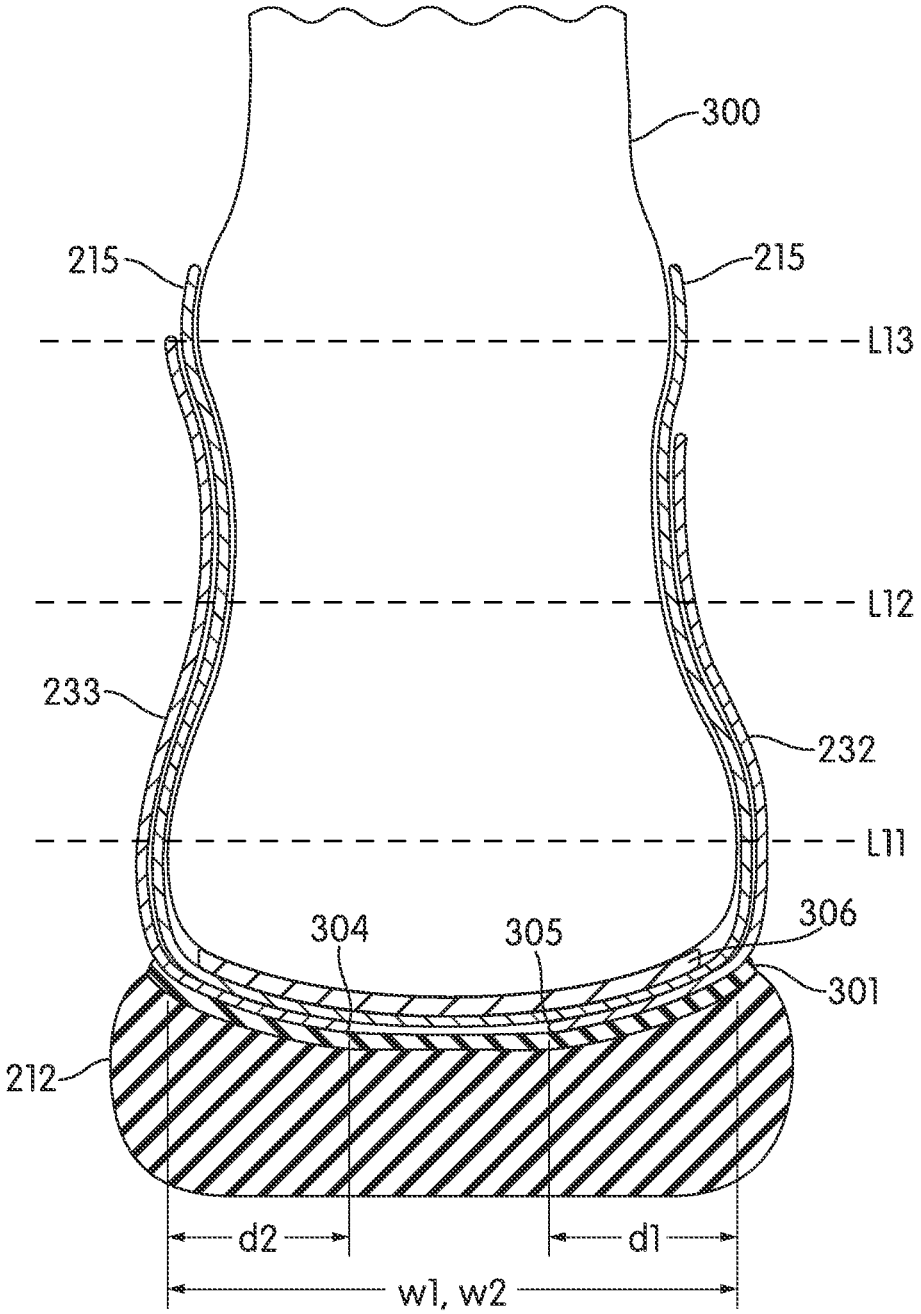
FIGS. 3A and 3B are area cross-sectional views of the shoe shown in FIGS. 2A through 2C.
Figure 3B:
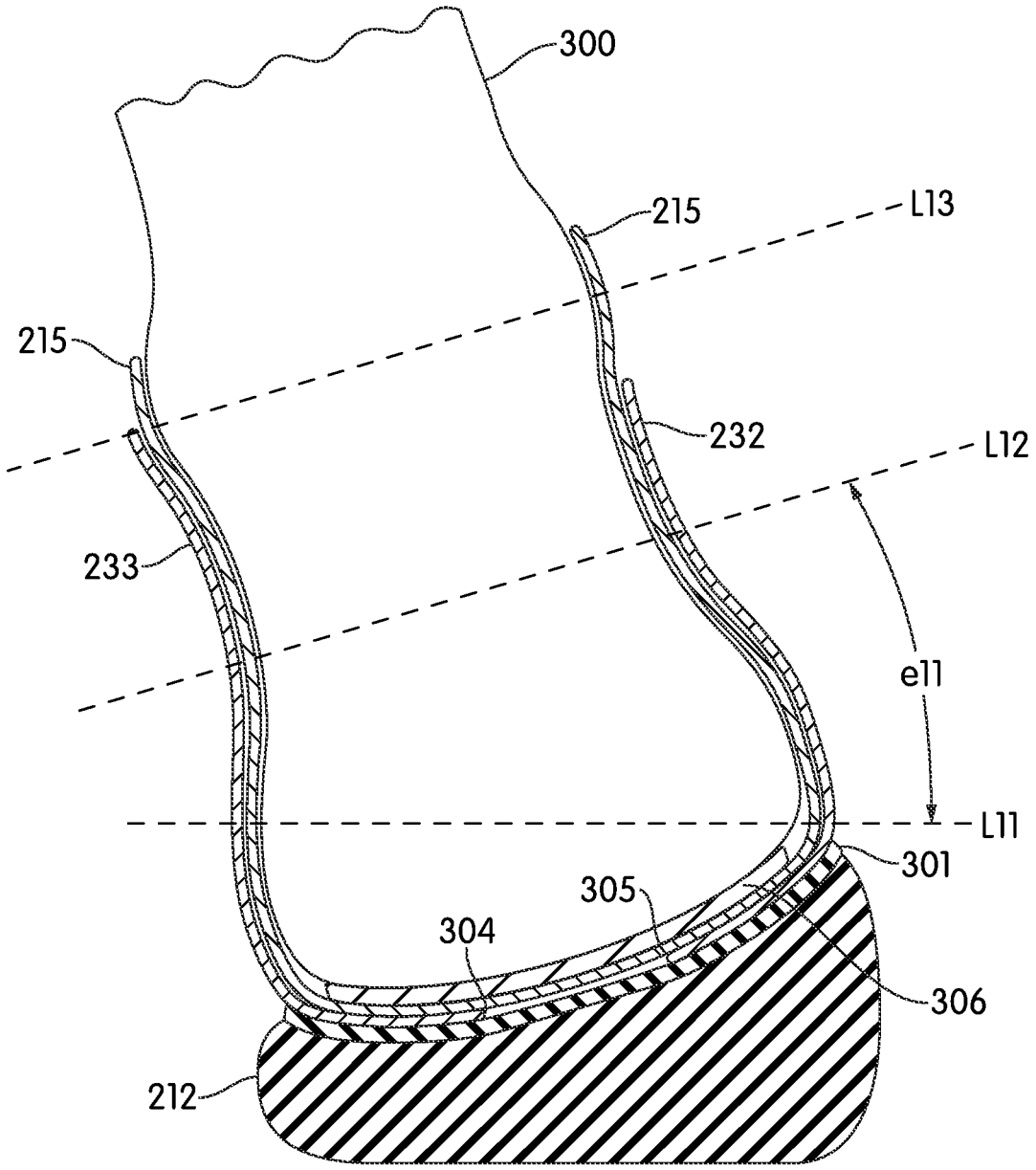

Conversely, strap system 211 accommodates the foot motion described above in connection with FIG. 1B2 and allows increased motion of a heel relative to a forefoot. In particular, strap system 211 secures a wearer heel to sole structure 212 and allows the wearer heel to tilt relative to the forward portion of sole structure 212, thereby permitting heel rotation relative to the forefoot. This is illustrated in FIGS. 3A and 3B. FIG. 3A is an area cross-sectional view of shoe 200 partially taken from the location indicated in FIG. 2A. As indicated above, strap system 211 is not symmetric. Accordingly, the sectioning plane on the left side of FIGS. 3A and 3B is forwardly offset (i.e., toward to the toe of shoe 200) from the sectioning plane on the right side of the figure so as to show straps 232 and 233. A wearer foot 300 is added in FIGS. 3A and 3B, but the internal anatomy of foot 300 in the sectioning plane is not shown. Lines L11, L12 and L13 in FIGS. 3A and 3B are respectively similar to lines L1, L2 and L3 of FIGS. 1A1 through 1C. For convenience, small pieces of forward element 214 that might also appear in the cross sectional views of FIGS. 3A and 3B have also been omitted for convenience.

FIG. 3A shows a hindfoot portion of a wearer foot 300 when the wearer is standing straight on a horizontal surface. For purposes of clarification, some space has been added between adjacent elements in FIG. 3A. In an actual shoe, some or all of that added space could be absent and elements shown to be separated in FIG. 3A might be in direct contact. In addition to strap system 211, sole structure 212 and bootie 215, FIG. 3A shows a base member 301. Base member 301 can be a Strobel or other type of lasting element. Member 301 can be stitched to forward element 214 and bonded to sole structure 212 in a manner described below. FIG. 3A also shows a sock liner 306 resting within bootie 215. Sock liner may extend the full length of the interior of shoe 200. As indicated above, bootie 215 may not be attached to sole structure 212 in the heel region. Sock liner 306 may similarly be unattached to sole structure 212 in the heel region, although a lower surface of liner 306 could be coated with a tacky material (e.g., a glue that does not fully cure) so as to prevent slipping between liner 306 and bootie 215 or between liner 306 and sole structure 212 in forefoot regions of shoe 200.

As seen in FIG. 3A, a bottom portion of lateral heel strap 232 is anchored to base member 301 (and thus to sole structure 212) at a location 305 under the heel of foot 300. Anchor location 305 is well inside the outer perimeter of the foot 300 heel and lies under the lateral front part of the heel fat pad. In some embodiments, the transverse distance d1 from anchor location 305 to the lateral perimeter of the foot is at least 10% of the average cross-heel width w1 at a point along the longitudinal length of shoe 200 corresponding to location 305. In other embodiments, the transverse distance d1 is at least 15% or at least 20% of that average cross-heel width w1. The underside portion of lateral heel strap 232 extending from location 305 and contacting base member 301 may be glued or otherwise bonded to base member 301.

As also shown in FIG. 3A, a bottom portion of medial heel strap 233 is anchored to base member 301 and to sole structure 212 at a location 304 under the heel of foot 300. Anchor location 304 is also well inside the outer perimeter of the foot 300 heel and lies under the medial front part of the heel fat pad. In some embodiments, the transverse distance d2 from anchor location 304 to the medial perimeter of the foot is at least 10% of the average cross-heel width w2 at a point along the longitudinal length of shoe 200 corresponding to anchor location 304. In other embodiments, the transverse distance d2 is at least 15% or at least 20% of that average cross-heel width w2. Distance w1 may be the same as distance w2, but this need not be the case. Similarly, distances d1 and d2 may, but need not, be equal. The underside portion of medial heel strap 233 extending from location 304 and contacting base member 301 may be glued or otherwise bonded to base member 301.

FIG. 3B is an area cross-sectional view of shoe 200 taken from the same location as FIG. 3A. In FIG. 3B, however, foot 300 is the outside foot while the wearer of shoe 200 is performing a cutting maneuver. As seen in FIG. 3B, shoe 200 allows movement of foot 300 that is more like the barefoot movement seen in FIG. 1B2. The configuration of heel straps 233 and 232, and of strap system 211, can accommodate the motion of foot 300 with less laterally outward pulling of the foot 300 ankle than has been observed in conventional shoes. For example, the positioning of anchor locations 304 and 305 allows reduction of the forces on strap system 211 and other portions of upper 213 during various extreme movements that might be contrary to natural motion. As a result, and as is shown by lines L12 and L13 being roughly parallel, the lower leg is straighter and in a condition that more closely conforms to natural foot motion. The natural eversion of the foot 300 heel relative to the forefoot is present, as can be seen by comparing lines L11 and L12. The eversion angle e11 may approach the barefoot version angle e1 (see FIG. 1B2).

FIG. 3B assumes that sole structure 212 is a deformable elastomeric material. The degree of deformation in the hindfoot region of sole structure 212 is exaggerated in FIG. 3B for purposes of illustration. Nonetheless, under conditions such as those described in connection with FIG. 3B, strap system 211 would facilitate compression of the medial side of the hindfoot region of sole structure 212 and expansion of the lateral side of the hindfoot region of sole structure 212. In turn, this would help permit rotation of the wearer ankle relative to the wearer forefoot.

Straps 231, 232 and 233 can be formed from various materials. In some embodiments, one or more of straps 231, 232 and 233 can include embedded reinforcing fiber strands. Example materials for such strands include liquid crystal polymer (LCP) fibers of aromatic polyester such as are sold under the trade name VECTRAN by Kuraray America, Inc. Other example strand materials include but are not limited to nylon and high-tensile polyester. As previously indicated, strap system 211 could be cut as a single piece from a larger piece of material. Alternatively, straps 231, 232 and/or 233 (or portions thereof) could be formed separately and then joined together.

Figure 4:
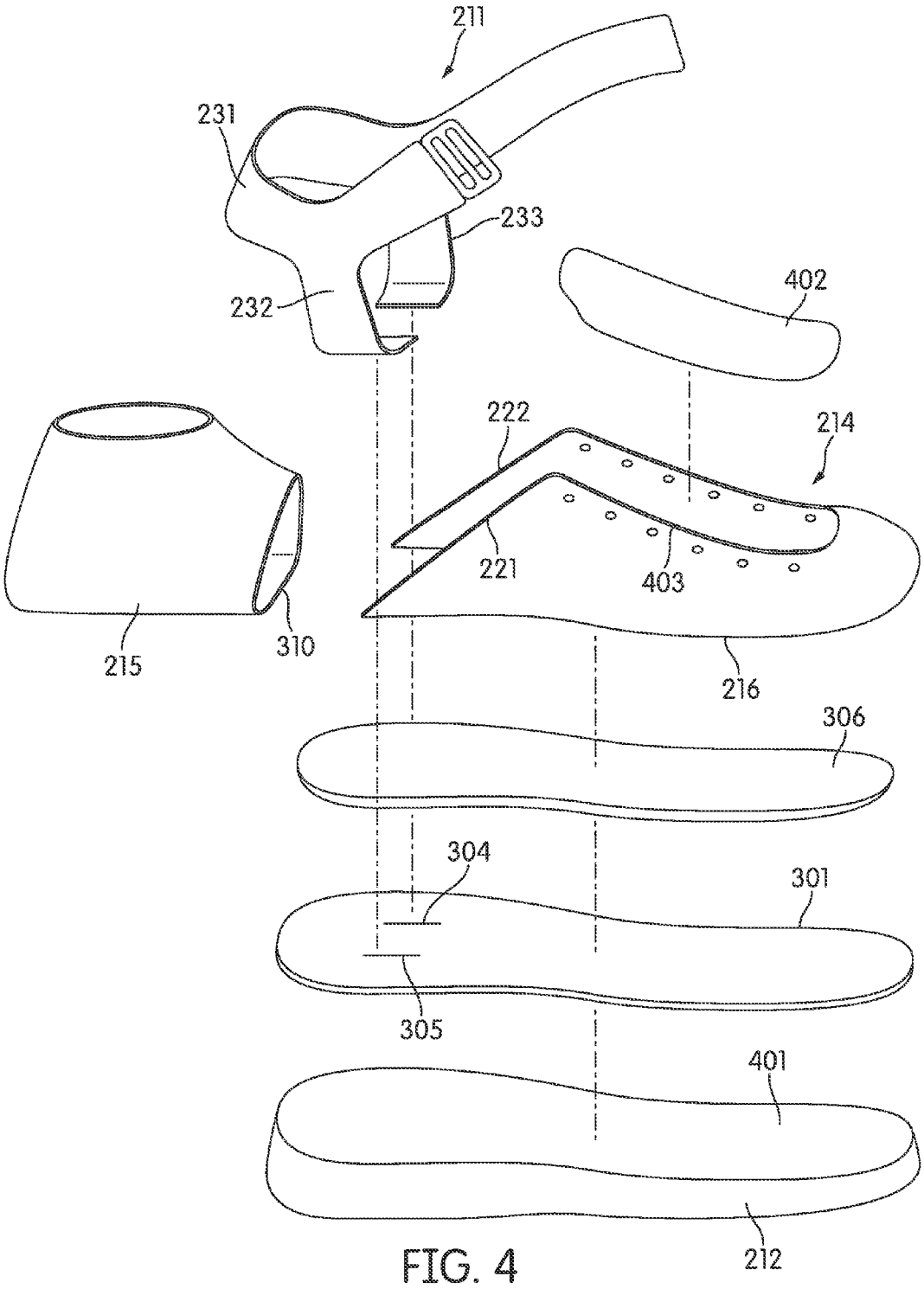
FIG. 4 is an exploded view of a shoe according to some embodiments.

FIG. 4 is an exploded view of shoe 200. Shoe 200 could be assembled by first attaching edge 310 of bootie 215 to interior regions of forward element 214. Next, lower edge 216 of forward element 214 can be stitched or otherwise attached to the outside edge of base member 310 in the corresponding regions of the base member 301 outer perimeter. The end of lateral heel strap 232 and the end of medial heel strap 233 could then be stitched to lateral anchor location 305 and to medial anchor location 304, respectively, on base member 301. The underside portion of lateral heel strap 232 extending from location 305 and contacting base member 301 may be glued or otherwise bonded to base member 301. The underside portion of medial heel strap 233 extending from location 304 and contacting base member 301 may be glued or otherwise bonded to base member 301. The bottom surface of base member 301 can be glued or otherwise attached to top surface 401 of sole assembly 212. Tongue 402 can be stitched in place and sock liner 306 inserted.

In at least some embodiments, the performance of a shoe is improved by independently mapping the shape of the hindfoot strap system directly to actual foot anatomy instead of to a conventional footwear last. Conventional footwear lasts are typically designed with added allowance for material thickness, component insertion, and foam padding. These added allowances cause the shapes of conventional lasts to be significantly different from the shapes actual human feet that would wear shoes fabricated with such lasts. In some embodiments, a hindfoot strap system for a shoe of a particular size can be created by measuring feet corresponding to that size. Such measurements could be in the areas of the foot where the straps would lie. The measurements could be averaged or otherwise statistically processed, some small allowance included to account for a bootie and a wearer's sock, and then used to generate a pattern for straps of a strap system.

As indicated above, shoe 200 offers numerous advantages relative to conventional shoe designs. Under some circumstances, however, various aspects of shoe 200 could pose possible disadvantages. An open portion of upper 200 extends from edge 221 of element 214, around the rear of sole structure 212, and to edge 222. This open region exposes the interface between the plantar side of bootie 215 and the top of base member 301. If bootie 215 is not glued to base member 301, dirt and other foreign matter could thus be entrapped under the plantar side of bootie 215. Moreover, some additional support around the lower portion of the hindfoot might be desirable. In some types of maneuvers, a wearer's heel may be pushed in a direction that is directly toward the rearmost part of the sole structure, or in a direction that has a substantial component toward the rearmost part of the sole structure. In such a maneuver, the wearer foot might slip rearward within strap system 211 and to the rear of shoe 200, and a heel cup or similar reinforcement could thus be beneficial.

For these and other reasons, certain additional embodiments include a hindfoot strap system but also include further support and/or protection in the hindfoot region. In one such additional embodiment, an upper includes an inner element and an outer element. The inner element covers substantially the entire foot and incorporates a hindfoot strap system. As in the embodiment of shoe 200, the hindfoot strap system may be substantially inelastic. However, various portions of the inner element that are distinct from the strap system could be elastic and configured to stretch under loads induced by wearer activity. The outer element surrounds a portion of the foot and is located on the exterior side of the inner element. The outer element can be inelastic. Portions of the outer element in the forefoot and midfoot regions help hold a wearer forefoot to a sole structure in a manner similar to forward element 214 of shoe 200, and thus non-rotationally secure the wearer forefoot to the shoe sole structure. In the hindfoot region, the outer element can be below the ankle on the lateral and medial sides, but may rise up somewhat in the rearmost portion to form a heel cup. The hindfoot strap system within the inner element rotationally secures the heel to the sole structure, as the ability of the wearer heel to tilt relative to the forefoot is only minimally impeded by the outer element or by other portions of the inner element.

Figure 5A:
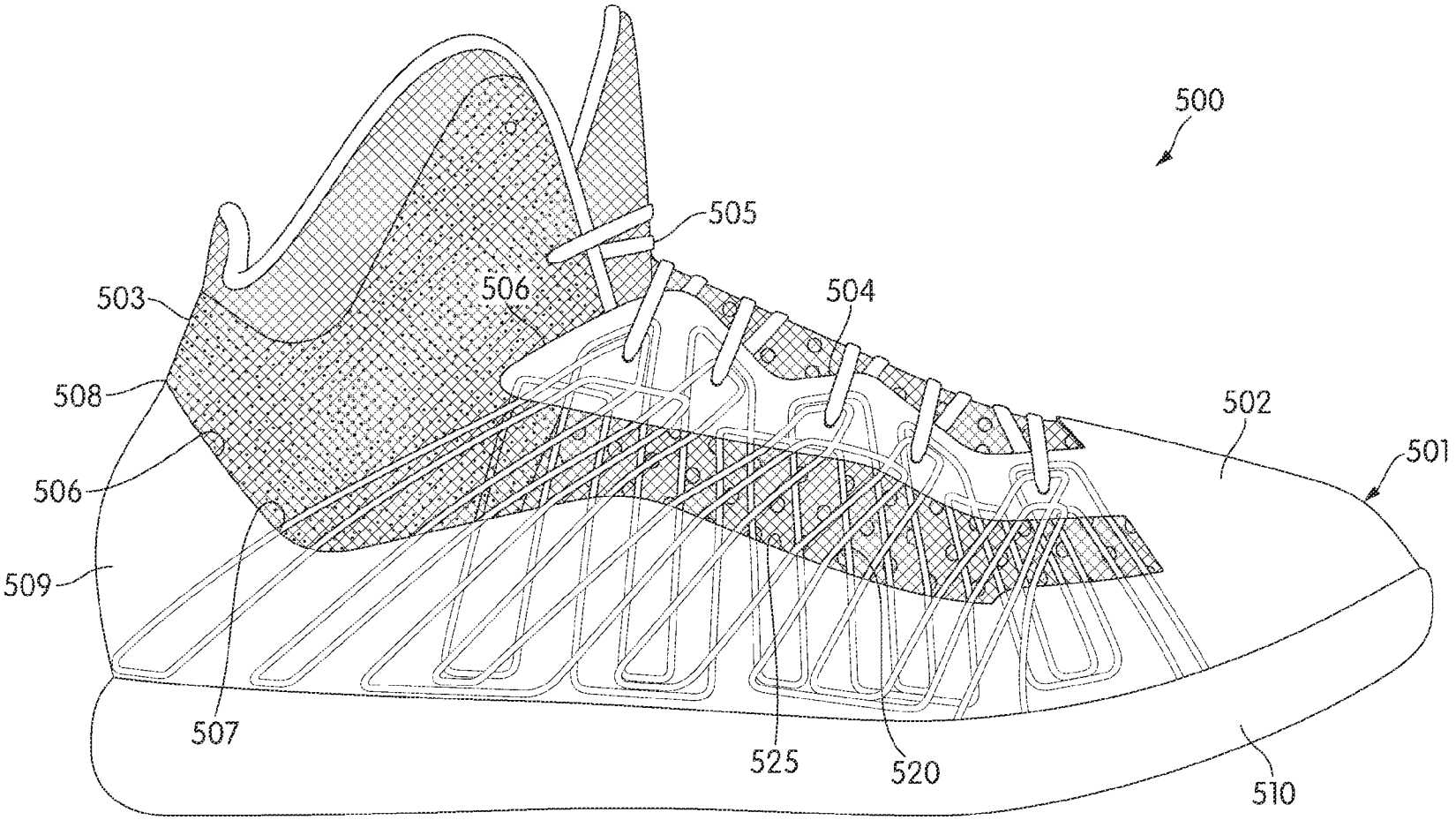
FIGS. 5A, 5B and 5C are lateral, rear and medial views, respectively, of a shoe according to some embodiments.
Figure 5B:
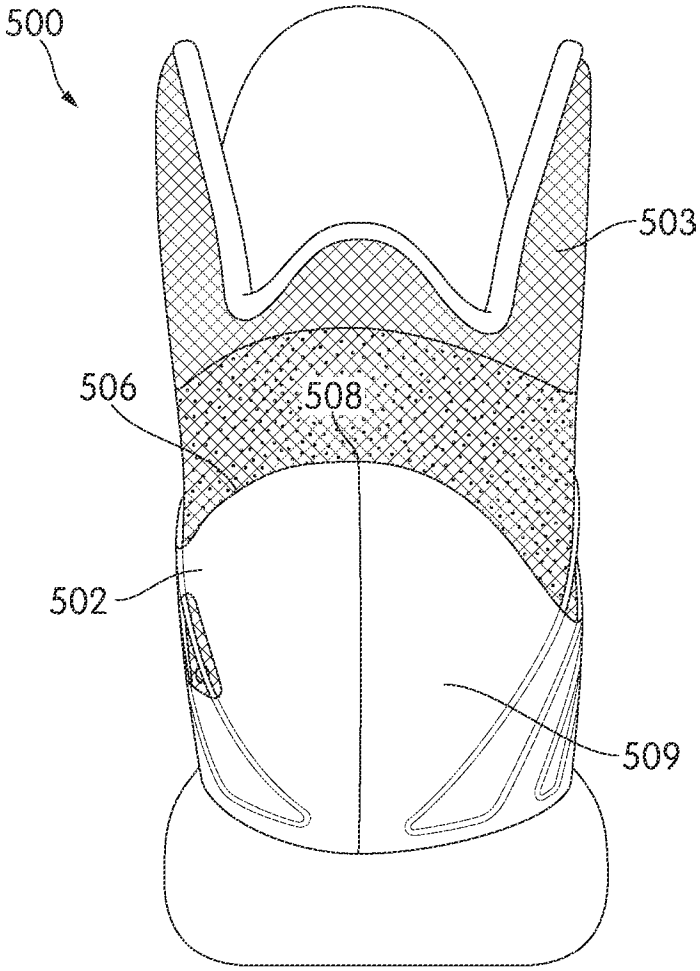
Figure 5C:
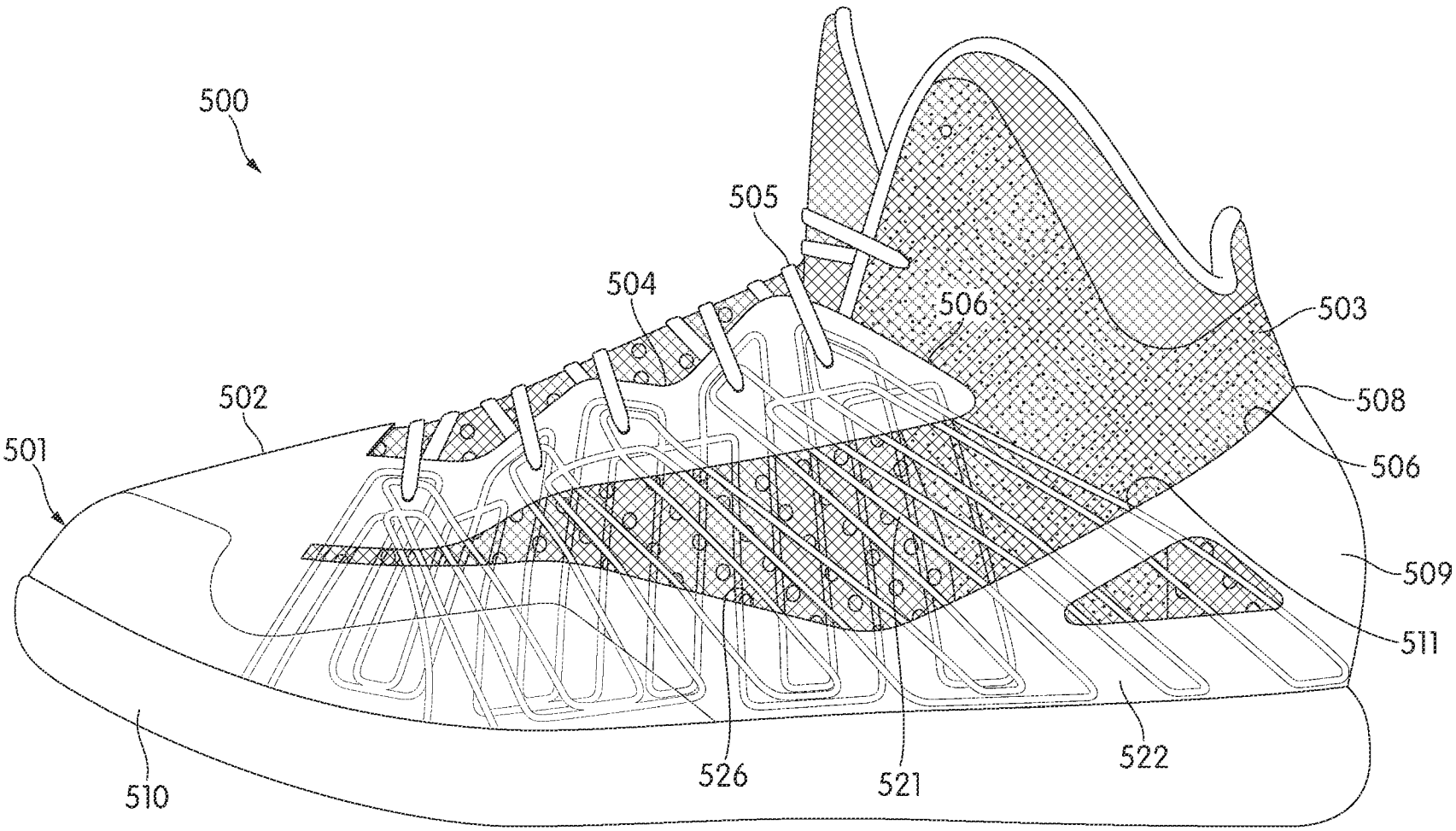

FIGS. 5A through 5C are lateral, rear and medial views of an embodiment of a shoe 500 that includes such inner and outer upper elements. Shoe 500 includes an upper 501, with upper 501 further including an outer element 502 and an inner element 503. Outer element 502 covers substantially all of the forefoot and midfoot regions of upper 501 and a portion of the hindfoot region. Outer element 502 includes an opening 504 in the instep region. A lace 505 passes through eyelets on the medial and lateral sides of opening 504 and in eyelets in inner member 503, as discussed below. As seen in FIG. 5A, an edge 506 of outer element 502 extends downward and rearward from the lateral side of opening 504 to a point 507 located under the lateral malleolus. Edge 507 then continues upward and rearward to the tip 508 of a heel cup 509 (FIG. 5B). Edge 506 then continues forward and downward to a point 511 located under the medial malleolus (FIG. 5C), and from there continues forward and upward to the medial side of opening 504.

In the embodiment of shoe 500, outer element 502 includes a plurality of lateral reinforcing strands 520 and medial reinforcing strands 521. Strands 520 and 521 are embedded in a shell of outer element 502 and are exposed in openings of that shell. A seen in FIG. 5A, strands 520 are exposed in a lateral side opening 525. As seen in FIG. 5C, strands 521 are exposed in a medial side opening 526. Strands 520 and 521 can be formed from any of a variety of materials.

Figure 6A:
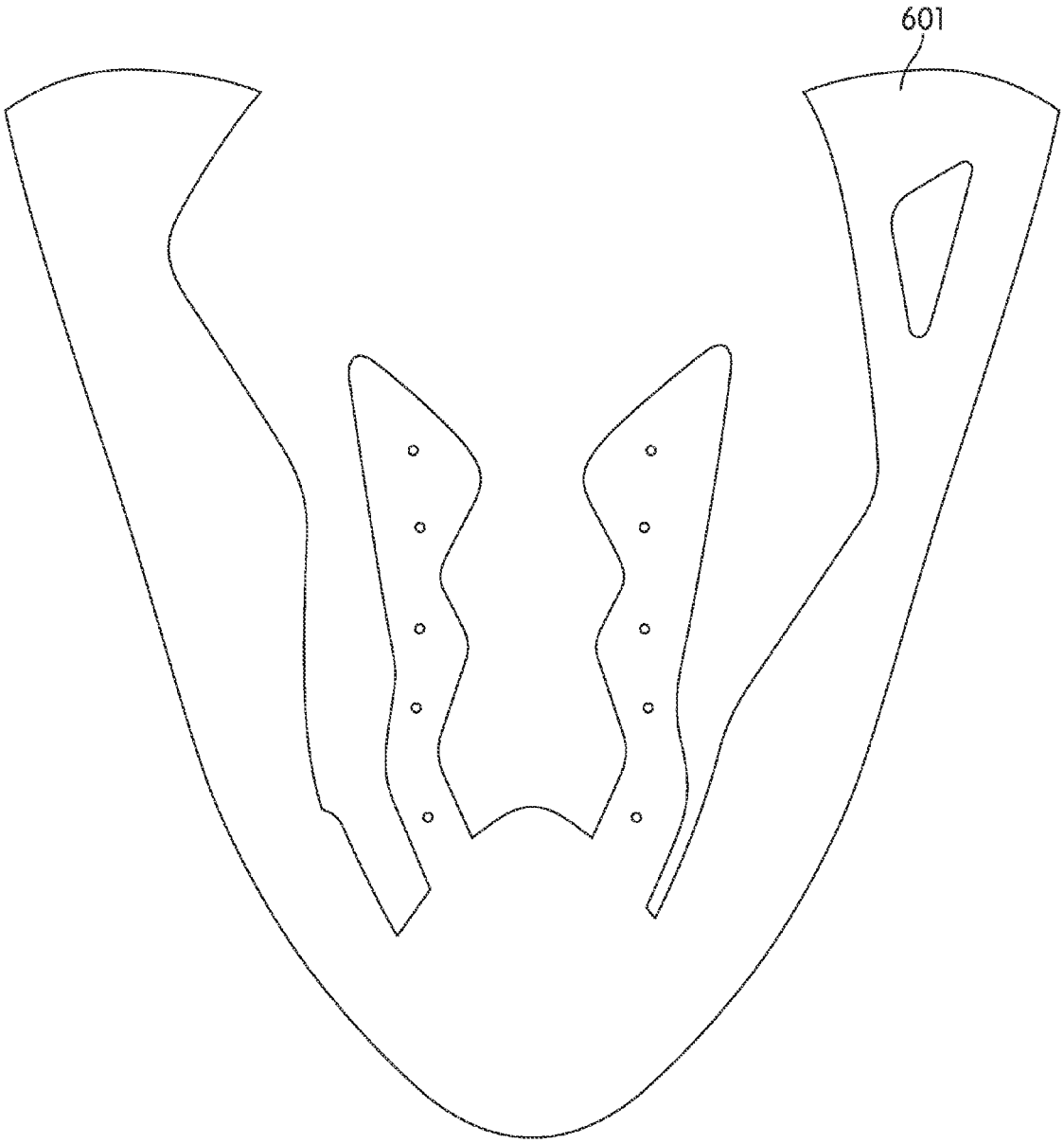
FIGS. 6A through 6D show certain steps in a process for fabricating an element of the shoe of FIGS. 5A-5C.
Figure 6B:
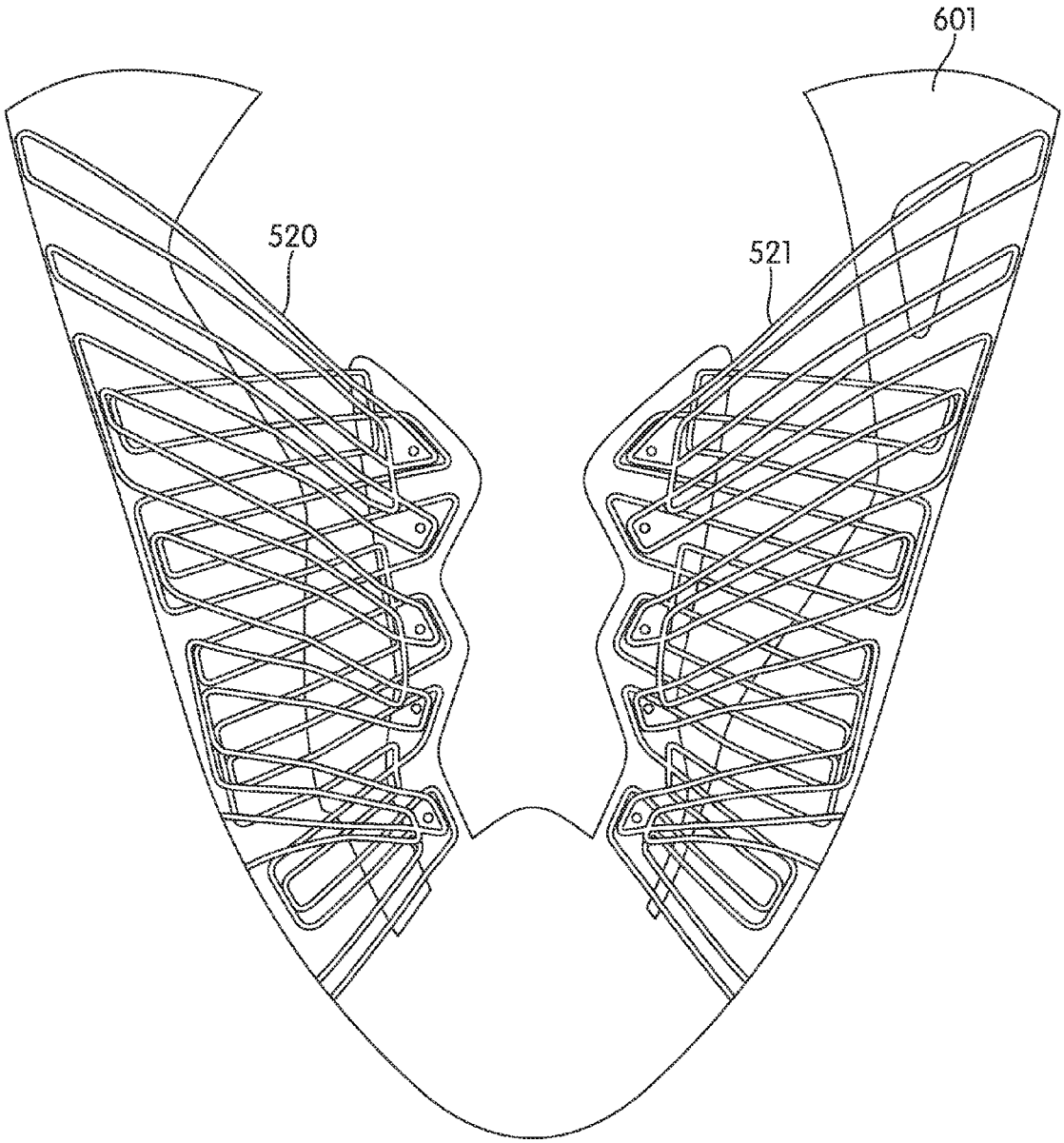
Figure 6C:
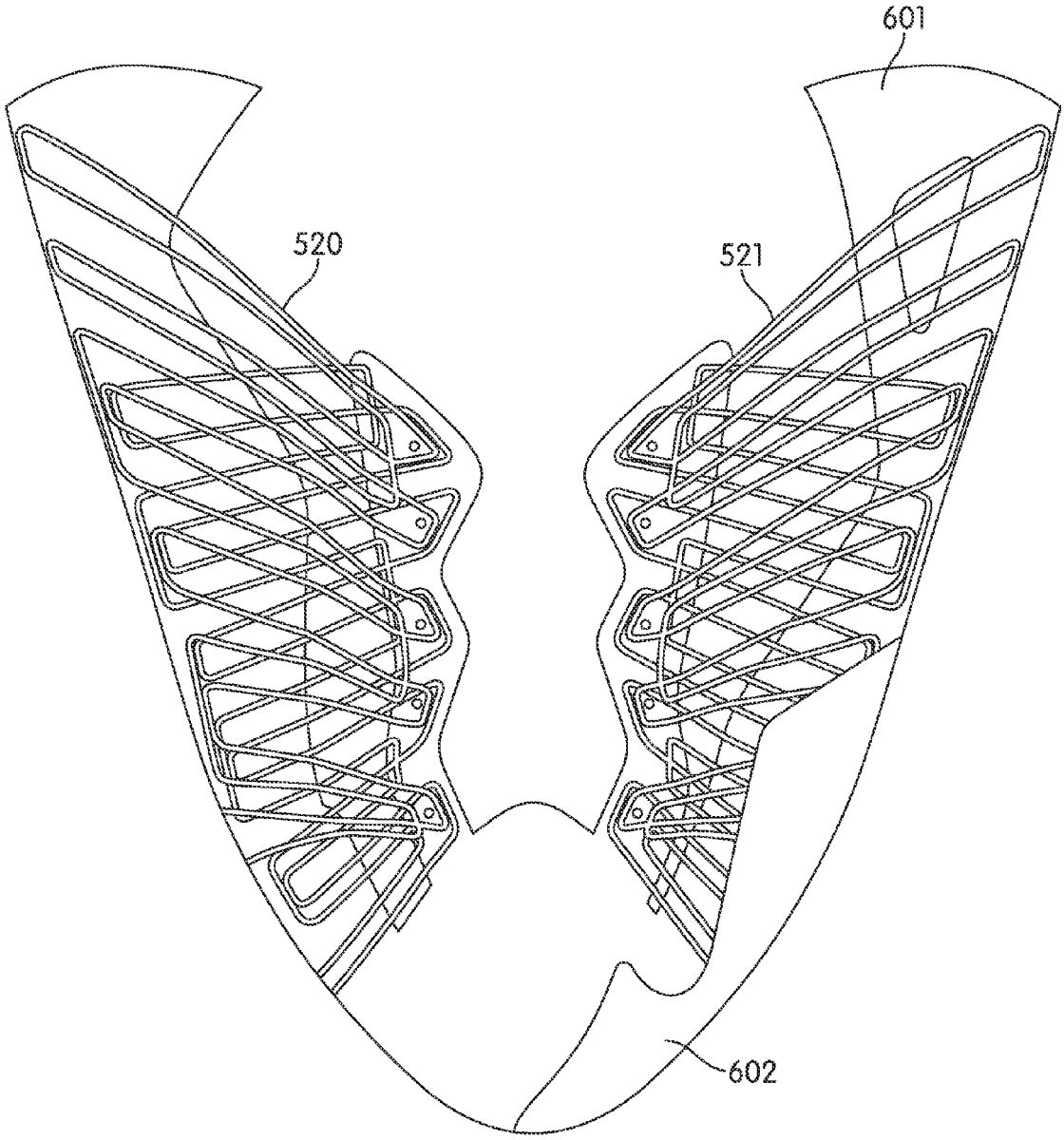
Figure 6D:
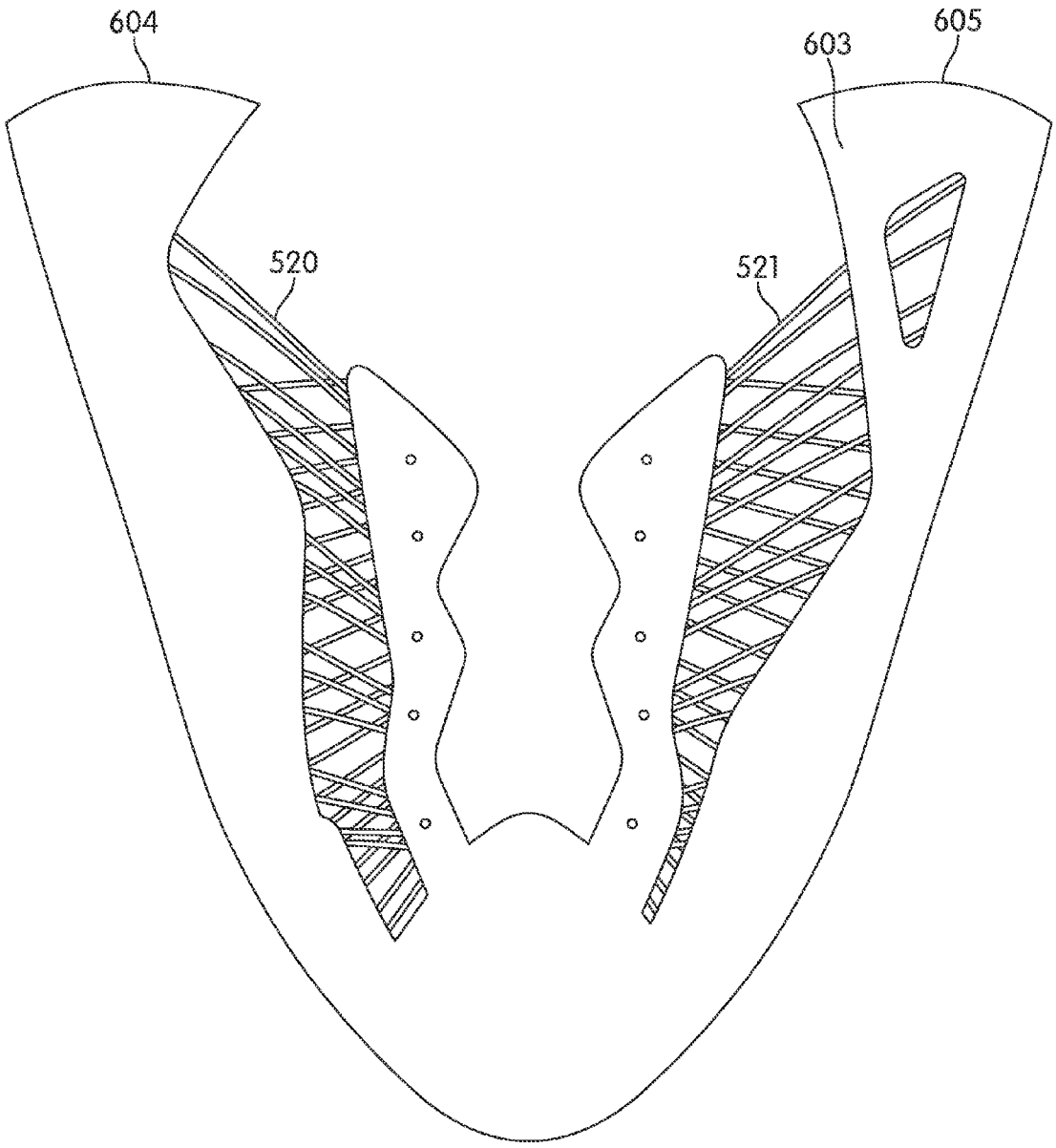

FIGS. 6A-6D show several steps in a method of creating outer element 502 according to some embodiments. First, and as shown in FIG. 6A, an interior layer panel 601 is cut from a larger piece of material. Materials than can be used for interior layer panel 601 include thermoplastic polyurethane (TPU). Next, and as shown in FIG. 6B, strands 520 and strands 521 are attached to panel 621 by stitching or otherwise embedding strands 520 and 521 into panel 601. One or more of strands 520 may be segments of a single strand that repeatedly crosses opening 525, and one or more of strands 521 may be segments of a single strand that repeatedly crosses opening 526. Strands 520 and 521 may be attached in multiple operations. For example, a first portion of strands 520 and strands 521 (e.g., of a first color) could be attached in a first operation, followed by a second portion of strands 520 and strands 521 (e.g., of a second color) during a second operation. A piece of medial side toe padding material 602 is then put in place (FIG. 6C), followed by an exterior layer panel 603 (FIG. 6D). Toe padding material 602 can be cut from, e.g., synthetic leather. Exterior panel 603 can be cut from a larger piece of TPU. The assembled components (panel 601, strands 520 and 521, padding 602 and panel 603) are then heated and pressed to bond those components together. After such treatment, the outlines of strands 520 and strands 521 are visible through panel 603. Edges 604 and 605 (FIG. 6D) are subsequently sewn together to give outer element 502 its three-dimensional shape. Techniques similar to those described in commonly-owned U.S. patent application Ser. No. 12/603,498 (filed Oct. 21, 2009, and incorporated by reference herein) can be used to bond the components of outer element 502 after those elements have been assembled into the configuration of FIG. 6D.

Figure 7A:
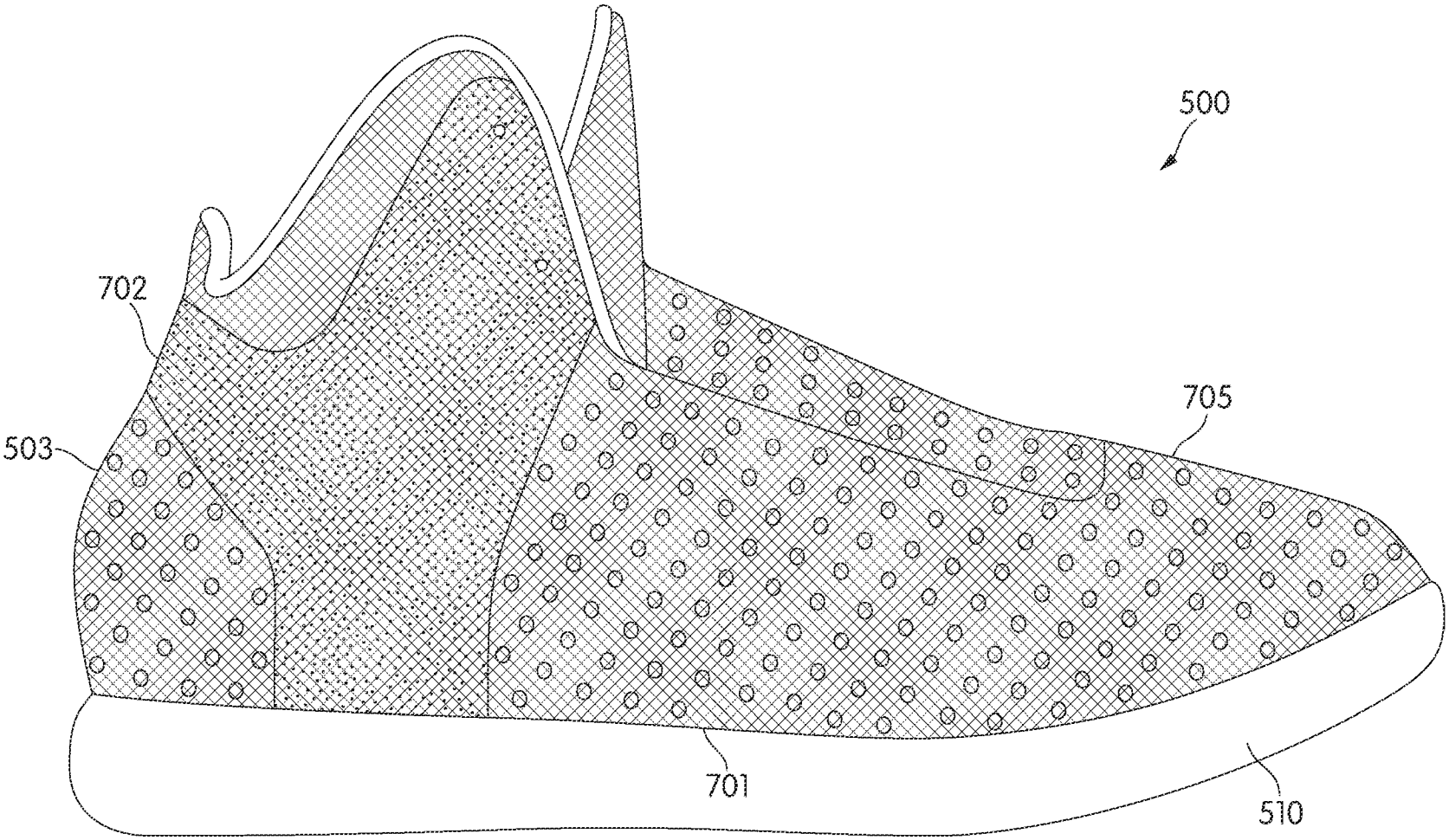
FIGS. 7A, 7B and 7C are additional lateral, rear and medial side views, respectively, of the shoe of FIGS. 5A-5C, but with an outer upper element removed.
Figure 7B:
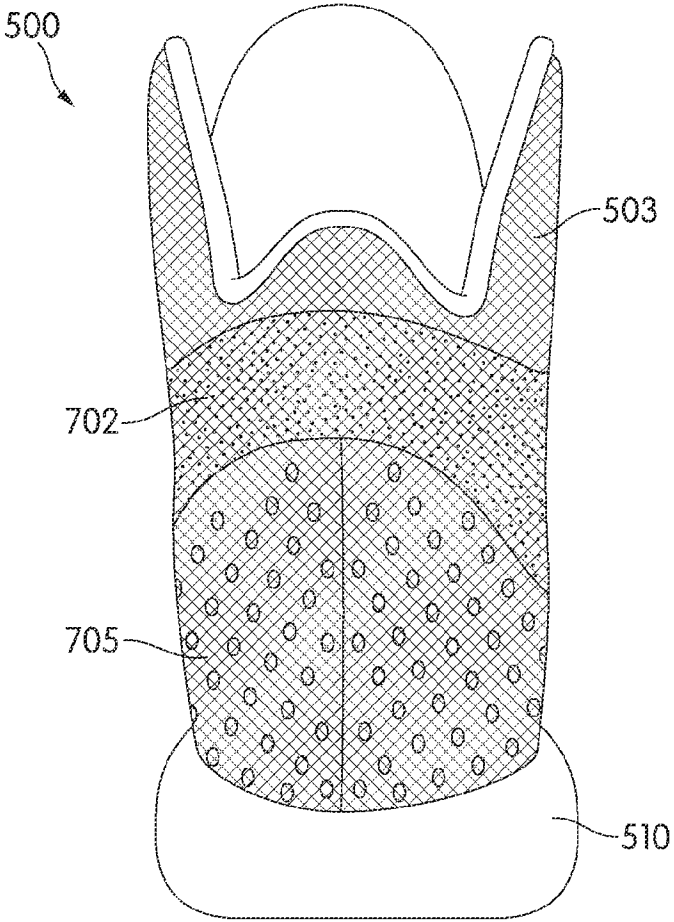
Figure 7C:
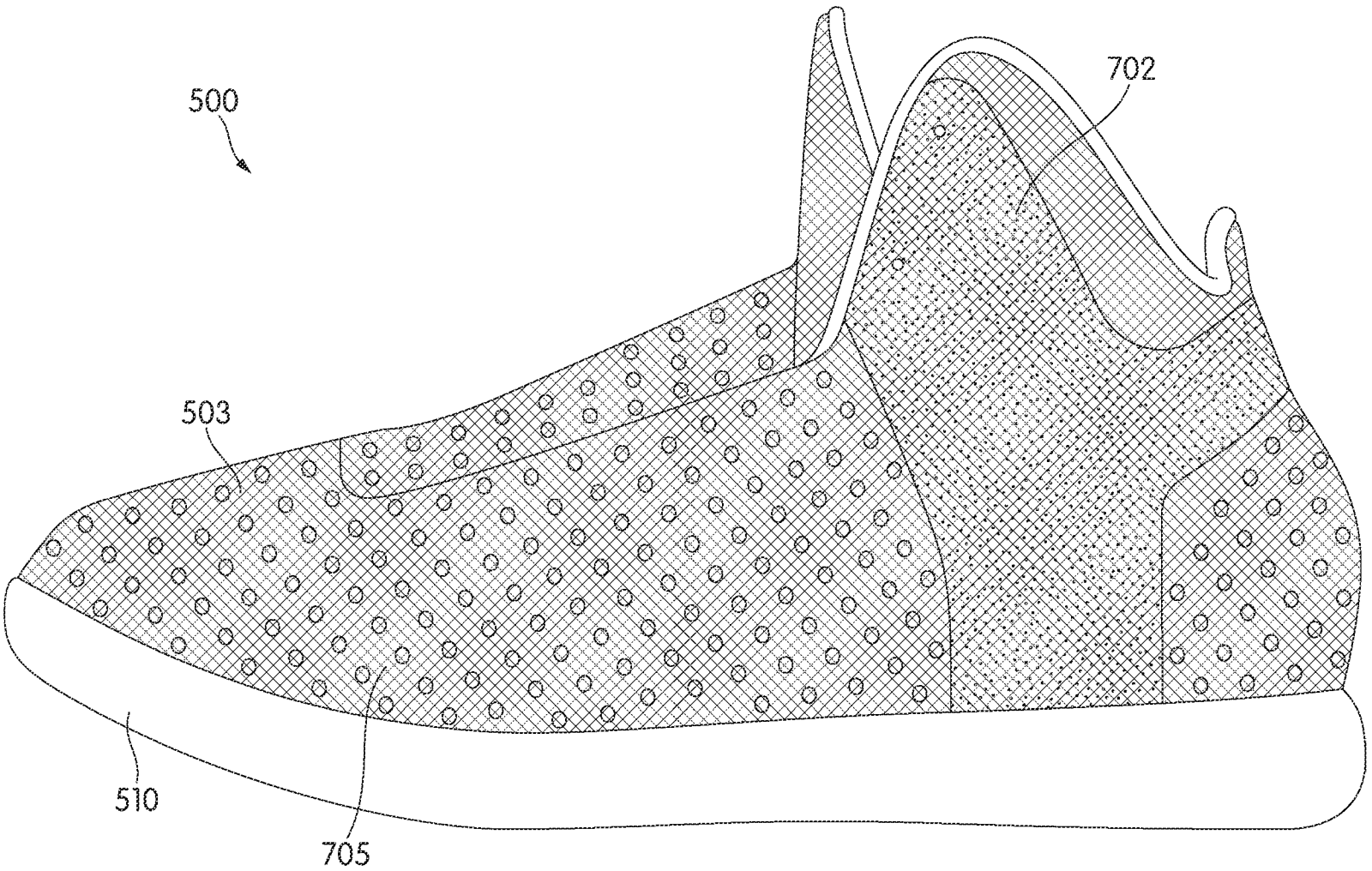
Figure 8A:
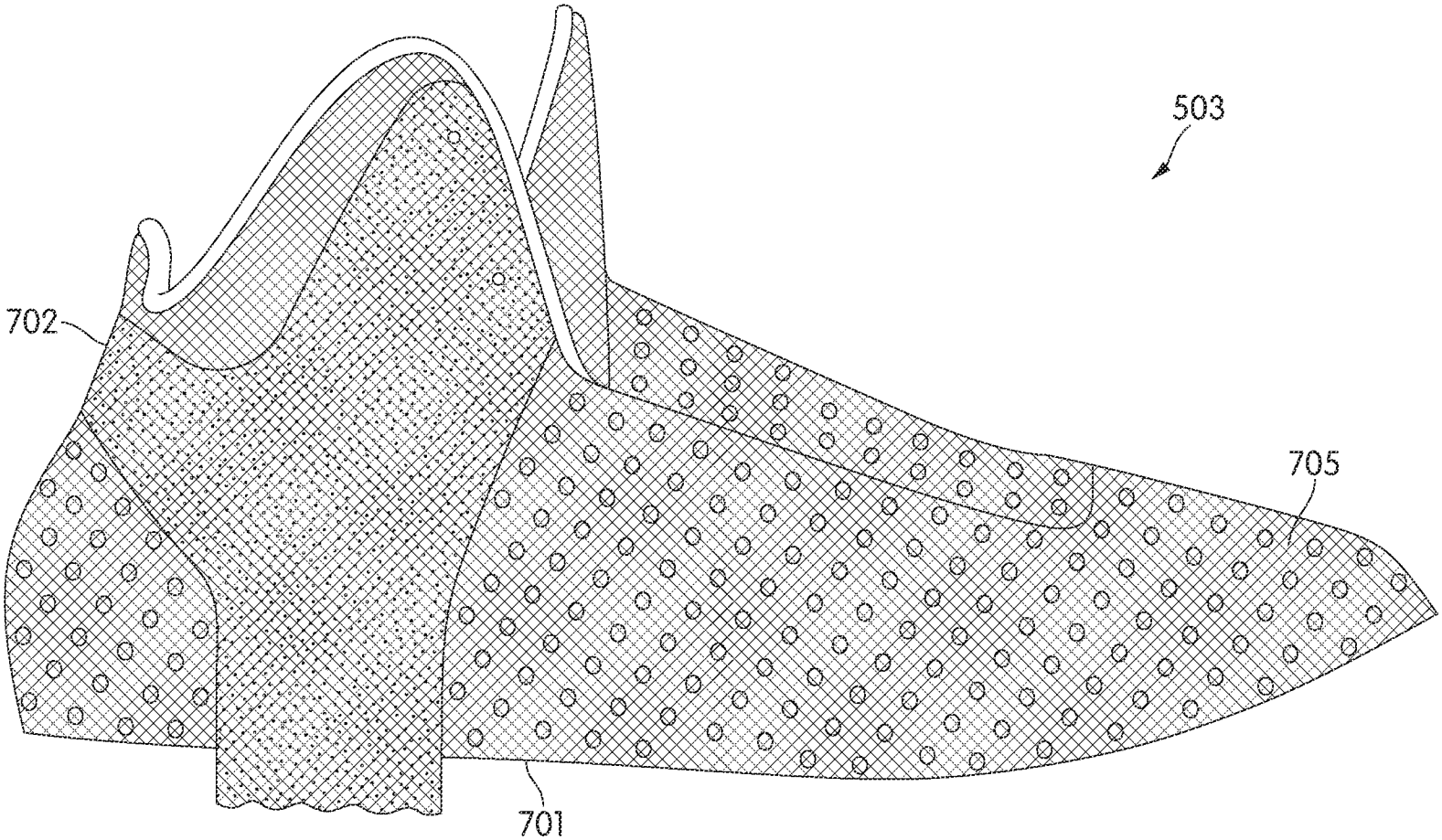
FIGS. 8A through 8D are respective lateral, rear, medial and front views of an inner upper element of the shoe of FIGS. 5A-5C.
Figure 8B:
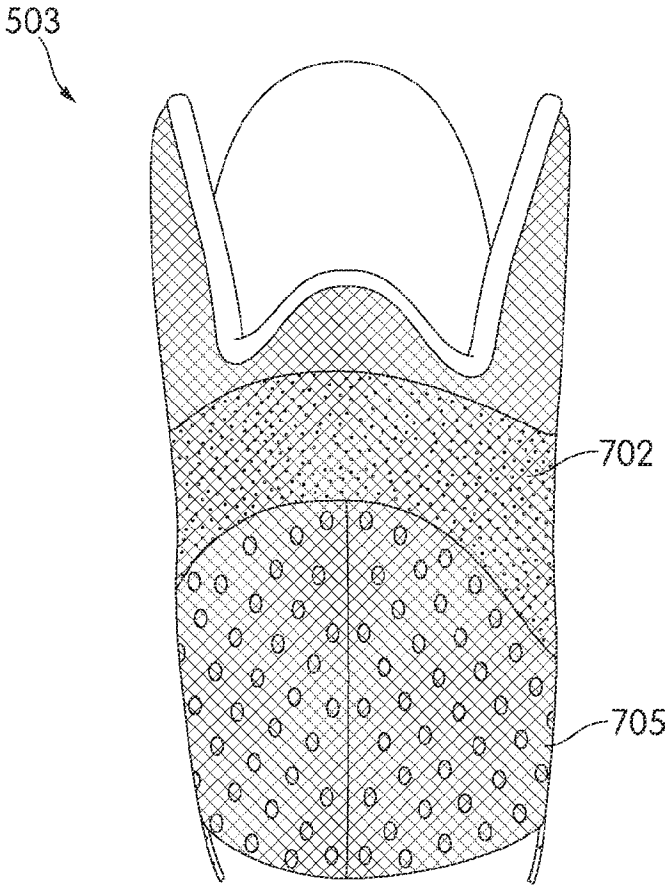
Figure 8C:
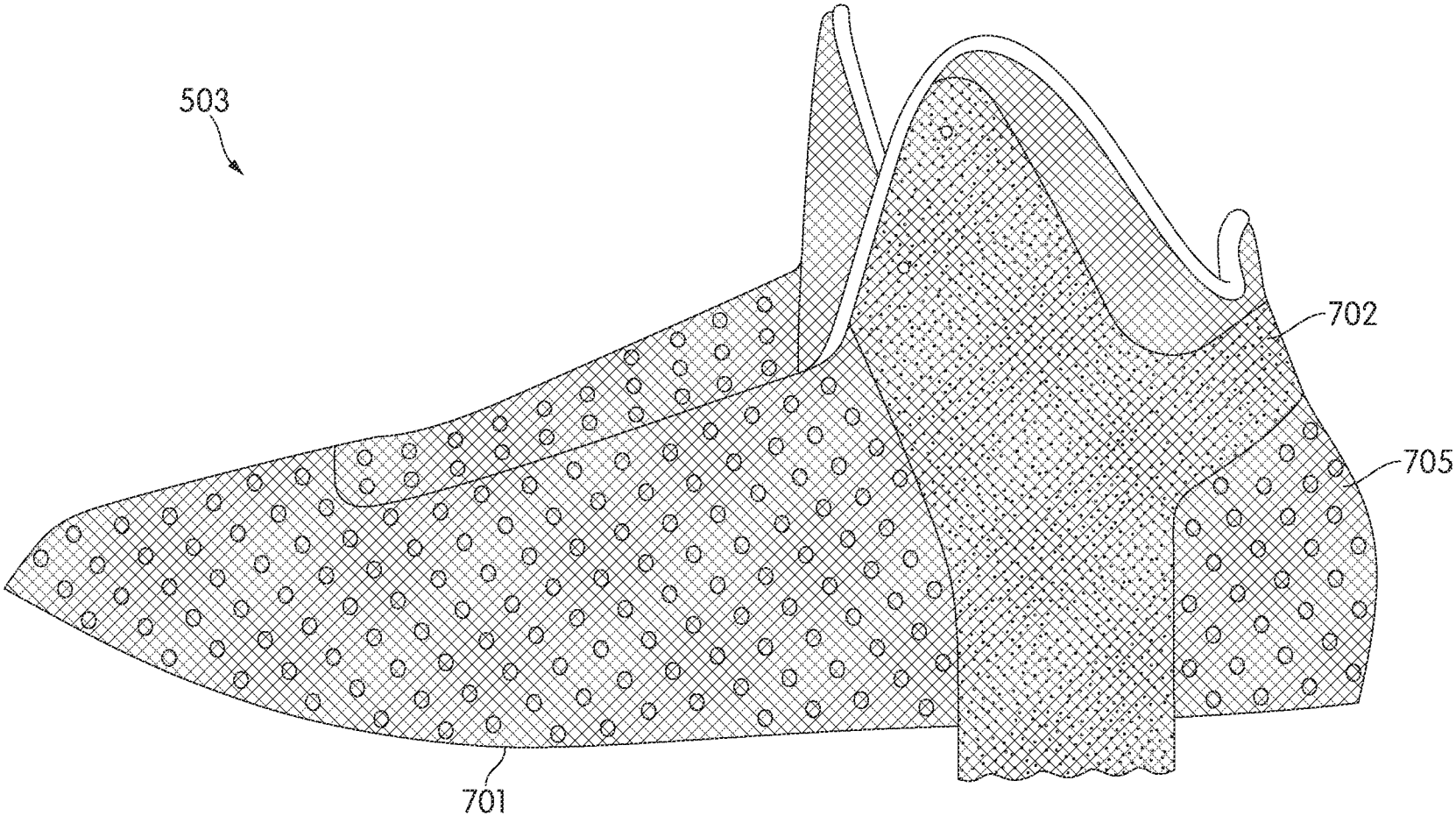
Figure 8D:
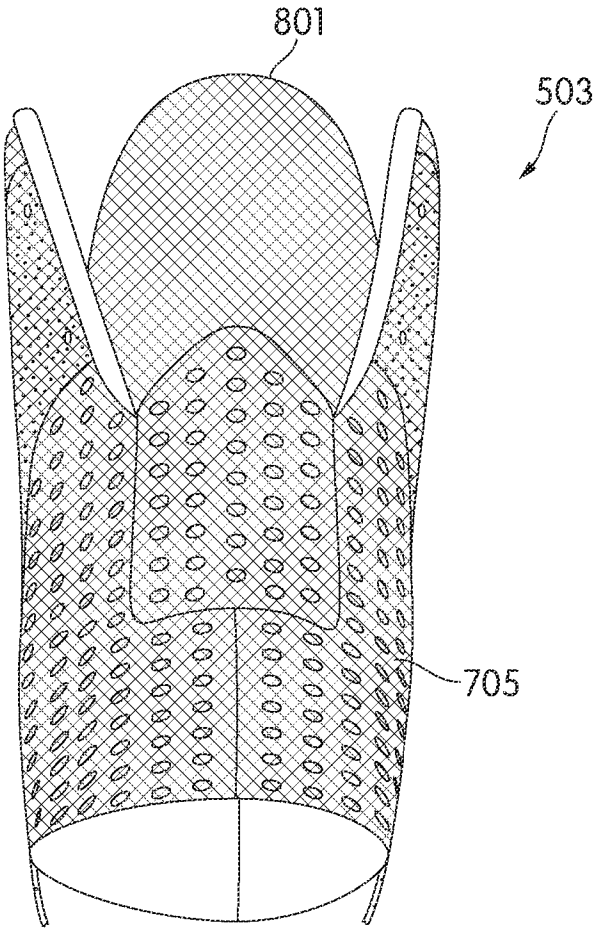

Returning to FIGS. 5A-5C, inner element 503 of upper 501 extends above edge 506 of outer element 502 and covers substantially all of the hindfoot region. As partially seen through openings 525 and 504 (FIG. 5A) and through opening 526 (FIG. 5C), inner element 503 also covers the tops and sides of the wearer midfoot and forefoot regions. FIGS. 7A, 7B and 7C are additional lateral, rear and medial side views, respectively, of shoe 500. In FIGS. 7A through 7C, however, outer element 502 is removed to better show the extent of inner element 503. A lower edge 701 of inner element 503 surrounds the entire perimeter of a wearer foot. Inner element 503 extends over the entire instep and does not include a tongue opening.

A hindfoot strap system 702 is contained within inner element 503. Because strap system 702 is substantially inelastic, the regions of inner element 503 that correspond to strap system 702 are thus substantially inelastic. In these inelastic regions, inner element 503 does not appreciably stretch under loads imposed by wearer activity. In some embodiments, however, other regions of inner element 503 are elastic and do stretch in response to loads imposed by wearer activity. An exterior layer 705 of inner element 503 comprises panels of a relatively thin mesh material formed from elastic fibers. In FIGS. 7A-8D, layer 705 is shown as a coarse diagonal grid. An interior layer of inner element 503 comprises a similar mesh material in the regions forward of strap assembly 503 and a second type of textile material in other regions. A central layer of inner element 503 comprises the inelastic strap system in the hindfoot region and elastic padding (or other) material in other regions. This construction allows inner element 503 to secure a wearer heel in the hindfoot region of shoe 500 while still allowing heel tilt relative to the forefoot.

FIGS. 8A through 10C further explain the construction of inner element 503. FIGS. 8A through 8D are respective lateral, rear, medial and front views of inner element 503. As previously indicated, the exterior layer 705 of inner element 503 comprises panels cut from a thin mesh material. Tab 801, shown in FIG. 8D, has a slightly different construction and is discussed below.

FIGS. 9A through 9D are respective lateral, rear, medial and front views of inner element 503, but with the panels of exterior mesh layer 705 removed to reveal elements in a central layer. Those elements include strap system 702. Strap system 702 further includes an ankle strap 910, a lateral heel strap 911 and a medial heel strap 912. Although somewhat wider than the straps of system 211 in shoe 200, straps 910, 911 and 912 of shoe 500 have a similar configuration. For example, ankle strap 910 has an asymmetric shape that dips down on the sides so as to be positioned under a wearer's malleoli, but that is located higher in the front and rear. A top portion of lateral heel strap 911 is coupled to ankle strap 910, as is a top portion of medial strap 912. As explained in further detail below, lower portions of lateral heel strap 911 and medial heel strap 912 are anchored to a base member, resulting in portions of heel straps 911 and anchor strap 910 being secured to sole structure 510 in a manner similar to that in which strap system 211 is secured to sole structure 212 of shoe 200. Forward edges 913 and 914 of lateral heel strap 911 and medial heel strap 912 are located in the hindfoot and/or midfoot regions of upper 501. Rear edges 915 and 916 of lateral heel strap 911 and medial heel strap 912 are located in the hindfoot region of upper 501.

Figure 9A:
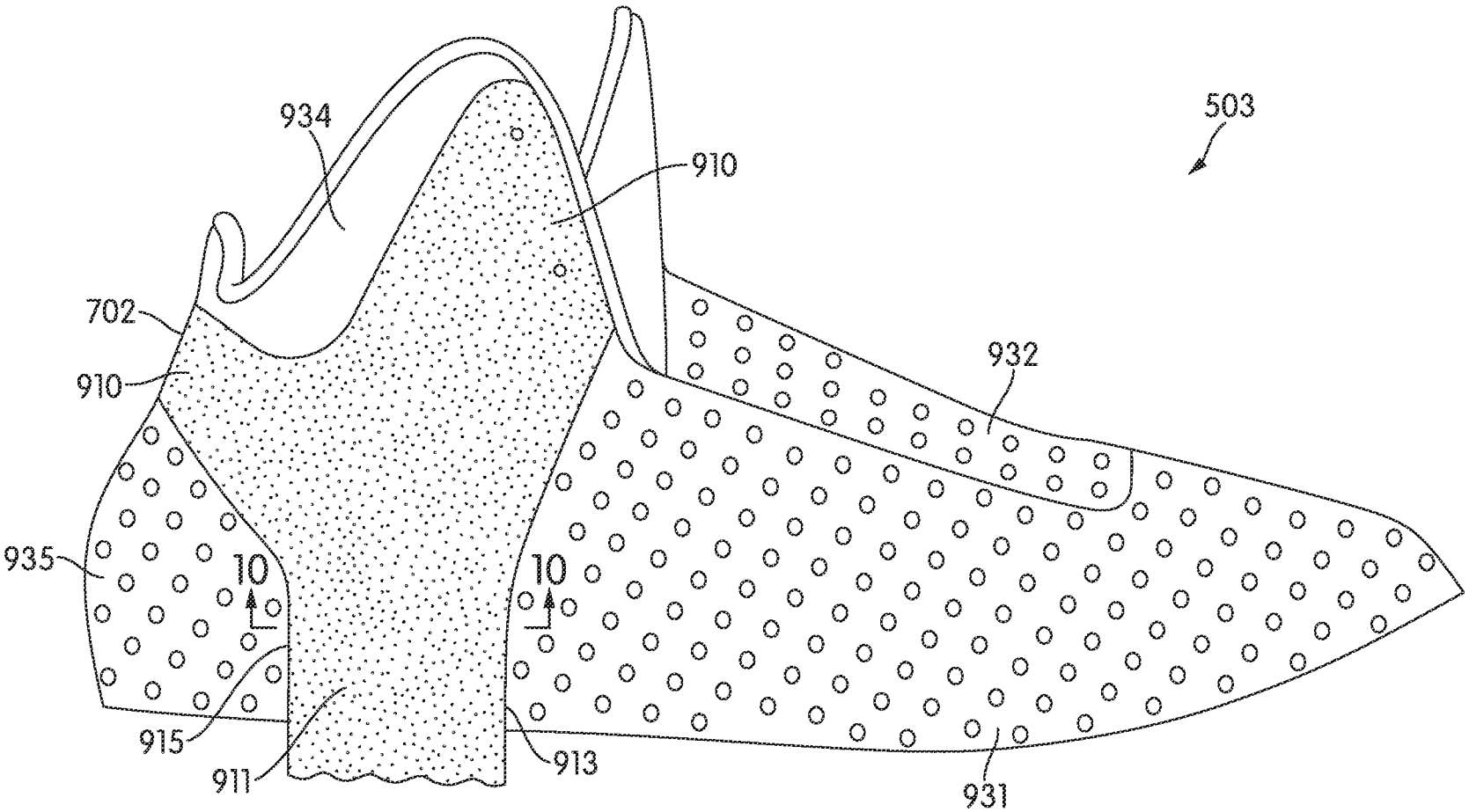
FIGS. 9A through 9D are respective lateral, rear, medial and front views of the inner upper element of FIGS. 8A-8D, but with exterior panels removed.
Figure 10:
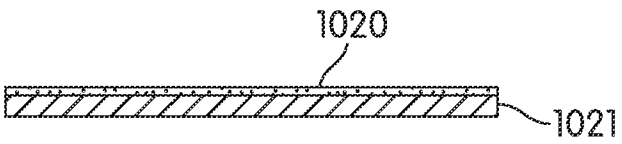
FIG. 10 is an area cross-sectional view from the location indicated in FIG. 9A.

FIG. 10 is an area cross-sectional view of strap 911 taken from the location indicated in FIG. 9A. In some embodiments, strap system 702 is cut as a single piece from a larger piece of a multilayer composite material. A tensile material layer 1020 of that composite is inelastic. Tensile material layer 1020 is bonded to a layer of padding 1021. As described in more detail below in connection with FIGS. 11A-11C padding layer 1021 could be formed from the same padding material used for other padding elements of inner element 503. Tensile material layer 1020 could also include reinforcing fibers. A portion of lateral heel strap 911 and a portion of medial heel strap 912 extend under a wearer heel in shoe 500, in a manner similar to that described in connection with strap system 211 of shoe 200, and as is discussed below. Padding layer 1021 can be removed from the portions of straps 911 and 912 that will extend under the wearer heel so as to only leave tensile layer 1020.

Figure 9B:
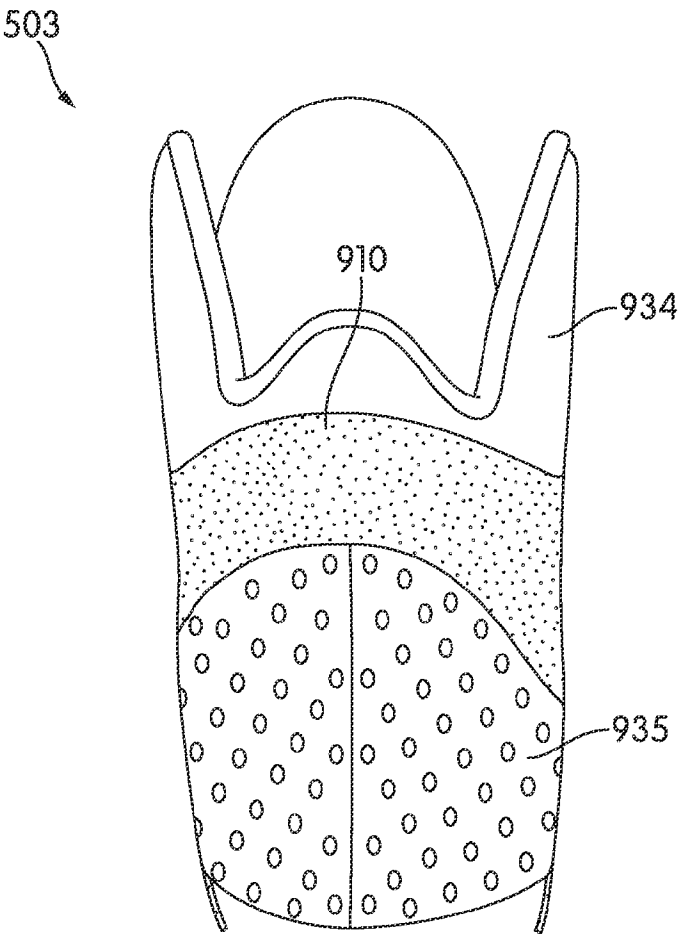
Figure 9C:
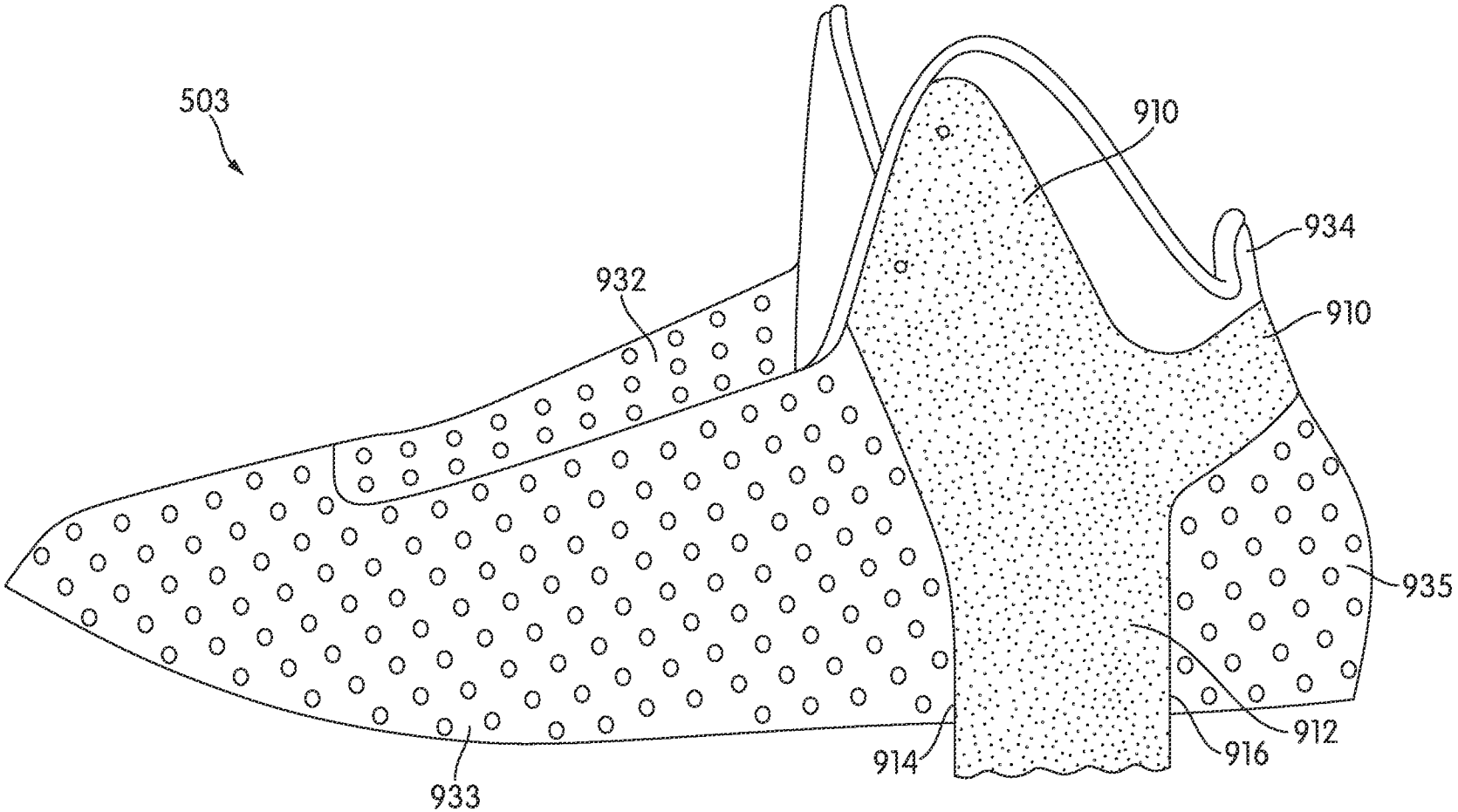
Figure 9D:
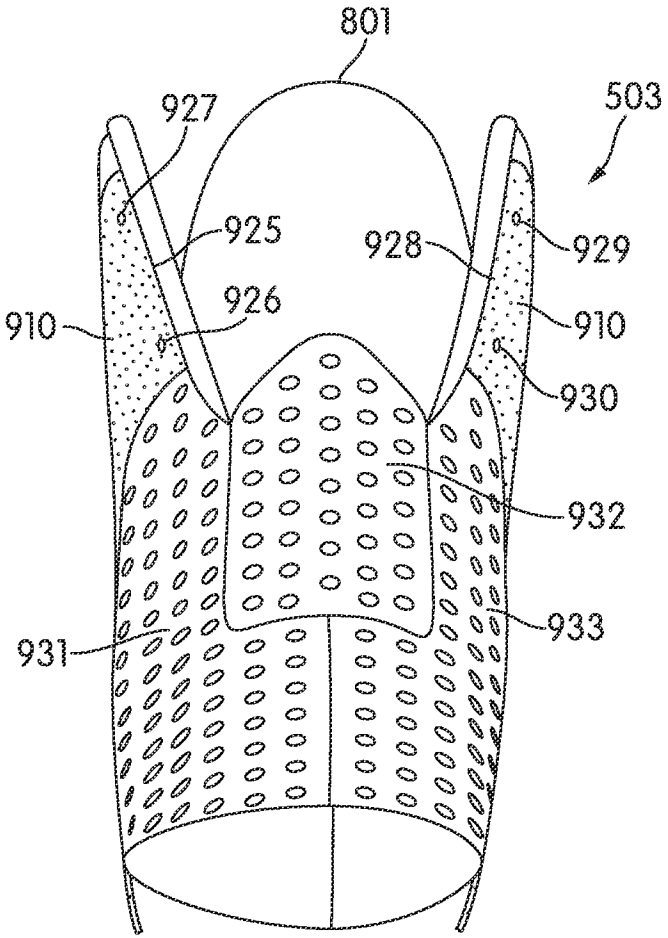

Referring to FIG. 9D), the lateral end 925 of ankle strap 910 includes eyelets 926 and 927. The medial end 928 of ankle strap 910 similarly includes eyelets 929 and 930. Lace 505 (FIGS. 5A and 5C) also passes through eyelets 926, 927, 929 and 930. When lace 505 is threaded through these eyelets and tied, ankle strap 910 is secured to the wearer's foot. Tab 801 acts similar to a tongue of a conventional shoe and spans the space between ends 925 and 928 of ankle strap 910. Tab 801 includes a layer of padding, but is generally not elastic, and may include a stiffening layer to moderate the force of tightened lace 505. The lower edge of tab 801 is attached to the instep portion of inner element 503, but the sides of tab 801 are not attached to the ends 925 and 928 of ankle strap 910.

As seen in FIGS. 9A, 9C and 9D, the central layer of inner element 503 forward of strap system 702 includes lateral padding element 931, instep padding element 932 and medial padding element 933. Each of padding elements 931, 932 and 933 can be cut from a larger sheet of a flexible padding material. Examples of materials that can be used for padding elements 931, 932 and 933 include the aforementioned material(s) that can be used for padding 1021. In some embodiments, the rear edge of padding element 931 and the forward edge 913 of lateral heel strap 911 (as well as the rear edge of padding element 931 and the forward lateral edge of ankle strap 910) are adjacent but unattached along some or all of their lengths. Similarly, the rear edge of padding element 933 and the forward edge 914 of medial heel strap 912 (as well as the rear edge of padding element 933 and the forward medial edge of ankle strap 910) may be adjacent but unattached along some or all of their lengths.

As seen in FIGS. 9A-9C, the central layer of inner element 503 above ankle strap 910 includes a padding element 934. The bottom edge of padding element 934 and the top edge of ankle strap 910 may be adjacent but unattached along some or all of their lengths. The central layer of inner element 503 below ankle strap 910 and to the rear of heel straps 911 and 912 includes a padding element 935. Adjacent edges of padding element 935 and of straps 910, 911 and 912 may be unattached along some or all of their lengths. Padding elements 934 and 935 can similarly be cut from larger pieces of the same types of materials used for padding elements 931, 932 and 933.

Figure 11A:
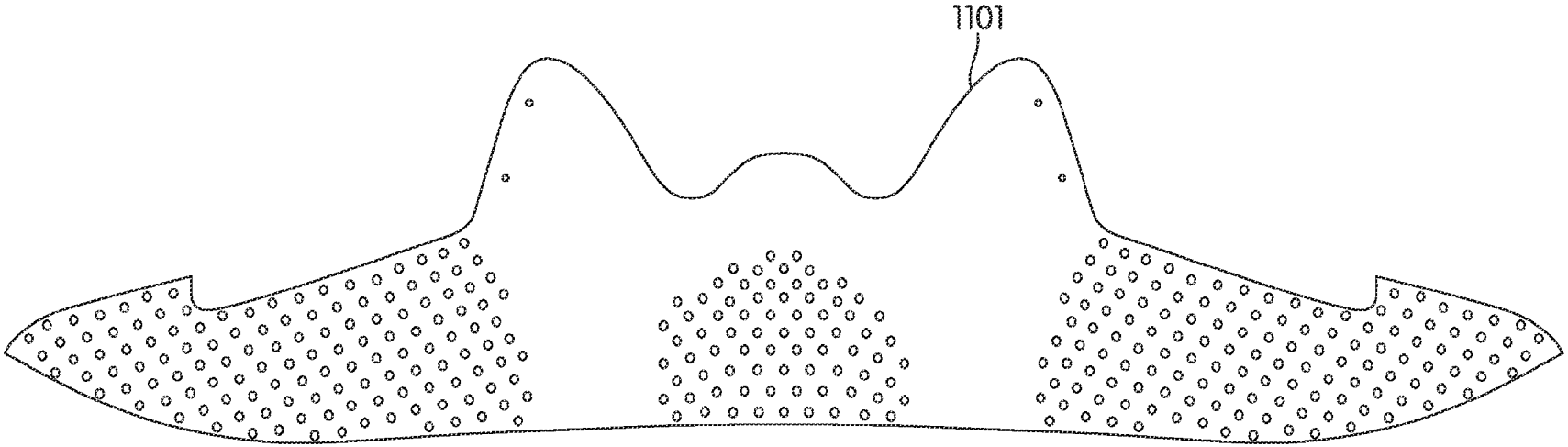
FIGS. 11A through 11C show operations in fabricating a portion of the inner upper element of FIGS. 8A-8D.
Figure 11B:
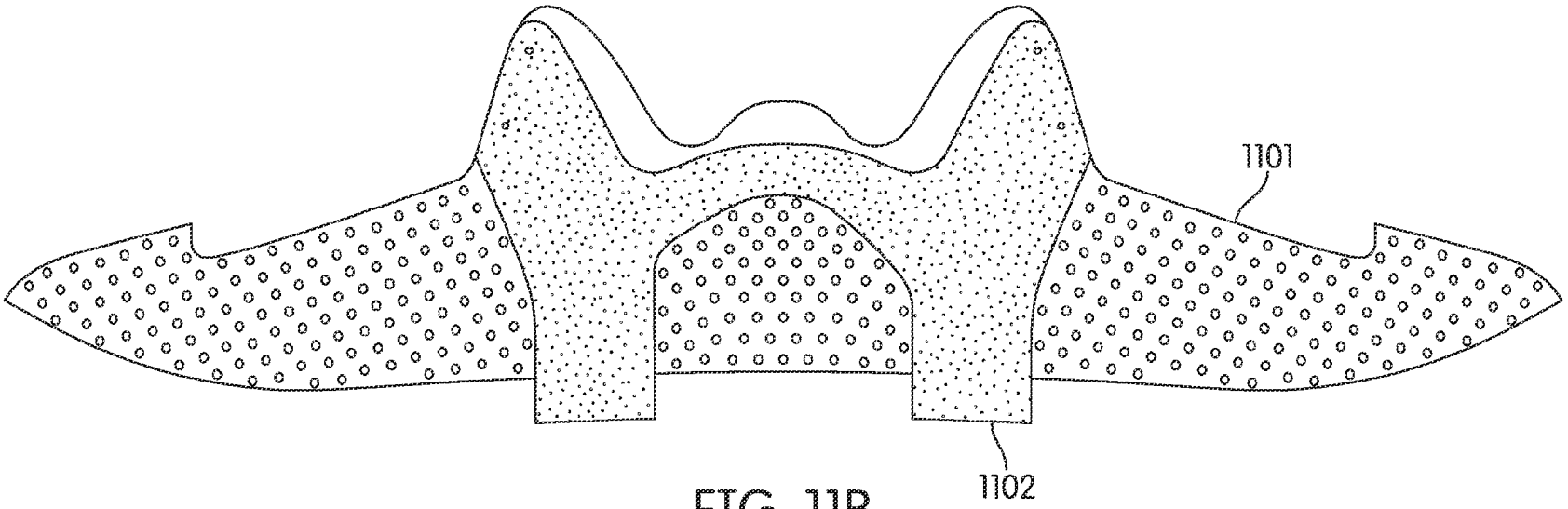
Figure 11C:
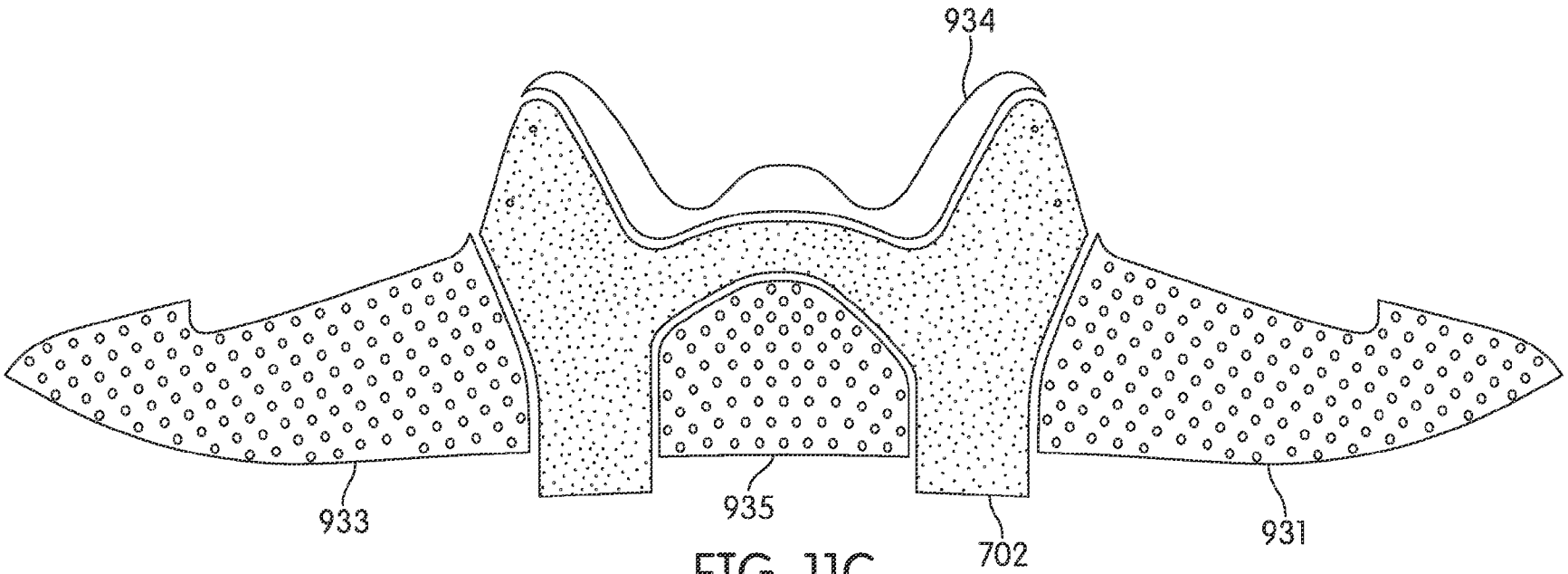

FIGS. 11A through 11C show one technique by which padding elements 931 and 933-935 and strap system 702 can be formed in some embodiments. In a first operation, and as illustrated in FIG. 11A, a first panel 1101 of foam material is cut from a larger piece of foam material. Panel 1101 has a shape that corresponds to the shapes of panels 931 and 933-935 and of strap system 702 in an open and flattened configuration. Holes are punched in panel 1101 for purposes of ventilation and/or weight reduction in certain regions, as well as for eyelets 926, 927, 929 and 930. In some embodiments, holes may be punched in other areas of panel 1101 (e.g., in the area in which the tensile panel for strap system 720 will be placed, as described below).

Next, and as shown in FIG. 11B, a panel 1102 of tensile material is bonded to first panel 1101. Panel 1102, which can be cut from a larger piece of material, has a shape that corresponds to strap system 702 in an open and flattened configuration. Subsequently, and as shown in FIG. 11C, panels 931 and 933-935 are separated from strap system 702. If desired, small connections can be left in place between each of these separate members (e.g., small connecting tabs) so as to keep all pieces together prior to final assembly of inner element 503. Panel 932 can be separately cut from a larger sheet of the same padding material used for panel 1101. In some embodiments, the shape of panel 1101 is modified so as to include panel 932, with panel 932 being separated from other elements during the step of FIG. 11C.

As previously indicated, a layer of inner element 503 inside of padding elements 931-935 and strap system 702 comprises two types of material: a mesh material similar to the mesh material of outer layer 705 and a second type of textile material. In particular, the interior of inner element 503 within padding elements 931-935 and strap system 702 includes a second mesh material layer in regions forward of strap system 702. All other interior portions of inner element 503 have a second type of textile material that has a finer weave (e.g., woven nylon or polyester). Inner element 503 can be assembled by stitching or otherwise joining interior mesh panels (not shown in the drawings), padding panels 931-933, and mesh layer 705 along the seams separating panels 931-933. Tab 801, which can be separately formed, can be stitched to panel 932 (and to the mesh panels on the interior and exterior sides of panel 932). Layer 705 wraps around the exterior of strap system 702 and padding elements 934 and 935. The interior textile layer, which can be stitched or otherwise joined to the interior mesh layer, wraps around the interior of strap system 702 and of padding elements 934 and 935. A top edge of layer 705 along the top edge of element 934, a top edge of the inner textile element along the top edge of element 934, and the edge of element 934 are also stitched or otherwise joined together. Similarly, a top edge of layer 705 and a top edge of the inner textile element are stitched or otherwise joined to the lateral end 925 of ankle strap 910. Another top edge of layer 705 and another top edge of the inner textile element are stitched or otherwise joined to the medial end 928 of ankle strap 910.

Figure 12:
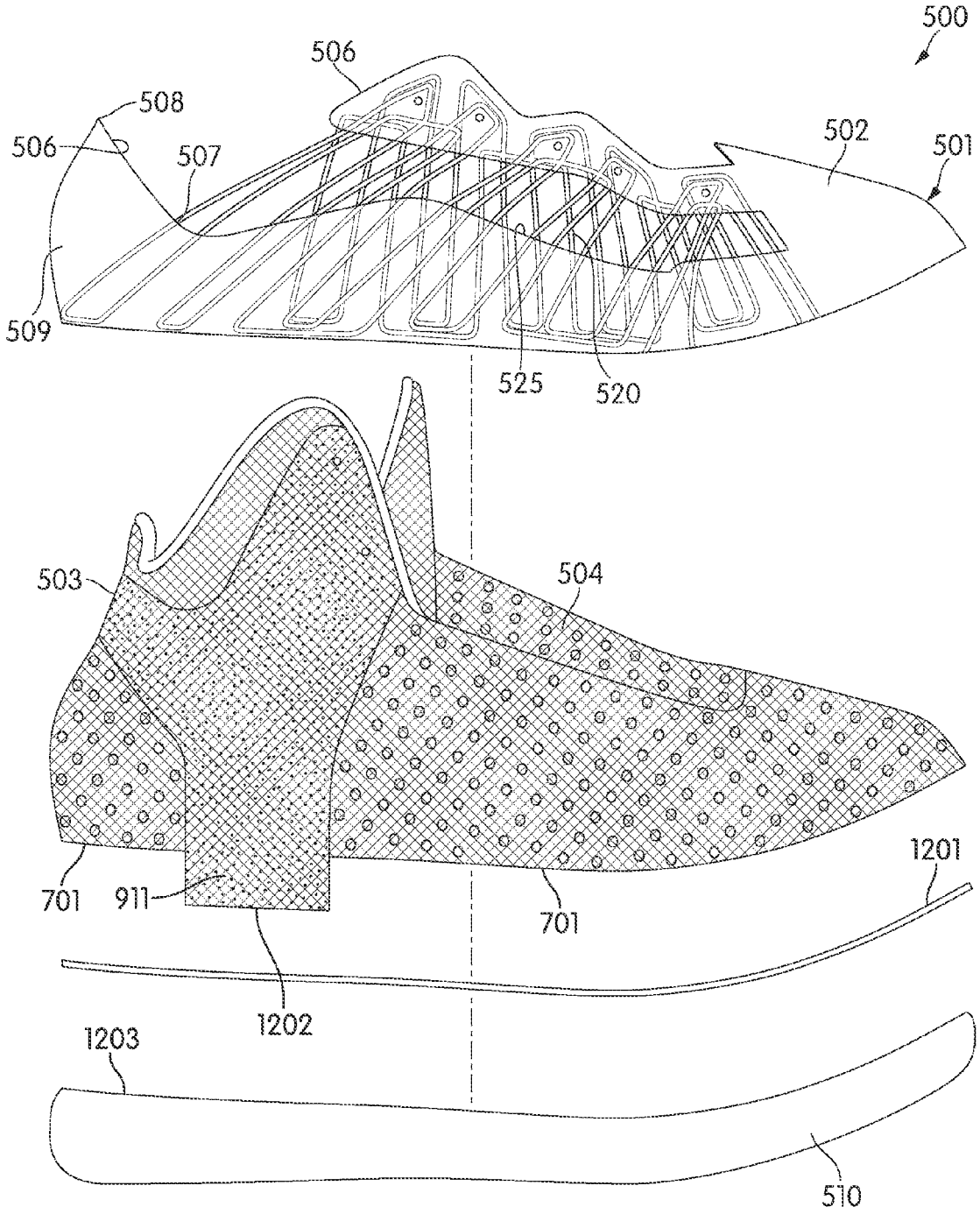
FIG. 12 is an exploded view of the shoe of FIGS. 5A-5C.

FIG. 12 is an exploded view of shoe 500. Shoe 500 could be assembled by first attaching inner element 503 to outer element 502. In particular, and after nesting inner element 503 within outer element 502, the portion of the inner element 503 lower edge 701 forward of heel straps 911 and 912 (not visible in FIG. 12) can be sewn or otherwise attached to the corresponding portion of the outer element 502 lower edge. The portion of the inner element 503 lower edge 701 located rearward of heel straps 911 and 912 can also be sewn or otherwise attached to the corresponding portion of the upper element 502 lower edge. Upper edge 506 of outer element 502 heel cup 509 can be sewn or otherwise attached to the corresponding region of inner element 503.

Next, an end 1202 of lateral heel strap 911 is attached to an anchor location on a base member 1201. Base member 1201, like base member 301 of shoe 200, can be a Strobel or other type of lasting element. An end of medial heel strap 912 (not shown) is similarly attached to a separate anchor location on base member 1201. The positions of anchor locations for the ends of straps 911 and 912, relative to the length of shoe 500 and/or width of a shoe 500 wearer heel, can be similar to the positions of anchor locations 305 and 304 relative to the length of shoe 200 and/or width of a shoe 200 wearer heel.

Next, the forward lower edge of upper 501 (formed by the joined edges of inner element 503 and outer element 502 forward of straps 911 and 912) can be stitched or otherwise attached to the front outside edge of base member 1201. The rear lower edge of upper 501 (formed by the joined edges of inner element 503 and outer element 502 rearward of straps 911 and 912) can likewise be stitched or otherwise attached to the rear outside edge of base member 1201. The lower surface of base member 1201 can then be glued or otherwise attached to upper surface 1203 of sole assembly 510.

The structure of shoe 500 combines certain of the benefits of conventional shoe constructions with advantages of a hindfoot strap system. Because outer element 502 is anchored to sole structure 510 around much of the wearer foot perimeter, unwanted sliding of the foot relative to the footbed can be reduced. For example, heel cup 509 can help prevent rearward motion of the foot relative to sole structure 510. Although inner element 503 is located within outer element 502, they are only joined along portions of their common bottom edges and at the top edge of heel cup 509. Thus, inner element 503 can move relative to the outer element 502 across most of their interfacing surfaces. Strap system 702 secures the wearer heel while allowing heel rotation relative to the forefoot. The low edge of outer element 502 under the malleoli reduces interference by outer element 502 with natural heel-forefoot rotation. The location of strap system 702 inside of inner element 503 facilitates inclusion of continuous padding around the wearer's foot.

Additional embodiments include numerous variations on shoes 200 and 500. Numerous materials in addition to those specifically identified can be employed. Upper 501 of shoe 500 can have numerous alternate constructions. In some embodiments, an outer element could lack openings such as openings 525 and 526. In some such embodiments, strands 520 and 521 might be omitted. In some embodiments, a hindfoot strap system might only include a lateral heel strap or a medial heel strap. Features of shoe 200 or shoe 500 can be combined with other features, including but not limited to various features described below.

Sole Structure with Heel Region Profile(s)

Figure 13:
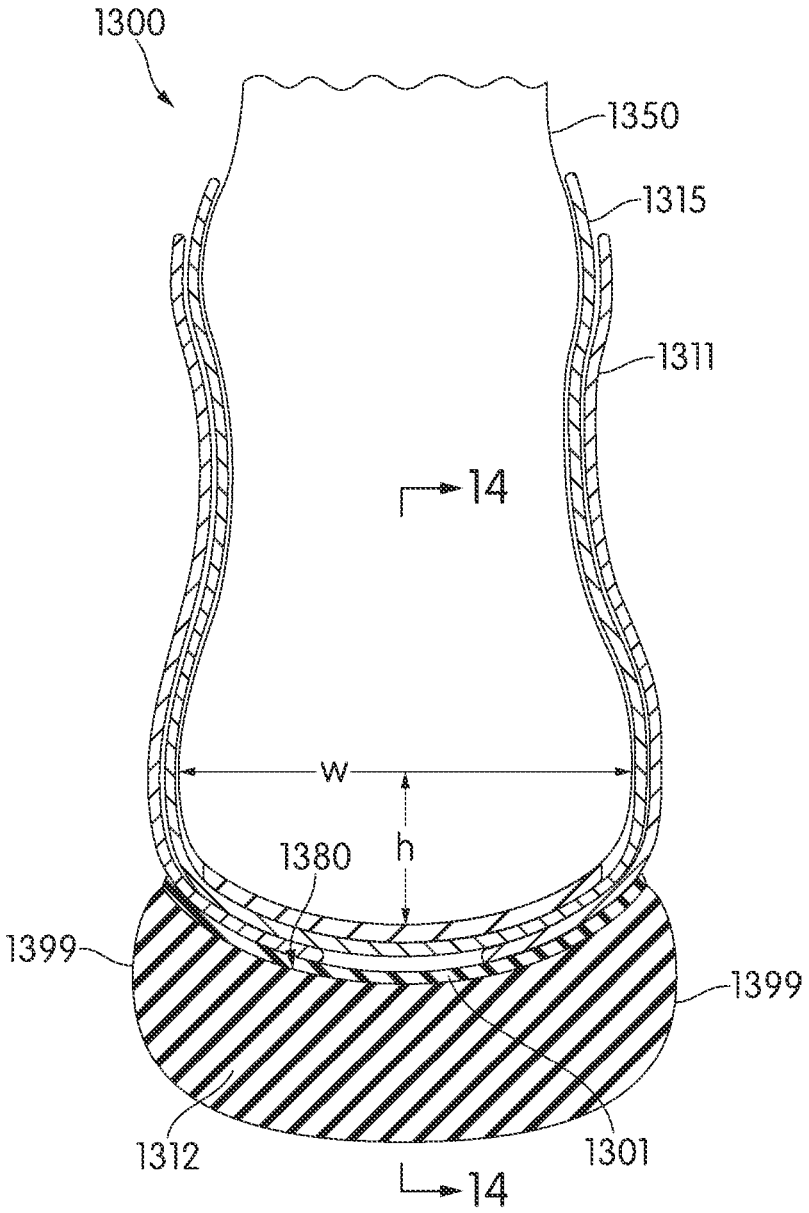
FIGS. 13 and 14 are area cross-sectional views of a heel portion of a shoe according to certain additional embodiments.

In some embodiments, a shoe may also include a sole structure in which the heel region has a rounded inner and/or outer profile. FIG. 13 is an area cross-sectional view of a shoe 1300 according to one such embodiment. Shoe 1300 is similar to shoe 200. The sectioning plane of FIG. 13 has a location relative to shoe 1300 similar to the location of the FIG. 3A sectioning relative to shoe 200. As with FIG. 3A, FIG. 13 similarly shows a hindfoot portion of a wearer foot 1350 when the wearer is standing straight. Shoe 1300 includes a strap assembly 1311 that is similar to strap assembly 211 and a bootie 1315 similar to bootie 215. Base member 1301 and sock liner 1315 are similar to base member 301 and sock liner 215, but are curved so as to match an internal curvature of sole structure 1312.

The outer surface 1399 of sole structure 1312 has a rounded contour that mimics the shape of an unloaded human heel. In some embodiments, outer surface 1399 of sole structure 1312 is curved in a region that begins just forward of the malleoli and that continues to the rear end of the heel. The curvature of outer surface 1399 in a transverse section of sole structure 1312 within a region of shoe 1300 is similar to the curvature that the part of foot 1350 in that same transverse section would have in an unloaded condition, and with adjustment of the outer surface 1399 curvature to account for the thickness of sole structure 1312 in that transverse section. In the region shown in FIG. 13, representative dimensions w and h might be approximately 78 mm and 18 mm, respectively, for a men's size 12 shoe. Curved outer surface 1399 allows the rear of shoe 1300 to remain in stable contact with the ground when shoe 1300 is angled medially or laterally. A downward component of force from the wearer can be applied to the ground along portions of curved surface 1399 in contact with the ground as sole structure 1312 is tilted.

The internal surface 1380 of sole structure 1312 is also curved to approximate the curvature of an unloaded heel of the wearer foot 1350. This internal profile helps to prevent foot 1350 from sliding within shoe 1300. This internal profile also helps to prevent displacement of the foot 1350 fat pad from under the foot 1350 calcaneus when shoe 1300 contacts the ground, thereby adding cushioning to foot 1350 within shoe 1350.

Figure 14:
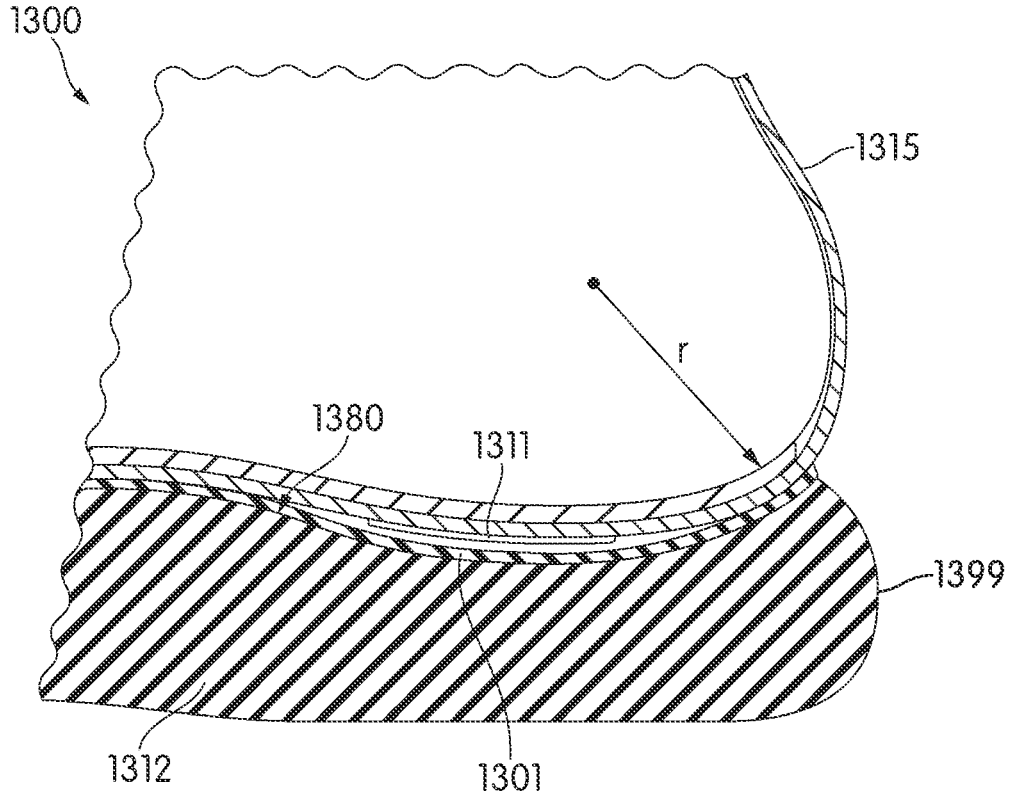

FIG. 14 is an area cross section of a heel region of shoe 1300 along the longitudinal axis of shoe 1300. As shown in FIG. 14, the profiles of outer surface 1399 and inner surface 1380 are also rounded so as to mimic the shape of the unloaded foot 1350 heel in longitudinal directions. In the region shown in FIG. 14, a representative dimension r might be approximately 28 mm for a men's size 12 shoe.

In some embodiments, sole structure 1312 may be primarily composed of a midsole. That midsole may have relatively thin outsole tread layers bonded to the midsole. The midsole material may sufficiently soft so as to deform with ground contact an allow additional area of the outsole to contact the ground, thereby increasing traction.

In some embodiments, shoe 1300 could be manufactured using a last that is more anatomically correct than conventional lasts. As indicated above, conventional footwear lasts are typically designed with added allowance for material thickness, component insertion, and foam padding. In some embodiments, a last for a particular size of shoe can by created by sampling feet having lengths within a predetermined range of the "stick" length of a conventional last for shoes of that size. Anatomical details from those measurements can then be added to a basic last shape. In particular, the locations of a first and fifth metatarsal, a full length foot volume, and widths of a foot various locations (including multiple heel locations), and unweighted heel contour can be mapped to a last having a correct stick length.

Various additional examples of articles of footwear, sole structures, and/or components of articles of footwear or sole structures in accordance with this aspect of the invention are described in more detail below. These components, sole structures, and/or articles of footwear also allow (and/or support) at least some degree of rotation of the rearfoot with respect to the forefoot during a direction change or cutting action (to better correspond to natural, unshod foot motion, as described above). The various example structures described below may be incorporated into footwear constructions that include a hindfoot strap component or system, e.g., of the various types described above.

I. Relative Motion Provided by Detached Interface Joint Between the Upper and Midsole Components Some example footwear and foot-receiving device structures in accordance with this invention will include a heel supporting component in a heel area of the shoe that is separate from a midsole component also provided in the heel area (the midsole component optionally may extend to other areas of the shoe as well, including the forefoot and midfoot regions). By providing separate components and maintaining them in an unattached or otherwise relatively movable configuration in the final footwear structure, the heel supporting component may be allowed to move toward the lateral side and/or medial side of the shoe (e.g., rotate, slide and rotate, etc.) along an interface between the heel supporting component and the midsole component. Thus, the heel supporting component moves relative to the midsole component. Using this type of construction, the rearfoot portion of the foot can move relative to the forefoot portion of the foot during phases of a cutting or direction change maneuver, and this relative movement may allow the rearfoot of the wearer to maintain a more neutral and natural ankle/foot orientation and/or motion (e.g., as shown in FIGS. 1B1 and 1B2). Examples of such foot-support structures and articles of footwear including such structures will be described in more detail below in conjunction with FIGS. 15A through 16E.

Figure 15A:
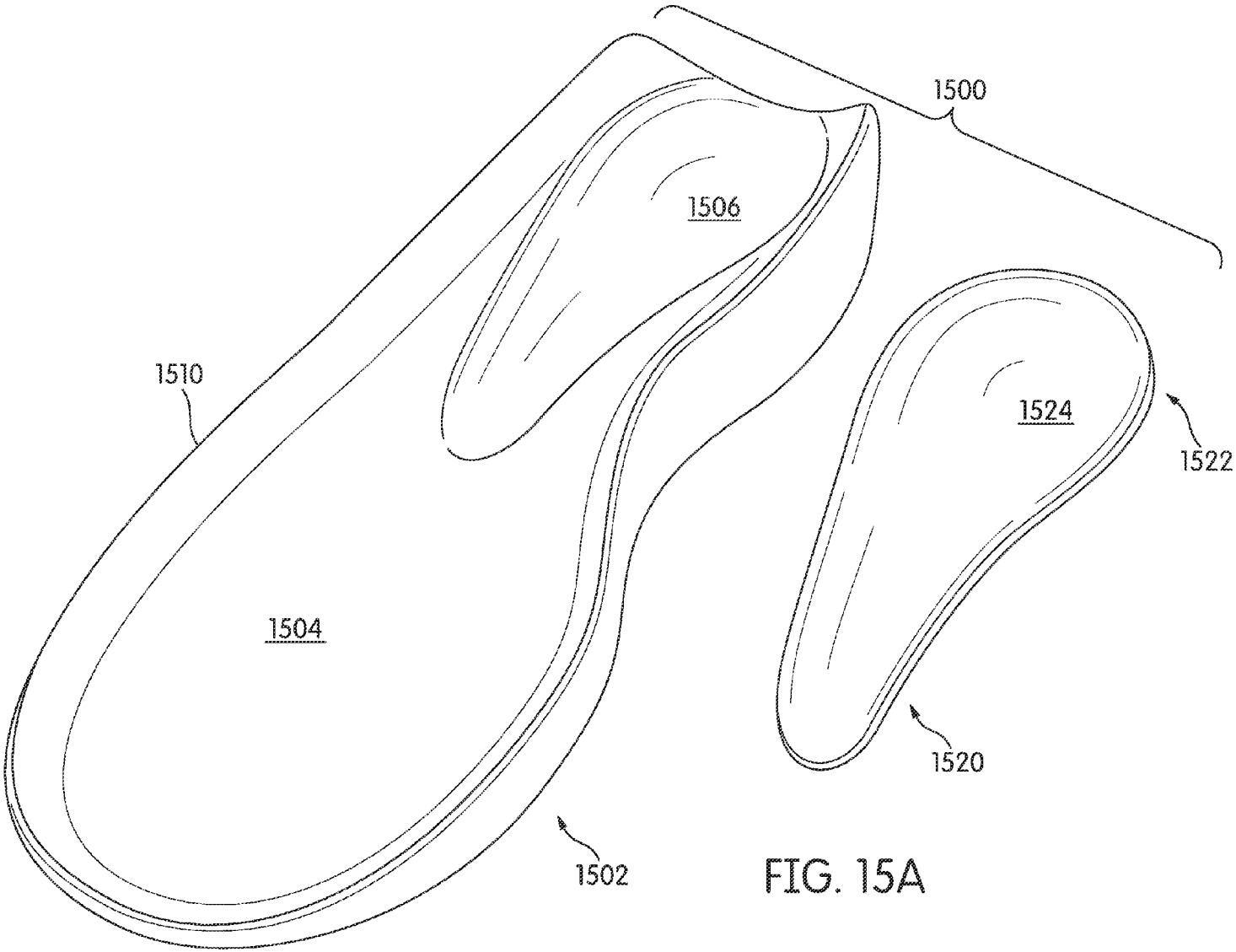
FIGS. 15A through 15C illustrate various views of a foot support member that includes a rotational or otherwise movable joint in accordance with at least some embodiments.

FIG. 15A shows an unassembled view of components of an example foot-support structure 1500 in accordance with this aspect of the invention. In this example, the foot-support structure 1500 includes a midsole component 1502, e.g., made of conventional midsole materials, such as polyurethane foam, foamed polyvinylacetate, etc., and/or other suitable or desired materials. In addition to the midsole component 1502 as a main impact force attenuating component, this example foot-support structure 1500 includes a heel supporting component 1520. The midsole component 1502 of this example includes a major upper surface 1504 that defines a support for at least a forefoot plantar surface of a wearer's foot. In this illustrated example, the midsole component 1502 extends to support virtually all of the forefoot and midfoot portions of a wearer's foot, and it even extends to the rearfoot area. Midsole components 1502 may provide support for the entire extent of the wearer's foot and extend throughout the entire longitudinal and transverse directions of an article of footwear. The major upper surface 1504 of the midsole component 1502 may curve upward somewhat at the perimeter edges, e.g., to provide a well-defined surface on which the plantar surface of the foot rests in use. Also, the major upper surface 1504 of the midsole component 1502 may be contoured to better conform to the shape of a human foot (e.g., in ways that are conventionally known in the art).

As further shown in FIG. 15A, a heel area of the major upper surface 1504 includes a recessed portion 1506 having a curved upper surface that extends inward, into a base material of the midsole component 1502. The recessed portion 1506 of this example lies beneath the calcaneus bone of a wearer's foot and extends forward, tapering in transverse width and terminating near, at, or within a midfoot region of the midsole component 1502.

For reasons that will be described in more detail below, the heel supporting component 1520 of this example is separate from the midsole component 1502. The heel supporting component 1520 includes a curved lower surface 1522 that is movably received in the recessed portion 1506 of the major upper surface 1504 of the midsole component 1502 (see also FIG. 15B). In this manner, in use, the heel supporting component 1520 may be movable toward at least one of a medial side or a lateral side of the shoe along an interface between: (a) the curved upper surface of the recessed portion 1506 of the midsole component 1502 and (b) the curved lower surface 1522 of the heel supporting component 1520. Such relative movement of these components is illustrated in FIG. 15C. A similar relative motion of these components toward the lateral side 1510 of the midsole component 1502 may occur, for example, during a cutting or rapid direction change action. The upper surface 1524 of the heel supporting component 1520 also may include appropriate contours, e.g., to conform to the shape of a wearer's foot. In particular, the upper surface 1524 of the heel supporting component 1520 may curve upward around the rear and side perimeter areas, e.g., to somewhat better conform to the shape of the wearer's heel and/or to form a rear heel engaging element that supports the rear and lower side areas of the heel.

The heel supporting component 1520 may be made from any suitable or desired materials without departing from this invention, including materials conventionally used for producing midsole components, such as polyurethane foam, foamed polyvinylacetate, and the like. If necessary or desired, at least one of the recessed portion 1506 of the major upper surface 1504 of the midsole component 1502 and/or the curved lower surface 1522 of the heel supporting component 1520 may be altered to reduce a coefficient of friction of the recessed portion 1506 with respect to the curved lower surface 1522 (i.e., at the interface of these surfaces). This may be accomplished in various ways, such as by treating some or all of one or both of these surfaces 1506 and 1522 to make them harder, slipperier, less tacky, etc. As another example, some or all of one or both of these surfaces 1506 and 1522 may be coated or otherwise covered with another material that lowers the coefficient of friction between these interfacing surfaces 1506 and 1522. Also, one or both of these interfacing surfaces 1506 and 1522 may be made harder than a majority of a material making up the remainder of the corresponding component, e.g., to reduce the coefficient of friction between the interfacing surfaces, to improve wear resistance, etc.

As best shown in FIG. 15C, in use, the heel supporting component 1520 is movable with respect to the midsole component 1502 in a sliding and/or rotational manner, e.g., rotatable about an axis A extending generally in the longitudinal direction. As another potential alternative construction, if desired, the heel supporting component 1520 may be mounted on the midsole component 1502 (or other appropriate portion of the shoe structure) on a physical rotational axis member. As some more specific examples, if desired, the forward and rear ends of the heel supporting component 1520 may include extending axle or ball members that fit into corresponding recesses or socket members provided at the rear heel area and the front of recessed portion 1506 of the midsole component 1502. As another option, the midsole component 1502 may include the axle or ball members that fit into recesses or sockets provided in the heel supporting component 1520. As still another option, the midsole component 1502 and the heel supporting component 1520 may include appropriately engaging rail and groove structures to enable translation and/or rotation of the heel supporting component 1520 with respect to the midsole component 1502 in the side-to-side direction (such rail and groove structures also may dovetail to prevent vertical separation of these parts, e.g., during a heel lifting portion of a step cycle). Other appropriate rotational or sliding supports between the interface of these parts 1502 and 1520 also may be used without departing from this invention.

Figure 15B:
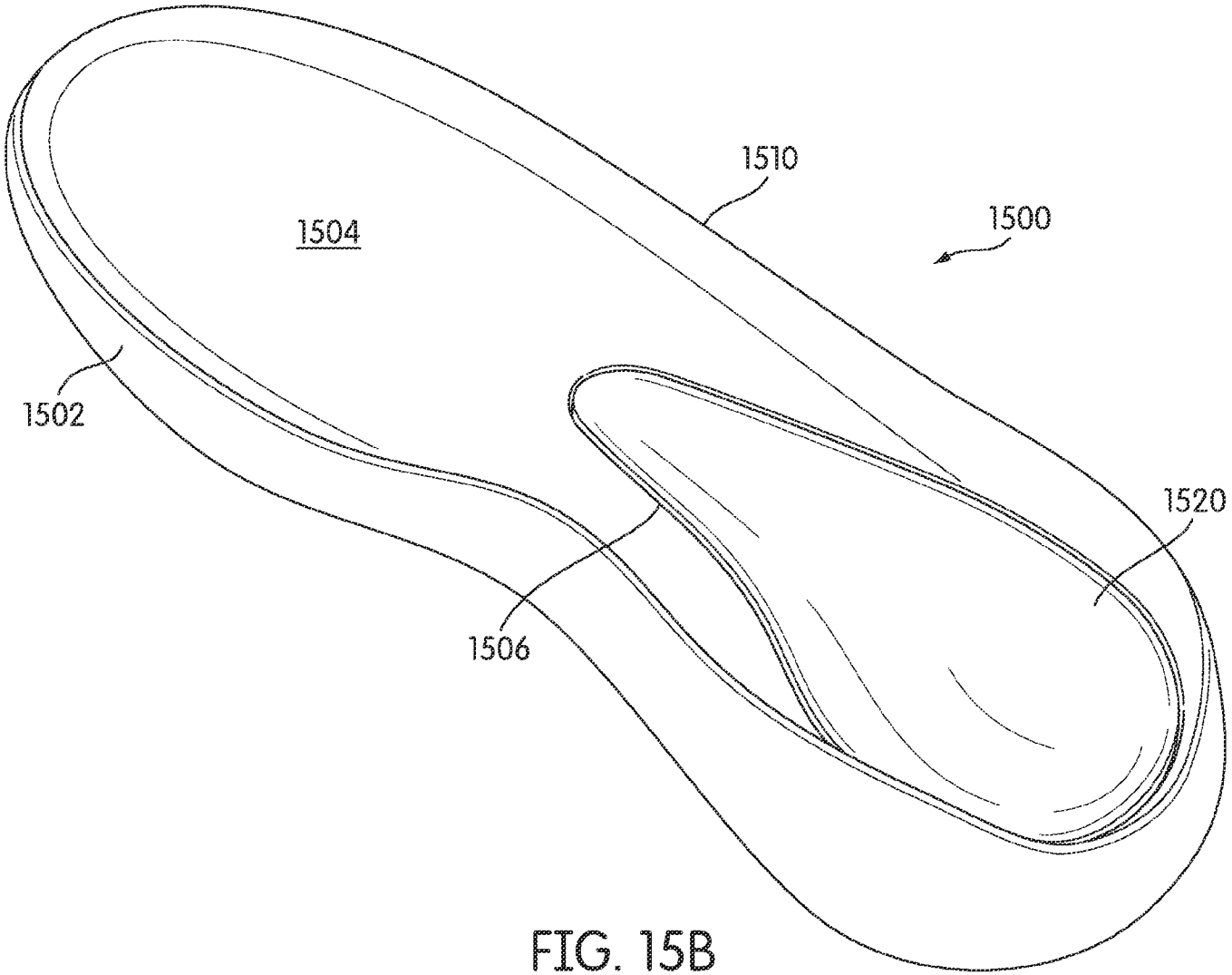
Figure 15C:
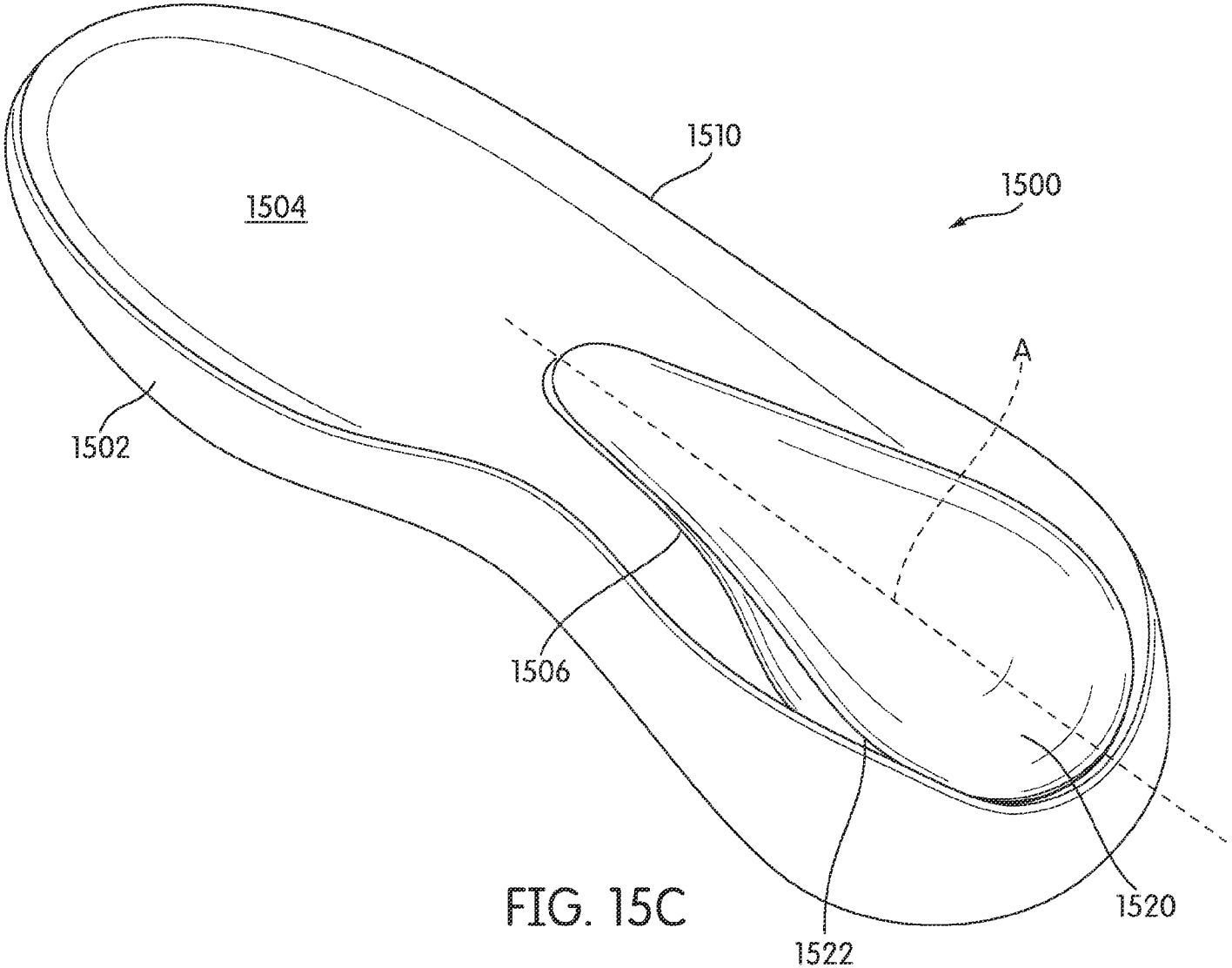

The foot-supporting component 1500 may have a variety of different sizes, shapes, parts, constructions, and the like, in addition to or in place of some of the structures shown in FIGS. 15A through 15C, without departing from this invention. As some additional examples, the foot-supporting component 1500 may include one or more fluid-filled bladders, optionally bladders embedded in or otherwise supported by the material of a midsole component 1502 (e.g., a fluid-filled bladder with an exposed upper surface, one or more exposed side surfaces, etc.). Additionally or alternatively, the foot-supporting component 1500 may include one or more discrete support elements, such as support pillars of any desired shapes made from foam or other materials.

Figure 16A:
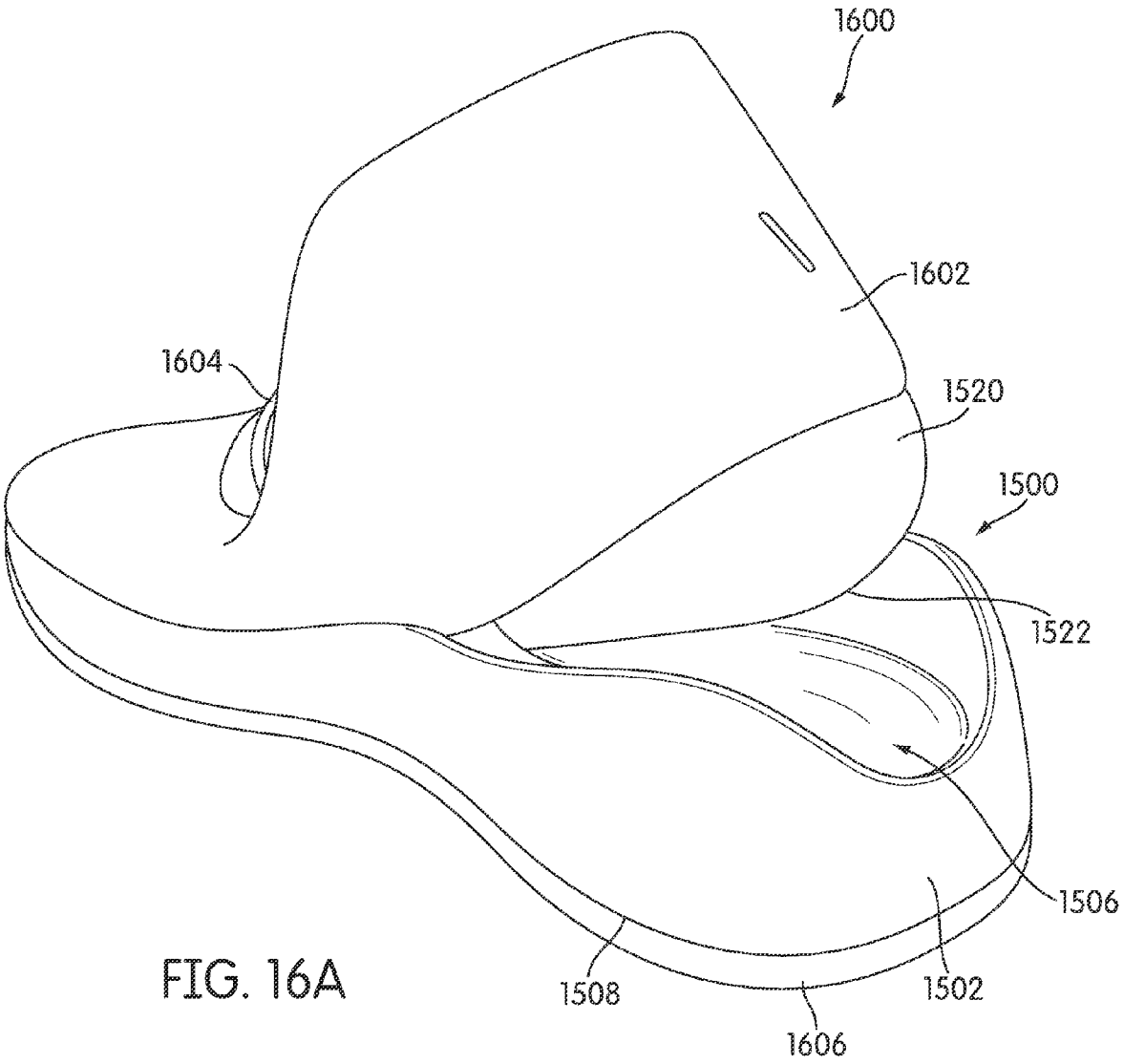
FIG. 16A illustrates an article of footwear including a foot support member of the type illustrated in FIGS. 15A through 15C.

FIGS. 16A through 16D illustrate various features of example articles of footwear 1600, 1650 including foot-support structures 1500 of the types described above in conjunction with FIGS. 15A through 15C. First, as shown in FIG. 16A, this example article of footwear 1600 includes an upper 1602, e.g., made of any desired material(s) and/or in any desired constructions, including from conventional materials and conventional constructions as are known and used in the art and/or from the materials and constructions described above. The heel supporting component 1520 described above is engaged with the upper 1602 at a heel area thereof in any suitable or desired manner, including via adhesives or cements, via mechanical connectors, via fusing techniques, and/or via sewing or stitching. As shown in FIG. 16A, the heel supporting component 1520 includes a rounded, curved lower surface 1522 (generally conforming to the shape of a human heel).

As further shown in FIG. 16A, the lower surface 1522 of the heel supporting component 1520 fits into the recess 1506 on the top surface 1504 of the midsole component 1502. While the midsole component 1502 is engaged with the upper 1602 at least at the forefoot area of the shoe 1600 (e.g., via adhesives or cements, via mechanical connectors, via fusing techniques, and/or via sewing or stitching), the rear heel area of the midsole component 1502 remains unattached to the upper 1602 and unattached to the heel supporting component 1520 that is engaged with the upper 1602. This detachment is provided to support the rotational and/or sliding action at the interface between the curved upper surface of the recessed portion 1506 of the midsole component 1502 and the curved lower surface 1522 of the heel supporting component 1520, as described above in conjunction with FIG. 15C.

The article of footwear 1600 may include many other features or components without departing from this invention, including features or components that are conventionally known or used in the art. As some more specific examples, as shown in FIG. 16A, the article of footwear 1600 includes an upper securing system (e.g., lace 1604 and structures for engaging the lace 1604). Additionally or alternatively, at least some portion(s) of the bottom major surface 1508 of the midsole component 1502 may be covered by an outsole component 1606. The outsole component 1606 may have any desired construction and/or be made from any desired materials without departing from this invention, including conventional constructions and materials as are known and used in the art (e.g., synthetic rubber, plastic, etc.). The outsole component 1606, which provides a durable ground contacting surface, may be applied to the midsole component 1502 (or other footwear component) in any desired manner without departing from this invention, including in conventional manners as are known and used in the art (e.g., via adhesives or cements, via mechanical connectors, via fusing techniques, and/or via sewing or stitching). Additionally, the outsole component 1606 (which may constitute a single or multiple parts) may include traction elements, cleats, or the like, including elements of this type as are conventionally known in the art.

Figure 16B:
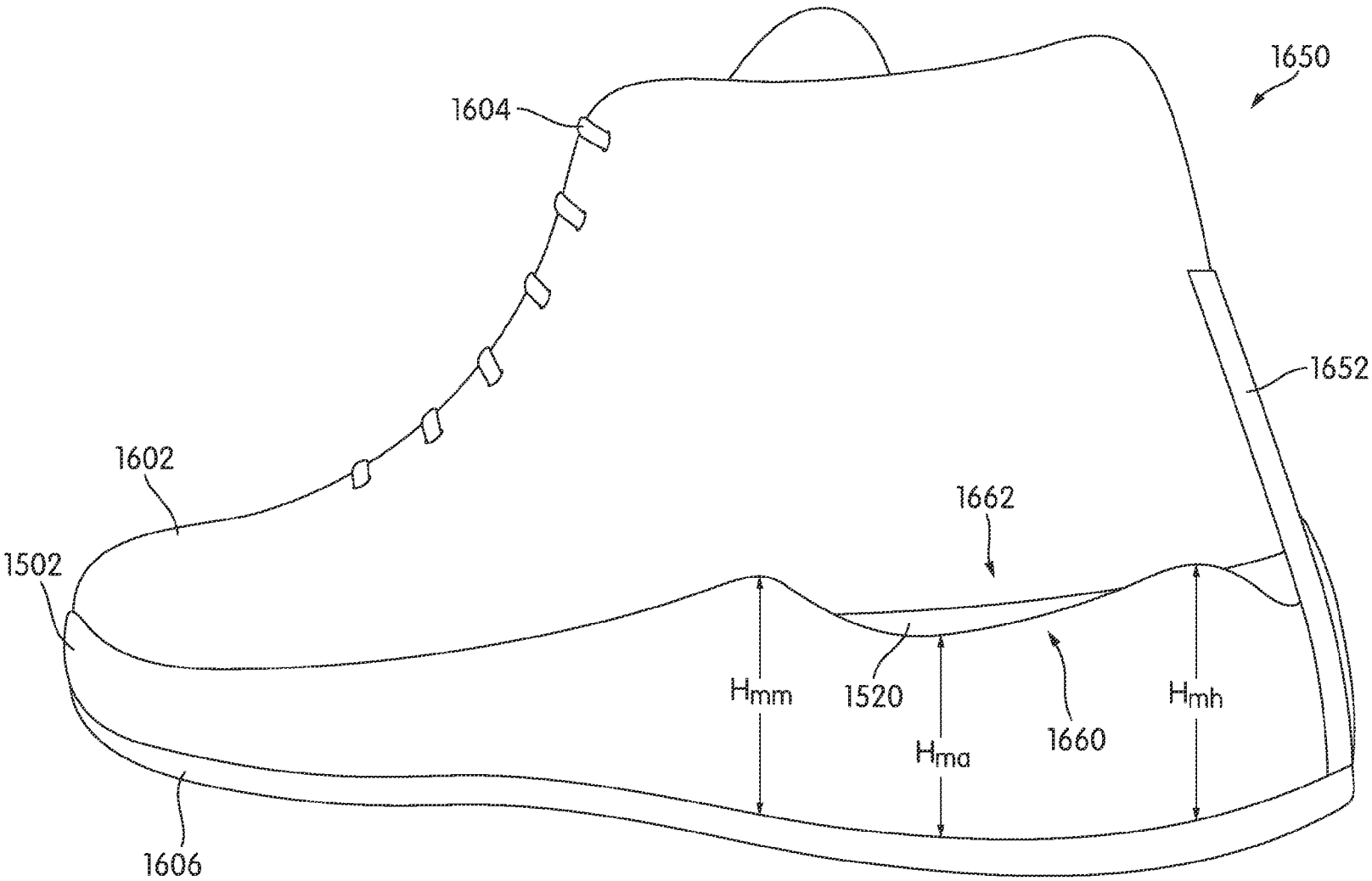
FIGS. 16B through 16E illustrate various views of a variation of the article of footwear shown in FIG. 16A and of the foot support member shown in FIGS. 15A through 15C.
Figure 16C:
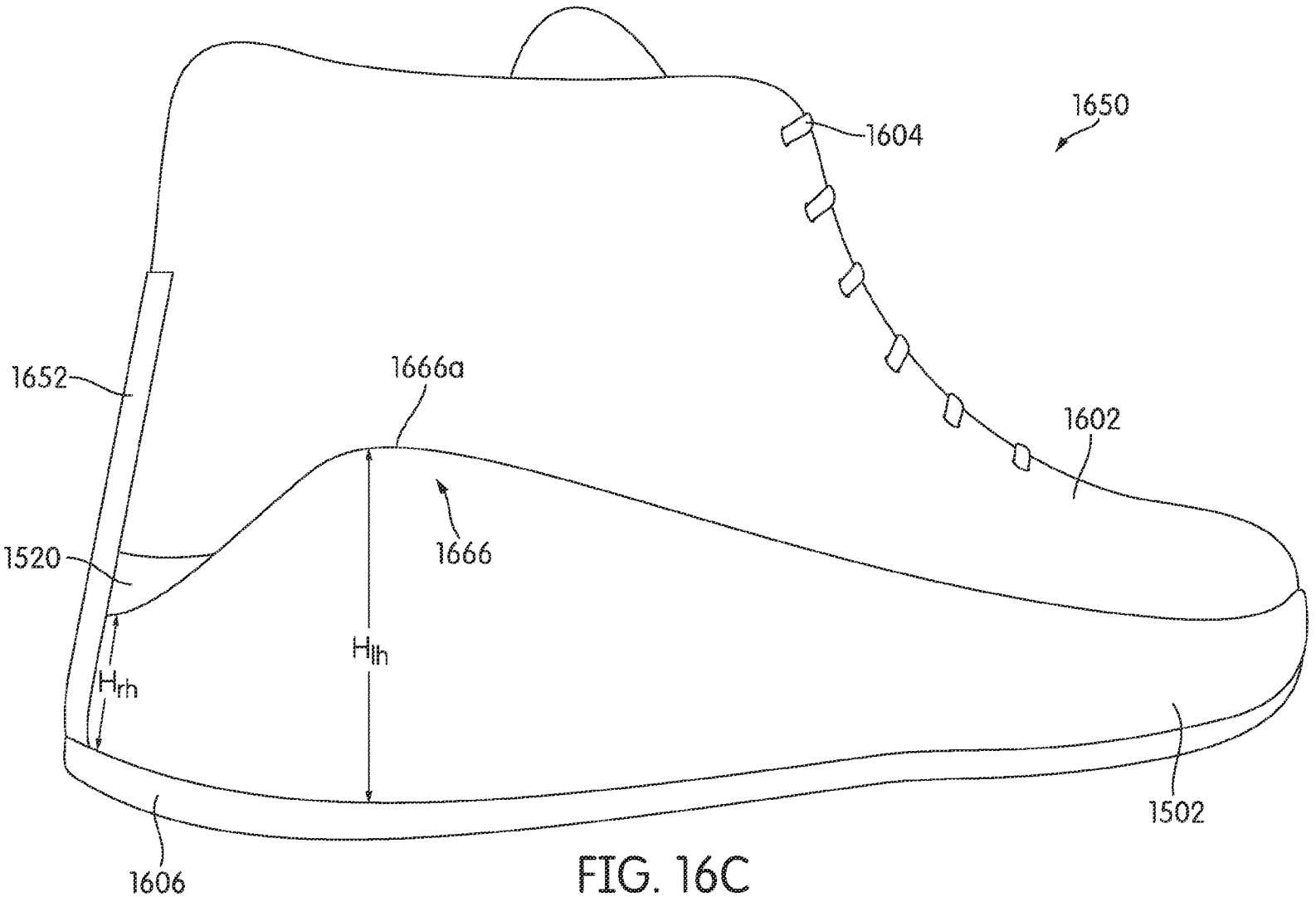
Figure 16D:
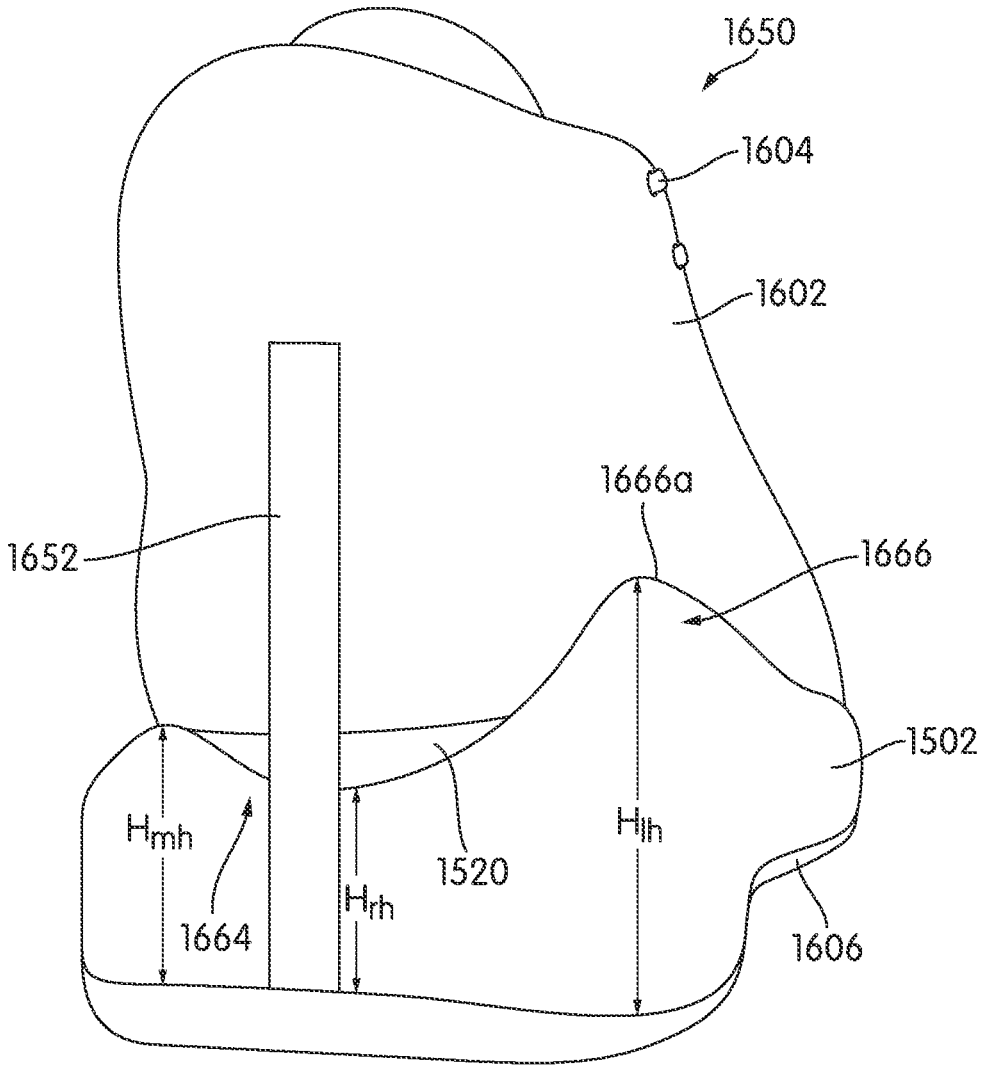

FIGS. 16B through 16D show additional potential features that may be included in articles of footwear and components thereof of the types generally described above with respect to FIGS. 15A through 16A. For example, if the heel area of the shoe 1600 shown in FIG. 16A is left completely uncoupled, the heel portion of the upper 1602 (including the heel supporting component 1520) may lift up and separate from the midsole component 1502 during a normal step cycle and then "slap" back up against one another as the shoe lifts off the ground (akin to the manner in which many sandals "slap" against the bottom of the wearer's foot during a step). This feature may be undesirable (or even unsafe) for use in an article of footwear during athletic activities. Accordingly, in the article of footwear 1650 shown in FIGS. 16B through 16D, a connecting element 1652 is provided for engaging the rear heel area of the midsole component 1502 with the upper 1602 so as to reduce or prevent vertical separation between the upper 1602 and the midsole component 1502 when an upward force is applied to the upper 1602 by a wearer's foot (e.g., like when the wearer lifts his/her heel off the ground during a step cycle). While the connecting element 1652 reduces vertical separation between these parts, it still allows the side-to-side or rotational movement of the heel supporting component 1520 with respect to the midsole component 1502 in the manner described above (along the interfacing surfaces between these parts). As other options, if desired, the upper end of the connecting element 1652 may engage the heel supporting component 1520 in addition to or in place of the engagement with the upper 1602. As yet another example, if desired, the lower end of the connecting element 1652 may engage the outsole component 1606, e.g., at the rear heel area, in addition to or in place of the engagement with the midsole component 1502.

The connecting element 1652 may take on a variety of sizes, shapes, numbers of parts, and the like, without departing from this invention. In this illustrated example, the connecting element 1652 is a single textile strip that extends along the rear heel area of the shoe 1650 connecting the midsole component 1502 and the upper 1602. If desired, multiple strips of this type may be provided in the rear heel area. Additionally or alternatively, if desired, a connecting element may be provided at the sides of the heel area, particularly at the medial heel side area (as the medial side will not typically stretch excessively during a cutting or direction change motion). Other materials and/or structures may be used to prevent vertical separation of these parts without departing from this invention, including, for example, retaining surfaces or stop members on the midsole component 1502 and upper 1602 that engage one another when an upward force is applied to the upper during a step cycle, dovetailing structures (e.g., on the surfaces 1522 and 1506 or other surfaces), or the like.

FIGS. 16B through 16D show additional features that may be provided in articles of footwear 1650 in accordance with this aspect of the invention to support the rotational/sliding movement of the heel supporting component 1520 with respect to the midsole component 1502. More particularly, as shown in these figures, the heel area of the midsole component 1502 may be configured to better accommodate the relative motion. As shown in FIGS. 16B and 16D, the upper perimeter, medial heel side area 1660 of the midsole component 1502 has a reduced height and/or an arched configuration to provide additional room to accept the bottom medial heel side 1662 of the upper 1602 during a cutting motion (i.e., when the user steps down hard on the medial heel side of the outer foot when making a rapid or high speed direction change). Notably, the height $H_{ma}$ at the bottom of the perimeter, medial heel side area 1660 of the midsole component 1502 (the bottom of the arch, in this illustrated example) is less than the height $H_{mh}$ at the medial heel area of the midsole component 1502 and less than the height $H_{mm}$ at the medial midfoot area of the midsole component 1502 (the peaks immediately adjacent the reduced height or arched region).

Also, as illustrated in FIGS. 16B through 16D, the rear heel perimeter portion 1664 of the midsole component 1502 is arched or otherwise has a reduced height. Notably, the height $H_{rh}$ at the bottom of the rear heel perimeter portion 1664 of the midsole component 1502 (the bottom of the arch, in this illustrated example) is less than the height $H_{mh}$ at the medial heel area of the midsole component 1502 and less than the height $H_{lh}$ at the tallest point of the lateral heel area of the midsole component 1502. This arched area 1664 reduces friction between the moving parts and provides better clearance and room for the parts to rotate or slide with respect to one another (along the interface between surfaces 1522 and 1506). As further shown in FIGS. 16C and 16D, the upper perimeter, lateral heel side area 1666 of the midsole component 1502 is higher and built up compared to other portions of the midsole component 1602 (e.g., $H_{lh}>H_{mh}$ and/or $H_{mm}$). In some examples of this invention, $H_{lh}>1.5H_{mh}$, and even $H_{lh}>1.75H_{mh}$ or even $>2H_{mh}$. This higher, built up portion of the lateral heel side area 1666 of the midsole component 1502 helps contain the heel supporting component 1520 within the midsole component 1502 during a cutting action (e.g., helps prevent the heel supporting component 1520 from rotating or sliding beyond the top edge 1666*a*). Additionally or alternatively, if necessary or desired, a rotation stop element may be provided at an appropriate location, such as at the lateral heel side area, e.g., another textile strap like element 1652. Such a stop element may join upper 1602 to midsole component 1502 or outsole component 1606. This stop element may be loose when the wearer stands upright (and the heel supporting component 1520 is seated squarely in the recess 1506 of midsole component 1502) and under tension during a cutting action or maneuver (e.g., when the heel supporting component 1520 is rotated in the recess 1506).

Figure 16E:
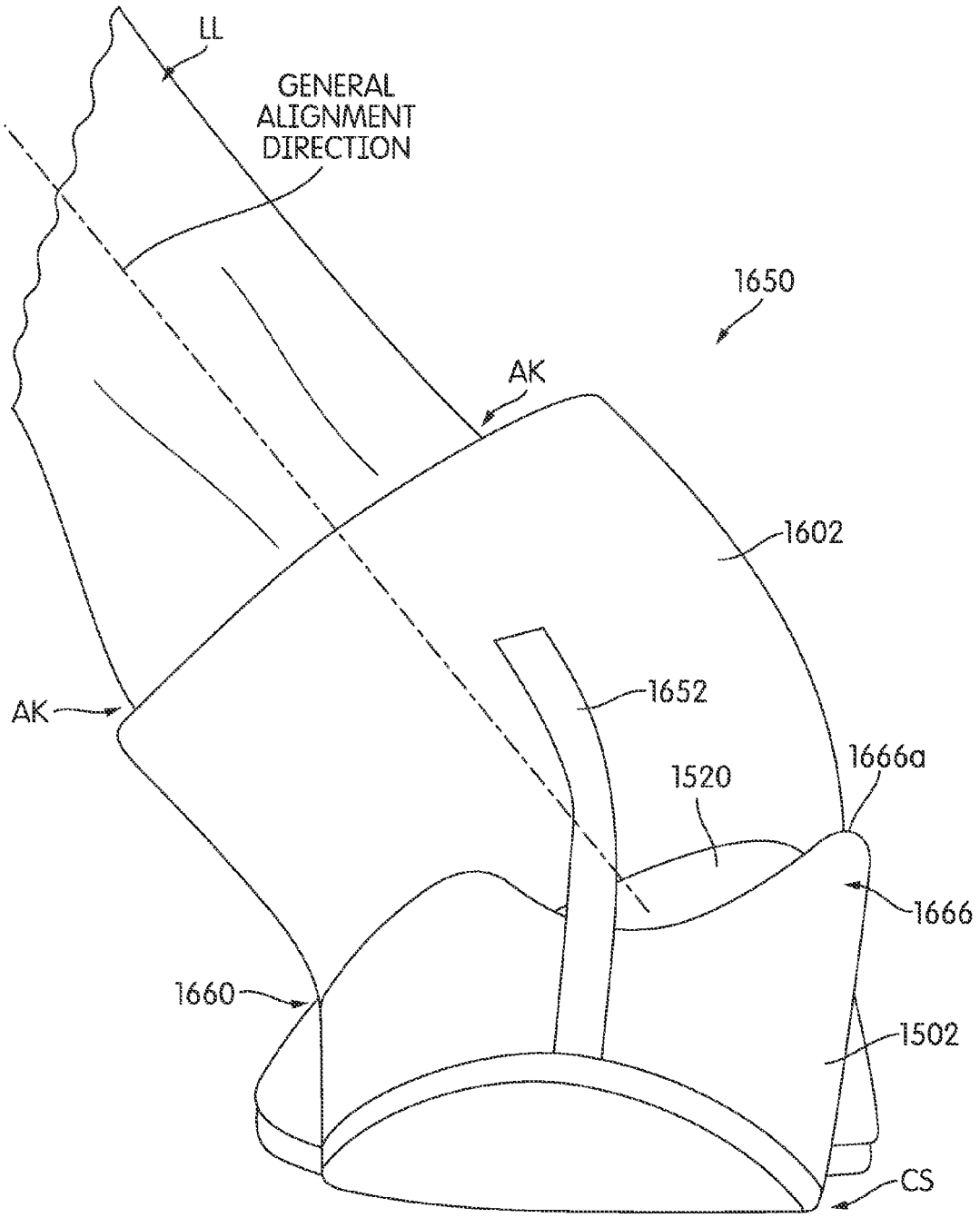

FIG. 16E illustrates a rear view of the article of footwear 1650 during a cutting action. As shown, when the wearer steps down hard on the medial side of this shoe (e.g., to make a quick direction change at high speed), the heel supporting component 1520 slides or rotates toward the lateral side of the shoe 1650 along the interface between the lower surface 1522 of the heel supporting component 1520 and the surface of the recessed portion 1506 of the midsole component 1502. This lateral rotation or sliding of the heel area of the foot can take place while the forefoot portion of the foot (and indeed the entire outsole component 1606, as shown in FIG. 16E) remains relatively flat and/or on the contact surface CS. This rotational action of the heel supporting component 1520 helps keep the lower leg LL and ankle AK aligned and provides a more neutral and natural orientation, motion, and feel for the article of footwear during this cutting action.

Notably, the raised lateral heel side area 1666 of the midsole component 1502 provides support during this cutting action and the raised upper edge 166*a* helps keep the heel supporting component 1520 engaged with the remainder of the midsole component 1502. FIG. 16E further illustrates how the reduced height of the medial heel side area 1660 of the midsole component 1502 provides some additional room for this rotational motion. Also, FIG. 16E illustrates how the connecting element 1652 prevents vertical separation of the upper 1602 from the midsole component 1502 while still allowing side-to-side motion of these parts (note the bend in connecting element 1652).

While not a requirement (and while not shown), if desired, foot-support structures and articles of footwear of the types described above in conjunction with in FIGS. 15A through 16E may be used in combination with a heel securing strap component, e.g., of the types illustrated in FIGS. 2A through 2C and 4. For example, if desired, the heel securing strap component 211 may extend at least partially under and fix to the curved lower surface 1522 of the heel supporting component 1520 (and between surfaces 1522 and 1506) for securely engaging the heel supporting component 1520 with a wearer's heel. As a more specific example, if desired (and as illustrated in FIGS. 2A through 2C), the heel securing strap component 211 may include: (a) a medial side junction area, (b) a lateral side junction area, (c) a lower medial strap component 233 that extends from the medial side junction area and under a medial side of the curved lower surface 1522 of the heel supporting component 1520, (d) a lower lateral strap component 232 that extends from the lateral side junction area and under a lateral side of the curved lower surface 1522 of the heel supporting component 1520, (e) a rear heel strap component 231 that extends from the medial side junction area to the lateral side junction area to engage around a rear heel portion of a wearer's foot, (f) an upper medial strap component (including the free end of the strap in FIG. 4) that extends from the medial side junction area toward a medial instep area of the article of footwear, and (g) an upper lateral strap component (including the tensioning device at its free end in FIG. 4) that extends from the lateral side junction area toward a lateral instep area of the article of footwear. The free ends of the upper medial strap component and the upper lateral strap component may engage one another (e.g., via hook-and-pile fasteners, snaps, buckles, tying, or the like) or another structure to securely engage the heel securing strap component around the wearer's heel.

As another alternative, if desired, the lower medial strap component 233 and the lower lateral strap component 232 mentioned above may be replaced by a single lower strap component that extends from the medial side junction area to the lateral side junction area under the curved lower surface 1522 of the heel supporting component 1520 (optionally fixed to the curved lower surface 1522 at one or more locations). If necessary or desired, one or both of the surfaces 1522 and 1506 may include a groove to receive the portions of the lower strap component(s) that extend under the curved lower surface 1522, to reduce or prevent direct contact between the strap(s) and the surface 1506, which could lead to wear, additional friction, and the like. Optionally, the portions of the straps that extend between surfaces 1506 and 1522 may be made from appropriate materials and/or treated so as to have a reduced or low coefficient of friction with respect to surface 1506 to better support and accommodate relative motion between these interfacing surfaces 1506 and 1522.

II. Relative Motion Provided by Flexible Foot Support Members

Other types of foot support members, such as shank plates in articles of footwear, also may be used to provide (or increase) an amount of rotation of the rearfoot with respect to the forefoot during a direction change or cutting action. FIGS. 17A through 17D illustrate one example of this type of foot support member 1700 in the form of a shank plate that can help provide the desired dynamic activity and help maintain a more aligned lower leg and ankle during a cutting action (a more neutral and natural orientation and/or motion of the foot).

The support member 1700 illustrated in FIGS. 17A through 17D provides a support for a plantar surface of a wearer's foot. This shank plate type support member 1700 may be provided at any desired location within a shoe construction, e.g., immediately beneath an insole or sock liner; included within or on top of a midsole component; between a midsole component and an outsole component; etc.

Figure 17A:
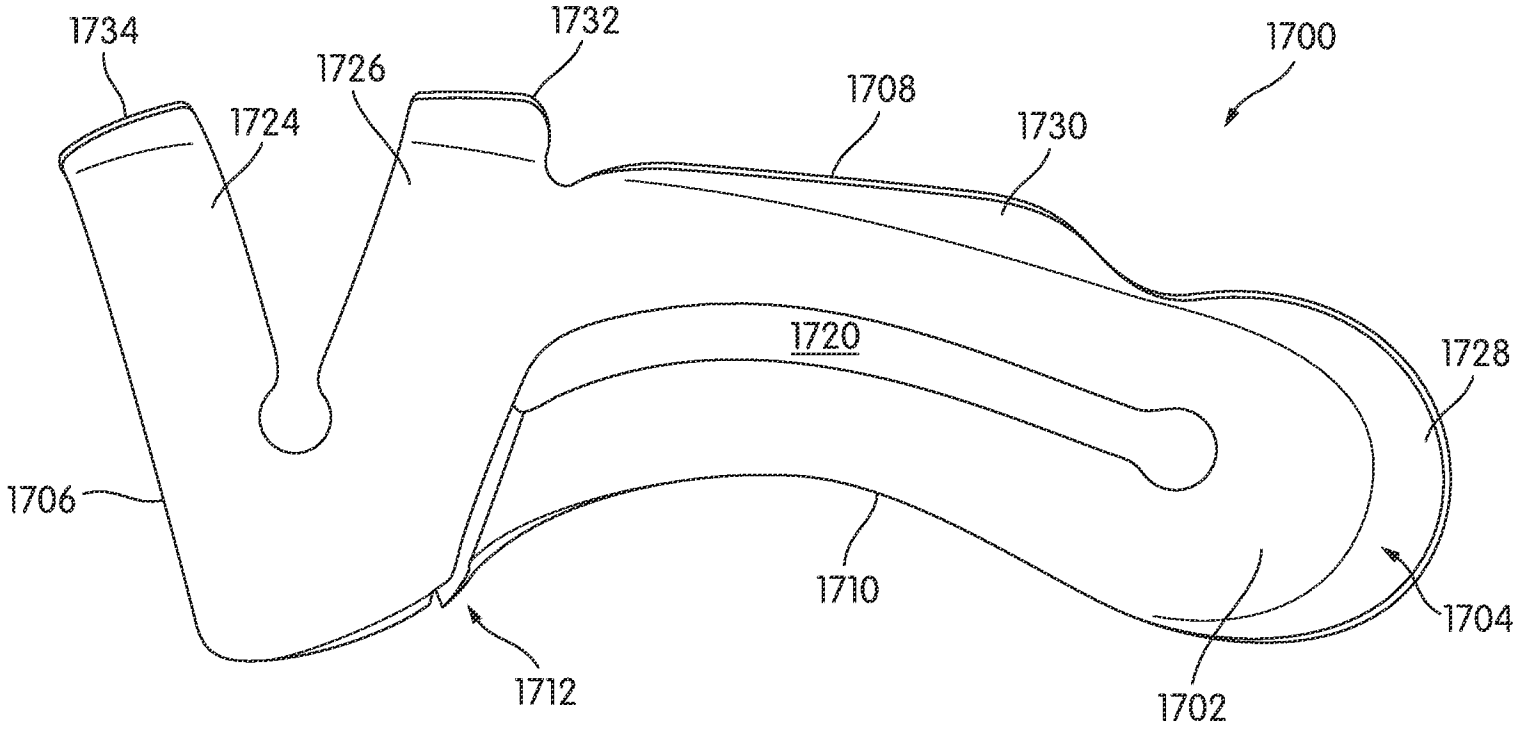
FIGS. 17A through 17D illustrate various views of a foot support member in the form of a shank plate that may be provided in at least some embodiments.

FIG. 17A shows a top view of the support member 1700, including the upper surface 1702 for supporting the plantar surface of a wearer's foot. The upper surface 1702 includes a heel support region 1704, a forefoot support region 1706, a lateral side member 1708 extending between heel support region 1704 and forefoot support region 1706, and a medial side member 1710 extending between the heel support region 1704 and the forefoot support region 1706. The various regions and members of the support member 1700 may be made from any desired materials without departing from this invention, including metals, metal alloys, polymers, composite materials, fiber-reinforced materials, and the like (e.g., rigid polymeric materials), provided the various regions and members as constructed are capable of functioning in the manner described in more detail below. Also, the support member 1700 may be made of any number of individual parts without departing from this invention, including a single, unitary, one-piece construction as shown in FIGS. 17A through 17D.

In this illustrated example structure 1700, the lateral side member 1708 is fixed to each of the heel support region 1704 and the forefoot support region 1706. While this is accomplished in the illustrated example structure 1700 by integrally forming the lateral side member 1708 with the heel support region 1704 and the forefoot support region 1706 as a unitary, one-piece construction (e.g., by an injection molding process using a plastic polymer material), other options are available. For example, if desired, the heel support region 1704 and the forefoot support region 1706 may be made as separate parts that are joined together by another separate part that functions as the lateral side member 1708. When made from multiple parts, the various parts may be fixed together in any desired manner, such as via cements or adhesives, via fusing techniques, via mechanical connectors, etc.

Figure 17B:
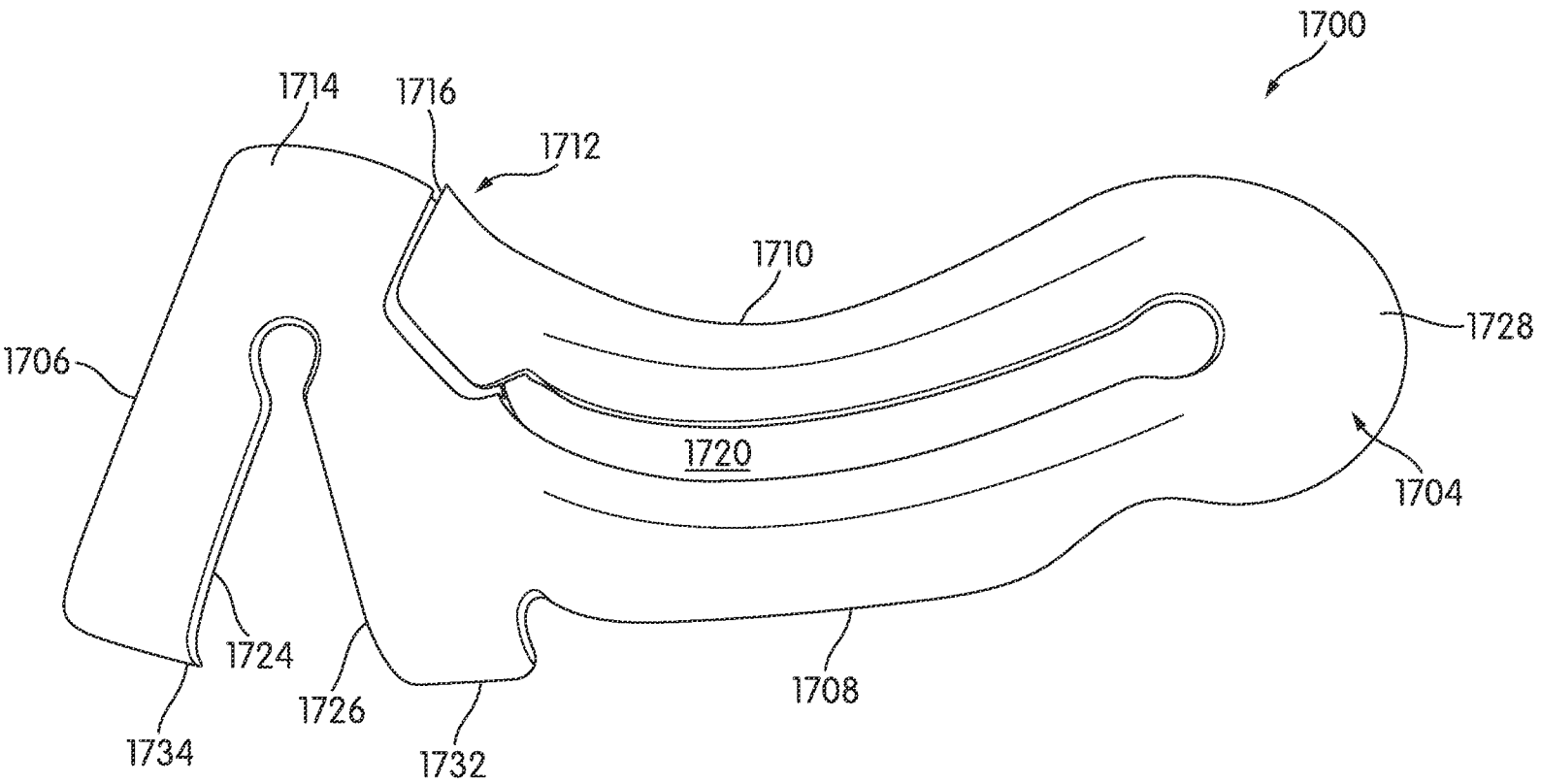
Figure 17C:
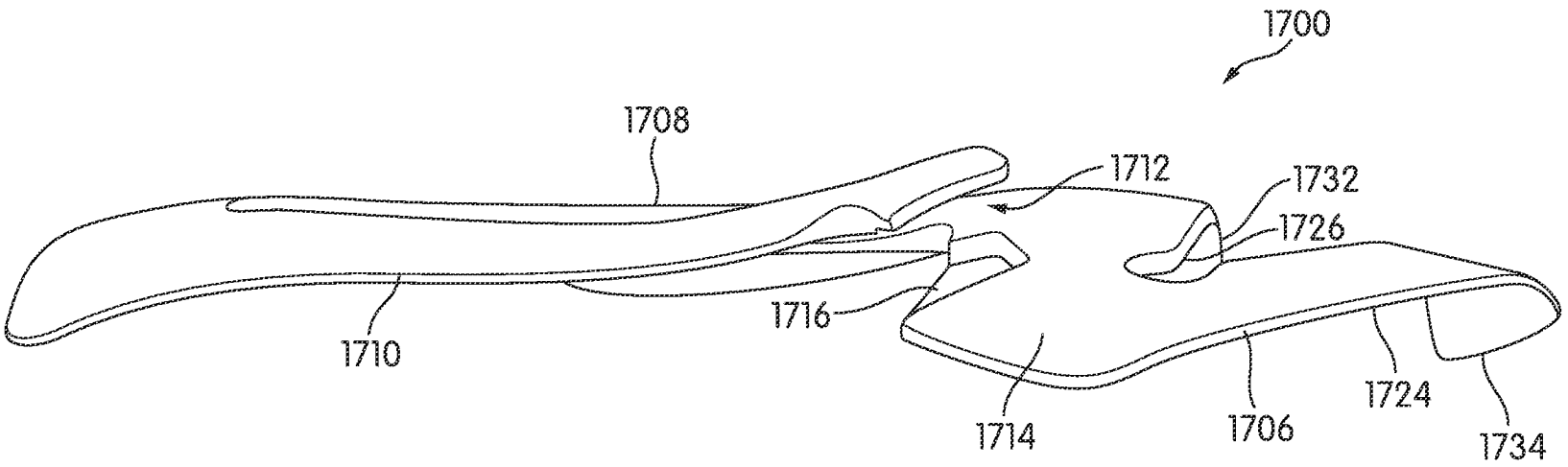
Figure 17D:
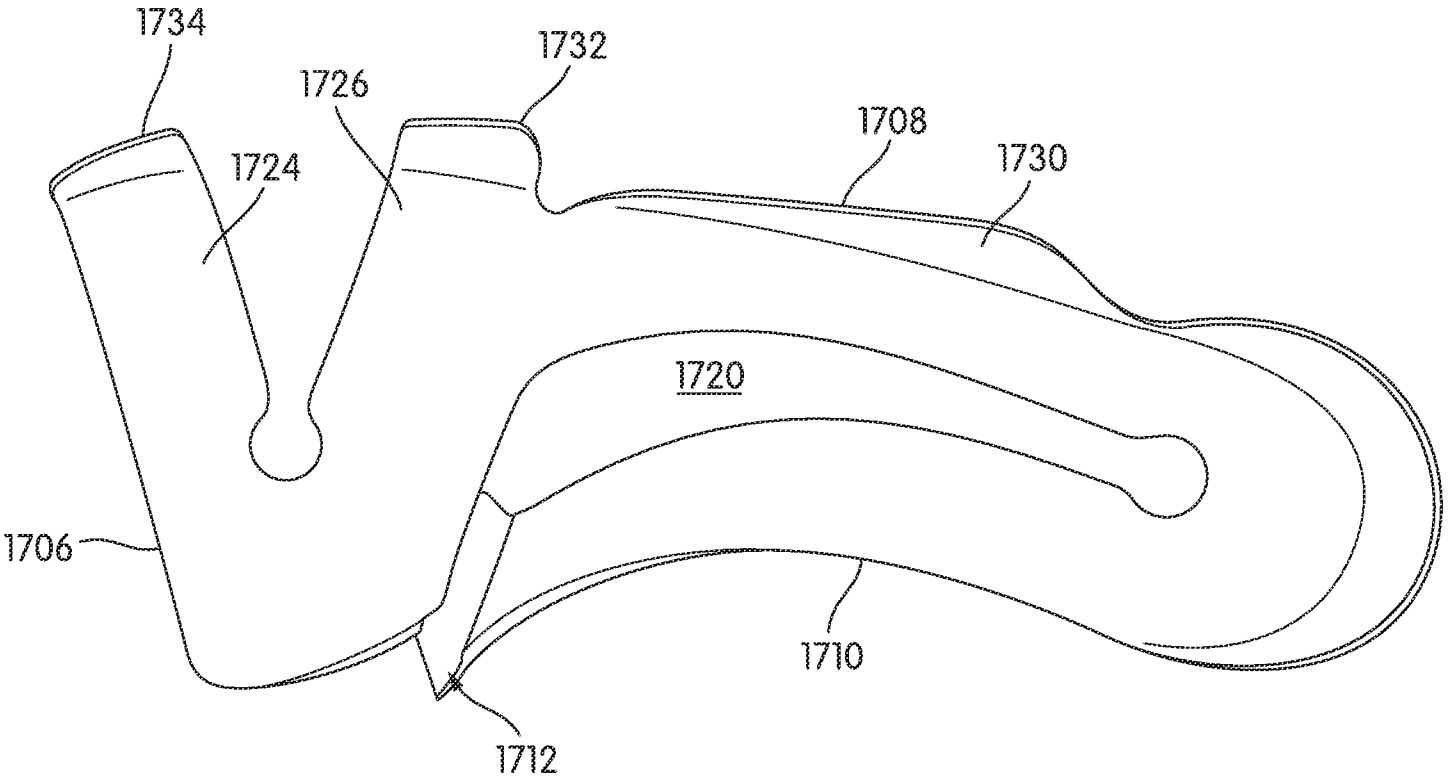

Also, in this illustrated example structure 1700, the medial side member 1710 is fixed to the heel support region 1704, e.g., by forming them as a unitary, one-piece construction (e.g., by injection molding) or by joining two separate members together, e.g., in the various manners noted above for lateral side member 1708. As best shown in FIGS. 17C and 17D, however, the medial side member 1710 of this example structure 1700 includes a free end 1712 that is not fixed to the forefoot support region 1706, and in fact, it partially overlaps with a portion of a major surface (in this illustrated example, the bottom major surface 1714) of the forefoot support region 1706 at one or more locations. In some example structures according to this aspect of the invention, including the one illustrated in FIGS. 17B and 17C, the medial side of the bottom major surface 1714 of the forefoot support region 1706 includes a recessed area 1716 for receiving the overlapping portion of the free end 1712 of the medial side member 1710. Optionally, if desired (and as shown in FIG. 17D), the free end 1712 of the medial side member 1710 may be made somewhat thinner at the very end (e.g., at least at the overlapping portion). In this manner, when the user stands on the shoe in an upright manner, the bottom of the overall shank member structure 1700 is flush or substantially flush (e.g., smoothly contoured) at the overlapping portion. As alternatives, if desired, the recessed or thinned area may be provided only on the bottom surface 1714 of the forefoot support region 1706 or only at the free end 1712 of the medial side member 1710, rather than at both the free end 1712 and the bottom major surface 1714 of the forefoot support region 1706. As yet another alternative, if desired, no recessed portion need be provided (or indeed, no overlapping portion need be provided). The recessed portion(s), when present, may be closely dimensioned to substantially match the shape of the overlapping area(s), or the recessed portion(s) may be somewhat or even substantially larger than the overlapping area(s).

As noted above, the foot support member 1700 may be made from rigid materials (e.g., a relatively hard plastic) that still provide some flexibility. In use, as a user wearing a shoe incorporating this support structure 1700 steps down hard on the medial side of an outside foot (e.g., to make a rapid, hard turn or a cutting action), the medial side member 1710 can flex such that the free end 1712 thereof moves in a direction away from the bottom major surface 1714 of the forefoot support region 1706 (e.g., to support a more neutral and natural lower leg/ankle orientation and/or motion). Flex of the medial side member 1710 in a direction toward the bottom major surface 1714 of the forefoot support region 1706, however, is limited by the overlap between the free end 1712 of the medial side member 1710 and the bottom major surface 1714 of the forefoot support region 1706 in this illustrated structure 1700.

Foot support members 1700 of this type may include various additional features that enhance their flexibility, comfort, and use. For example, as illustrated in FIGS. 17A, 17B, and 17D, in at least some example structures according to this aspect of the invention, the medial side member 1710 and the lateral side member 1708 are separated from one another by a space 1720. This space 1720 can help improve the feel and reduce the stiffness of the plate, particularly as the foot pronates (e.g., rolls from the lateral side to the medial side) during a step cycle and as the foot contacts the ground during a direction change or cutting action, as described above. Adjusting the widths (in the medial side-to-lateral side direction) and/or the thicknesses (in the top-to-bottom direction) of the medial side member 1710 and the lateral side member 1708, at least in part, also can allow the manufacturer to control the flexibility and stiffness of the support member 1700.

Flexibility in other directions or other areas also may help improve the "feel" of a shoe incorporating this support member 1700. For example, as illustrated in these figures, the forefoot support region 1706 of this example structure 1700 includes a flexion zone that allows flex of a lateral toe area 1724 and the very front of the forefoot support region 1706 with respect to a lateral ball area 1726 of the forefoot support region 1706. These features allow for better flex of the toe area of the shoe during a step cycle, a jump, a cut, etc., and improve the comfort of the support structure 1700.

Various areas of the support member 1700, and particularly the lateral side areas and the heel area, include raised side walls that help support the foot and maintain the foot's position during use of a shoe, including during a hard turn or cutting maneuver. Note, for example: the raised perimeter wall 1728 at a rear heel area of the heel support region 1704 (extending around the rear heel area of the heel support region 1704 from a medial side area to a lateral side area of the heel support region 1704); the raised side wall 1730 along the outside perimeter edge of the lateral support member 1708; the raised side wall 1732 along the lateral ball support region 1726 (part of the forefoot support region 1706); and the raised side wall 1734 along the lateral toe support region 1724 (also part of the forefoot support region 1706). While all of these side walls 1728, 1730, 1732, and 1734 are shown in the example structure 1700, one or more (or all) of these side walls could be omitted without departing from this invention (and optionally replaced with a side support as part of another component of the article of footwear). Also, while these side walls may be raised up from the plantar support surface immediately adjacent to them by any desired height without departing from this invention, in the illustrated example, for men's shoes (e.g., sizes about 9 to 12), these walls will be raised up at their highest points from about 2 mm to about 20 mm. The lateral ball support side wall 1732 in this illustrated example structure is the highest of all of the side support walls, with the lateral toe support wall 1734 being the next highest.

As noted above, the support member 1700 illustrated in FIGS. 17A through 17D provides a support for a plantar surface of a wearer's foot, and this shank plate type support member 1700 may be provided at any desired location within a shoe construction, e.g., immediately beneath an insole or sock liner; included within or on top of a midsole component; between a midsole component and an outsole component; etc. If necessary or desired, modifications may be made to other components of the footwear structure to accommodate the motion, as described above (i.e., the flex of the medial support member 1710 in a direction downward and away from the bottom major surface 1714 of the forefoot support region 1706). For example, if desired, the outsole of a shoe including this support member 1700 also may be detached or include a gap or flexible joint at the area of the overlapping portion between the medial side support 1710 and the forefoot support region 1706 (and optionally rearward thereof) so that the outsole can flex or move in the desired manner to support the movement of the free end 1714 of the medial side support 1710. As another example, if desired, the midsole, insole, sockliner, and/or the like may include a gap, slit, other detachment, or flexible joint at the area of the overlapping portion (and optionally rearward thereof) to help accommodate movement of the free end 1714 of the medial side support 1710 with respect to the forefoot support region 1706. As still another example, if desired, the outsole, midsole, insole, sockliner, and/or the like may include an elastic component or element at the area of the overlapping portion and extending rearward from the overlapping portion to help accommodate movement of the free end 1714 of the medial side support 1710 with respect to the forefoot support region 1706. Other constructions or combinations of the above constructions may be provided without departing from this invention.

While not a requirement (and while not shown), if desired, foot support members 1700 of the types described above in conjunction with FIGS. 17A through 17D may be used in combination with a heel securing strap component, e.g., of the types illustrated in FIGS. 2A through 2C and 4. For example, if desired, the heel securing strap component 211 may extend at least partially around and optionally attach to a lower surface of the foot support member 1700 in the heel support area 1704 of the foot support member 1700. As another alternative, if desired, the heel securing strap component may extend around a portion of the sole structure that lies above (and optionally rests on) the heel support area 1704 of foot support member 1700. Any desired location and connection of a heel securing strap component to a shoe including the shank plate support member 1700 may be used without departing from this invention.

III. Relative Motion Provided by Soft Midsole Components

Figure 18A:
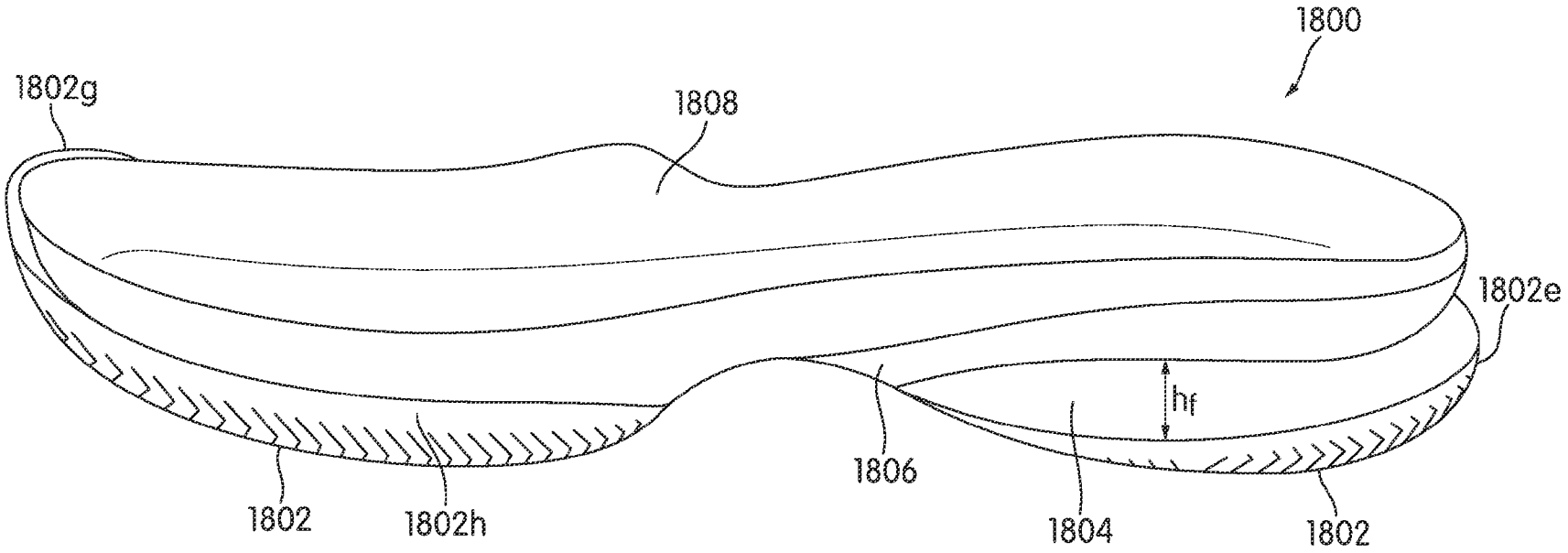
FIGS. 18A through 18M illustrate various views of a sole structure and various individual components thereof that may be provided in at least some embodiments.
Figure 18B:
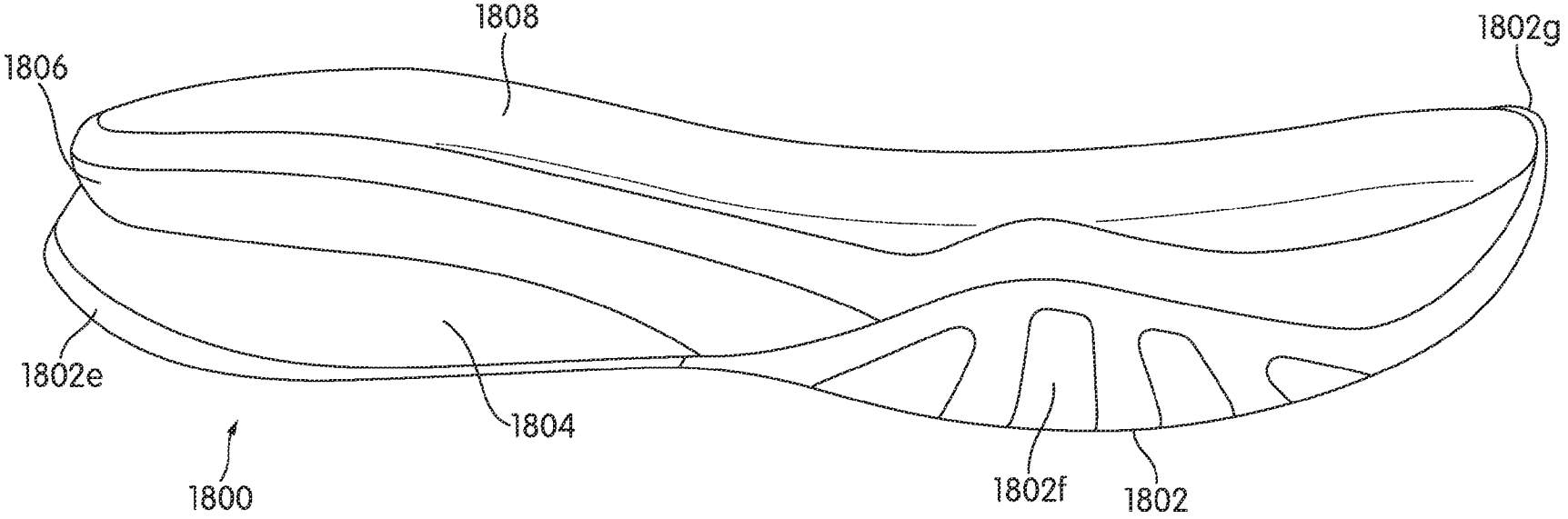
Figure 18C:
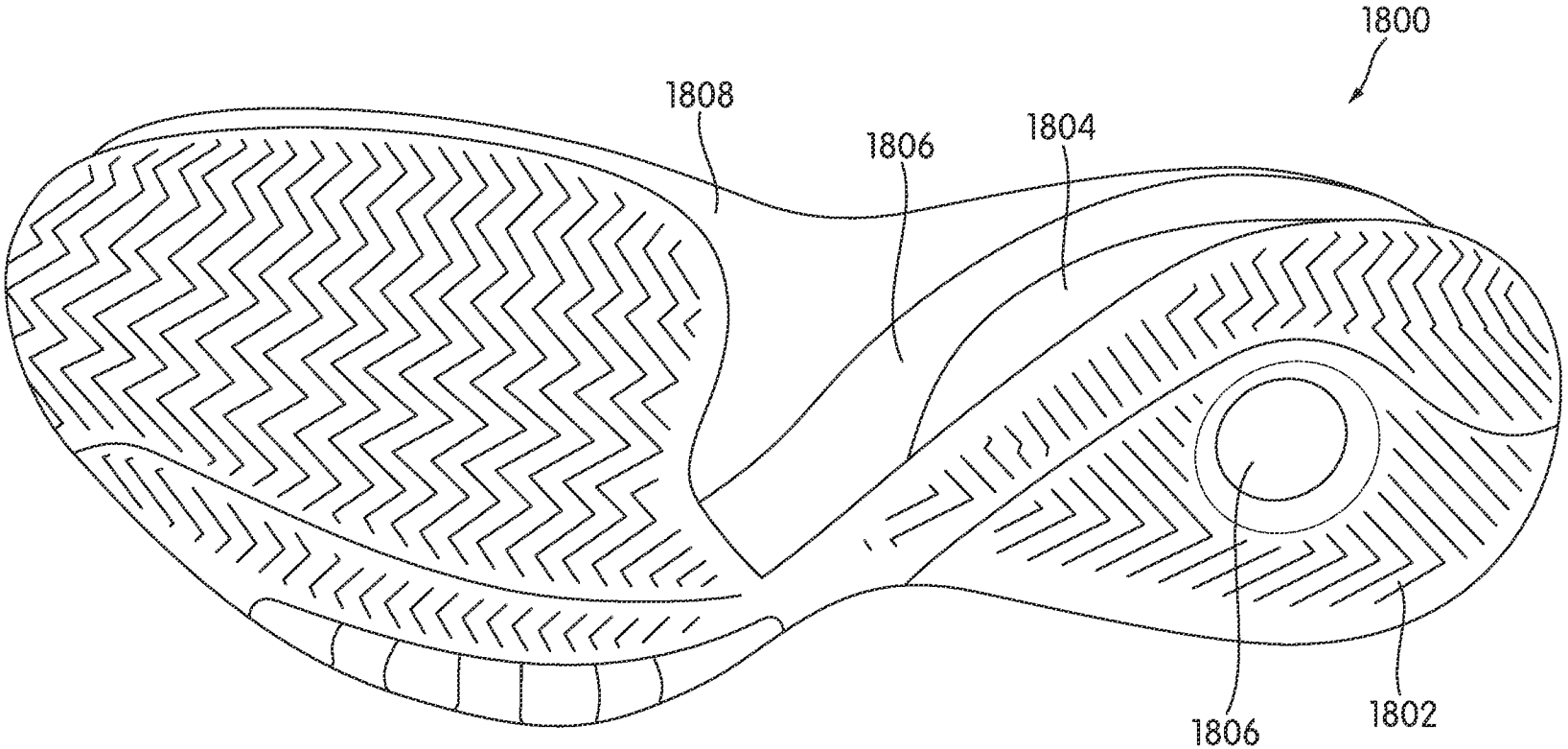

Other types of footwear structures and components also may be used to provide or support relative movement between the rear foot and forefoot areas of a wearer's foot during a direction change or hard cut maneuver. FIGS. 18A through 18C illustrate a sole structure 1800 in accordance with at least some examples of this aspect of the invention (FIG. 18A provides a medial side view, FIG. 18B provides a lateral side view, and FIG. 18C provides a bottom view). As shown in these figures, this example sole structure 1800 includes four main components, namely: (a) an outsole component 1802 (extending the entire longitudinal length of the sole structure 1800 in this illustrated example), (b) a lower foam component 1804 (generally in the heel area in this illustrated example), (c) a rigid plate component 1806 (generally in the heel area and midfoot areas in this illustrated example), and (d) a midsole component 1808 (extending the entire longitudinal length of the sole structure 1800 in this illustrated example). The sole structure 1800 may be incorporated into an article of footwear in any desired manner without departing from this invention, including in conventional manners as are known and used in the art, such as by adhesives or cements, by sewing or stitching, by mechanical connectors, etc. The various individual components of this example sole structure 1800 will be described in more detail below (and also in conjunction with FIGS. 18D through 18M).

Figure 18D:
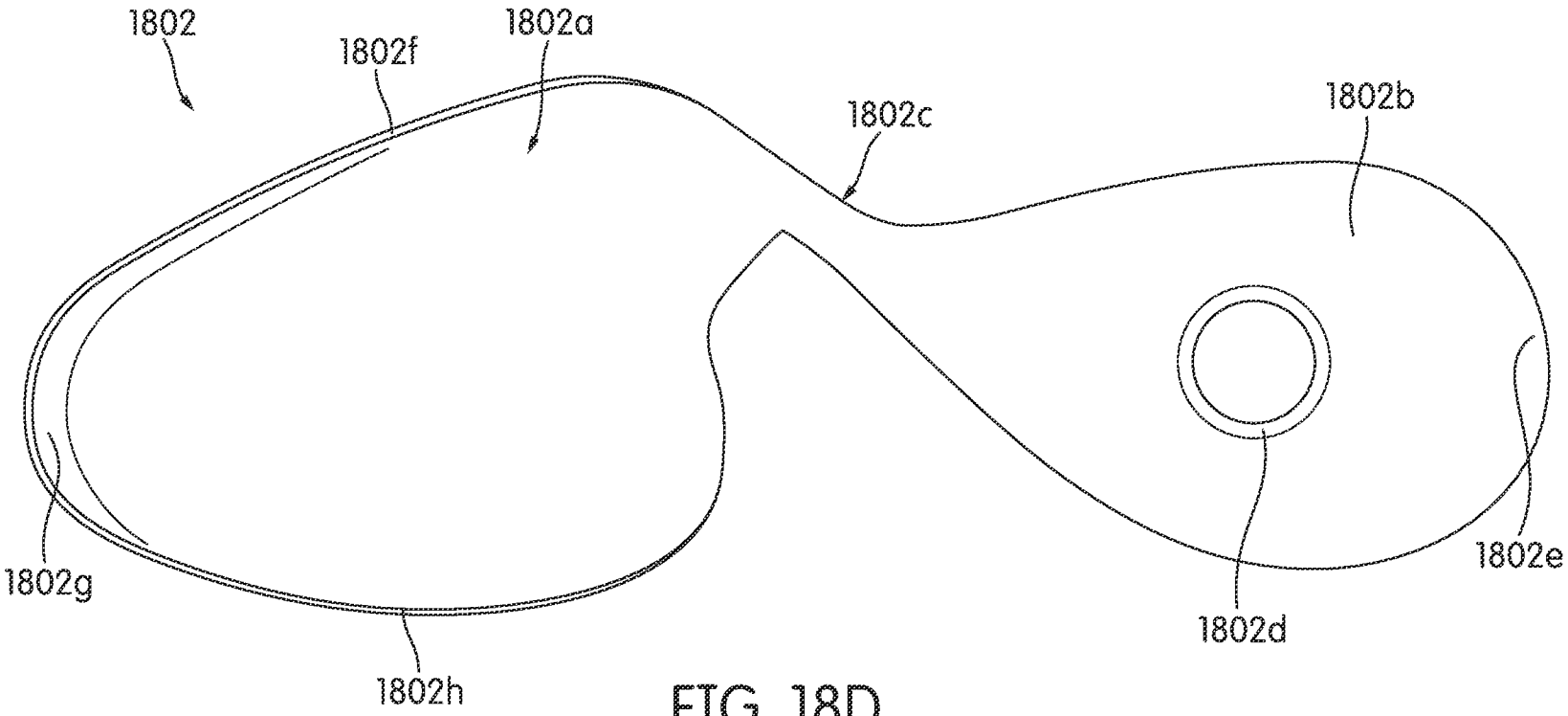
Figure 18F:
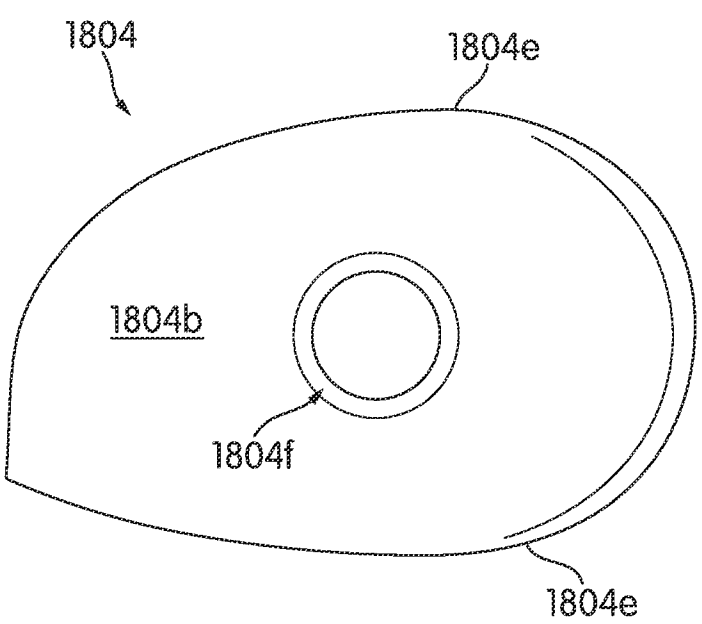

FIG. 18D shows a top view of the outsole component 1802 (the bottom of which is shown in FIG. 18C). As shown in this figure, the outsole component 1802 of this example extends the entire longitudinal length of the sole providing at least a majority of the bottom surface of the sole (and, as can be seen from FIG. 18C, covers at least a majority of the lower rearfoot surface of the lower foam component 1804). This example outsole component 1802 includes a forefoot outsole portion 1802*a*, a rearfoot outsole portion 1802*b*, and a connecting portion 1802*c* connecting the rearfoot outsole portion 1802*b* and the forefoot outsole portion 1802*a*.

As shown in FIG. 18D, the connecting portion 1802*c* is located at the lateral side of the outsole component 1802, and while it may have any desired size or dimensions, in at least examples of this invention, the connecting portion 1802*c* will have a transverse width W of less than 20 mm, and in some examples, less than 18 mm, less than 15 mm, or even less than 12 mm. The narrowness of the connecting portion 1802*c* and its location at the lateral side of the outsole component 1802 help provide adequate flexibility in the overall outsole component 1802 and allow the rearfoot outsole portion 1802*b* to move or rotate with respect to forefoot outsole portion 1802*a*. Alternatively, if desired, the connecting portion 1802*c* can be omitted and the overall outsole component may simply be made from separate forefoot outsole member and rearfoot outsole member parts (and, optionally, each of the separate forefoot outsole member and rearfoot outsole member parts may itself be made from one or more separate parts).

FIG. 18D further shows that the outsole component 1802 includes an opening 1802*d* defined generally in the center of the rearfoot outsole portion 1802*b*. While not necessary at least in all example structures according to this aspect of the invention, the opening 1802*d* can help provide some additional degree of flexibility in the outsole component 1802 (and the overall sole structure 1800), e.g., allow the medial side of the rearfoot outsole portion 1802*b* to bend downward somewhat with respect to the lateral side of the rearfoot outsole portion 1802*b* (e.g., rotate or bend along a generally longitudinal axis) during a hard direction change or cutting action.

FIGS. 18A and 18D further illustrates that the rearfoot outsole portion 1802*b* of this illustrated example structure 1802 has an upwardly curved perimeter edge providing a raised sidewall 1802*e*, at least in the rearmost heel area. This perimeter sidewall 1802*e* may have a greater or lesser perimeter extent around the medial and/or lateral sides and a greater or lesser height, if desired. The sidewall 1802*e* assists in holding the various parts together, e.g., during assembly, and helps maintain stability and the stacked construction of parts during manufacture and use of the shoe.

Additionally, the forefoot outsole portion 1802*a* of this example structure 1802 includes a raised perimeter support 1802*f* at the lateral midfoot to forefoot area (e.g., to enclose the area beneath and alongside the little toe). This raised lateral wall or support 1802*f* (which may be taller or shorter and/or may extend further or less in either perimeter direction) provides additional support and stability to the overall sole structure 1800, particularly during a cutting or hard turn maneuver. Additionally or alternatively, if desired, the perimeter of forefoot outsole portion 1802*a* may include additional raised side walls, such as front wall 1802*g* and medial side wall 1802*h*. These additional side walls 1802*g* and 1802*h*, when present, also may help provide stability (e.g., maintain the foot on top of the sole structure and maintain the parts in the proper stacked construction, etc.), improve construction (e.g., by providing more surface area for bonding, by helping maintain the stacked configuration, etc.), etc.

While these various side walls 1802*e*, 1802*g*, and 1802*h* and the raised lateral support 1802*f* may have any desired perimeter extent and/or height without departing from this invention, in at least some examples of this invention the lateral support 1802*f* will have the tallest height of these side walls, having an absolute height in some structures 1802 of at least 10 mm, and in some examples at least 15 mm, at least 20 mm, or even at least 25 mm. The height of this lateral support 1802*f* (at its tallest point, from the bottom surface of the outsole up) may be at least twice as tall as the height of the raised side wall 1802*h* (at its tallest point, from the bottom surface of the outsole up) at the opposite side of the sole.

Figure 18E:
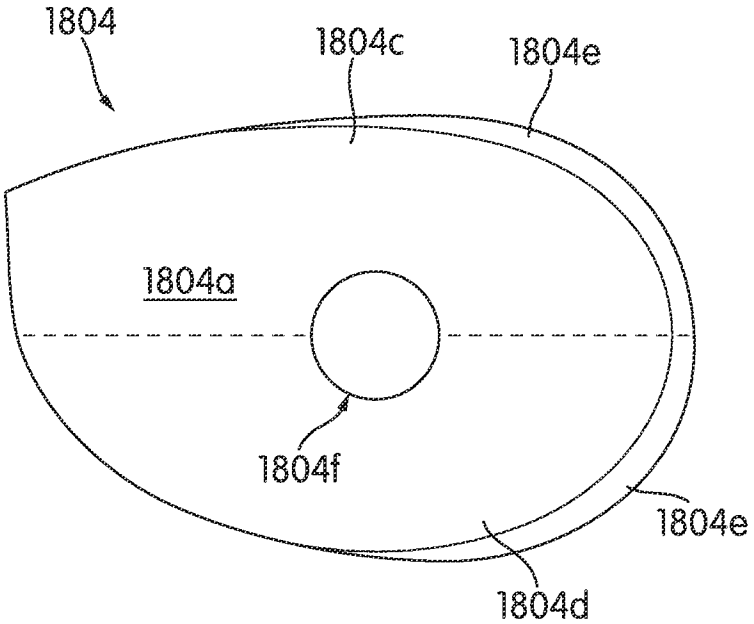

The next component in this example sole structure (working one's way up from the bottom to the top) is the lower foam component 1804, as shown in FIGS. 18E (top view) and 18F (bottom view). This example lower foam component 1804 includes a curved upper surface 1804*a* at least in the rearfoot area for receiving and supporting the lower rearfoot surface of the plate 1806 (as will be described in more detail below). This example lower foam component 1804 further includes a bottom surface 18041*b* that is substantially flatter than the curved upper 1804*a* at least in the rearfoot area, and in some examples, the bottom surface 1804*b* (at least the central 80% of the surface area) is flat or substantially flat. The differences in surface flatness between surface 1804*a* and 1804*b* helps provide a comfortable support and a more stable feel when standing or running straight (as compared to standing or running straight on a more curved heel surface like the exterior surfaces of the components in this example sole structure 1800 above the lower foam component 1804).

The lower foam component 1804 may be made from any desired foam material without departing from this invention, including polyurethane foams, ethyl vinyl acetate foams, phylon, phylite, etc. Also, the foam component 1804 may be made from two or more component parts without departing from this invention. For example, as shown by the broken line in FIG. 18E, if desired, the lateral side 1804*c* of the lower foam component 1804 may be made as one component and the medial side 1804*d* of the lower foam component 1804 may be made as a different component. When multiple components are present, they may be fixed together, if desired, in any manner, such as through the use of adhesives or cements, mechanical connectors, fusing techniques, etc. As another option, the multiple components of the lower foam component 1804 may remain unattached to one another and simply may be attached separately to the outsole component 1802 (or other shoe component).

At least the medial side 1804*d* or medial perimeter area of the foam component 1804 (and optionally the entire foam component 1804) may be made of relatively low density foam or soft foam to allow relatively easy compression under an applied force as will be explained in more detail below. As additional potential features, at least the medial side 1804*d* or medial perimeter area of the lower foam component 1804 (and optionally the entire lower foam component 1804) may have a hardness that is at least 5% lower than the hardness of the foam midsole component 1808 (when component 1808 is made at least in part from foam) and/or a density at least 5% lower than the density of the foam midsole component 1808 (when component 1808 is made at least in part from foam). In still other examples, lower foam component 1804 (or at least its medial perimeter or medial side 1804*d*), will have a hardness and/or density at least 10% lower, or even at least 15% lower, than the hardness and/or density of foam midsole component 1808 (when component 1808 is made at least in part from foam).

The curved upper surface 1804*a* and flatter bottom surface 1804*b* produce a somewhat cupped structure wherein the perimeter edges 1804*e* are substantially higher or thicker than the thickness of the lower foam component 1804 at a center portion thereof (e.g., in the area adjacent the opening 1804*f*). As some more specific examples, the height or thickness of the foam component 1804 at the perimeter edge 1804*e* (e.g., $h_f$ shown in FIG. 18A) may be at least 5 times, and in some examples, at least 8 times or even at least 10 times taller or thicker than the thickness of the foam material adjacent opening 1804*f*. As some more absolute numbers, the foam height $h_f$ at the tallest perimeter area 1804*e* may be at least about 10 mm, or even at least about 12 mm, 15 mm, 18 mm, 20 mm or more, while the foam height (or thickness) adjacent the opening 1804*f* (e.g., at its thinnest location) may be at most 5 mm thick, and in some examples, this height may be at most 3 mm or even at most 2 mm thick.

As noted above, this example lower foam component 1804 includes an opening 1804*f* defined generally in the center of the rearfoot support area. While not necessary at least in all example structures according to this invention, the opening 1804*f* can help provide some degree of flexibility in the overall sole structure 1800 (and in the lower foam component 1804), e.g., to allow the medial side 1804*d* of the lower foam component 1804 to bend downward somewhat with respect to the lateral side 1804*c* thereof (e.g., rotate along a generally longitudinal axis) during a hard direction change or cutting action. If desired, the opening 1804*f* in the lower foam component 1804 may align with or at least partially overlap with the opening 1802*d* of the outsole component 1802 (when such an opening is present). Providing aligned openings 1802*d* and 1804*f* exposes the bottom surface of the plate member 1806 from the exterior of the sole structure 1800 (see FIG. 18C) and helps prevent undesired wear or abrasion of the lower foam component 1804 during use.

While the lower component 1804 is discussed above as being made from a foam material, other compressible materials or components may be used without departing from this invention, such as one or more fluid-filled bladders, one or more mechanical impact-force absorbing members (e.g., shock absorber structures), etc.

Figure 18G:
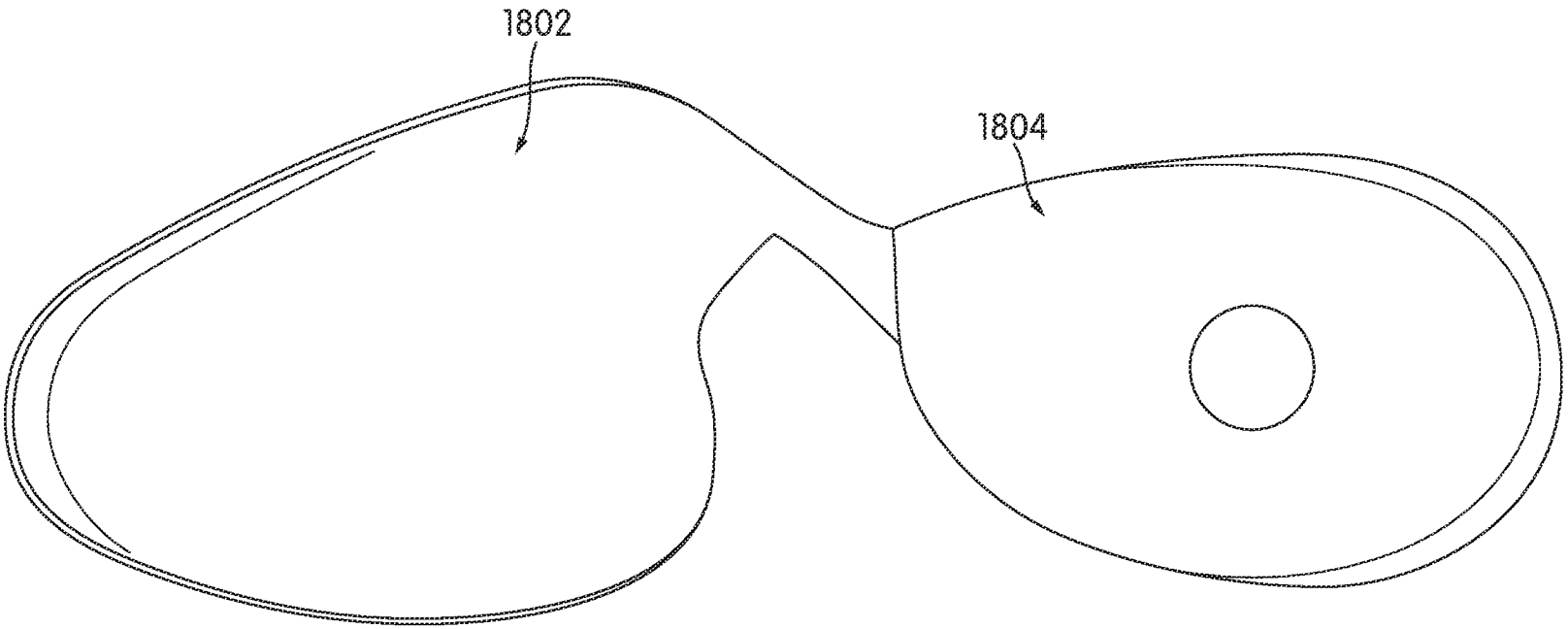

FIG. 18G shows a top view of a portion of the overall sole structure in which the outsole component 1802 is joined with the lower foam component 1804. These parts can be joined in any desired manner without departing from this invention, including through the use of one or more of: cements or adhesives; fusing techniques; mechanical connectors; and/or sewing or stitching. As shown in FIG. 18G, in this example overall sole structure construction, the lower foam component 1804 is located primarily in the rearfoot area of the sole structure, although it may extend further if desired, e.g., into the midfoot area, through the midfoot area, or even into or through the forefoot area, if desired.

Figure 18H:
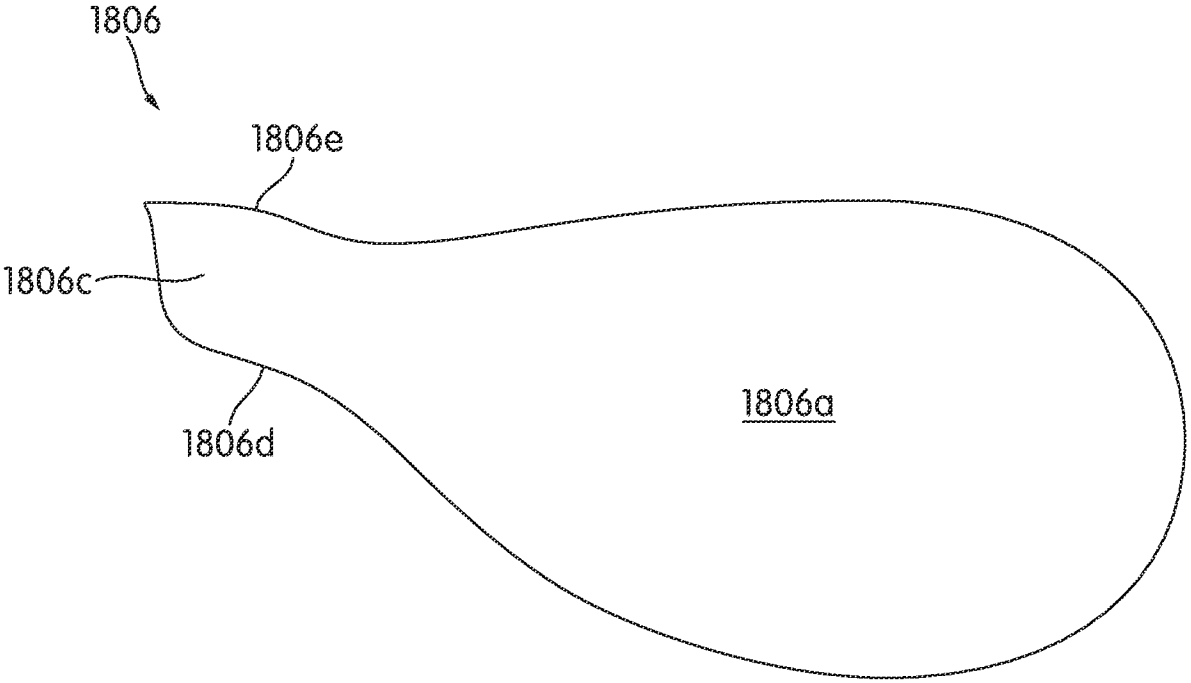
Figure 18I:
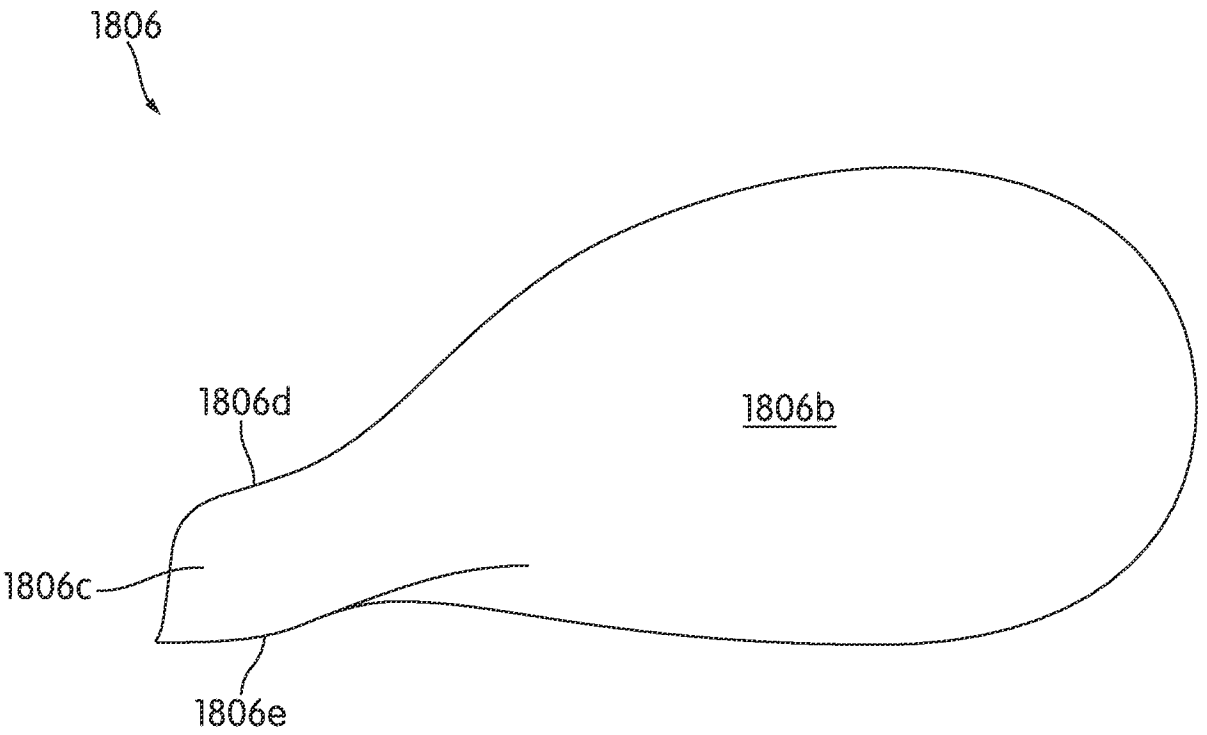

The next component as one moves upward in the overall sole structure 1800 is the plate 1806. One example plate member 1806 is illustrated in FIGS. 18H and 18I. In this illustrated example, the plate 1806 includes an upper surface 1806*a* at least a rearfoot region of the overall sole structure 1800 (for supporting at least the rearfoot region of the foam midsole component 1808, which will be discussed in more detail below). The upper rearfoot surface 1806*a* of the plate 1806 is curved to receive the curved lower surface of the foam midsole component 1808. Additionally, the lower rearfoot surface 1806*b* of the plate 1806 also is curved, and in at least some example constructions, it will be curved in a substantially parallel manner to the upper rearfoot surface 1806*a* of the plate 1806. In this manner, the plate 1806 may have a substantially uniform thickness, although some thicker or thinner areas may be provided in at least some plate components without departing from this invention. For example, as shown in FIG. 18I, the bottom surface 1806*b* may include some ridges, recessed areas, raised areas, or the like, e.g., to better stack, combine, and/or join with other components in the sole structure 1800. This example plate 1806 construction further includes a free end 1806*c* opposite the rear heel end that tapers and narrows down from a widest overall transverse width (in the medial side-to-lateral side direction) in the central rearfoot area.

The plate member 1806 may be made from any desired materials without departing from this invention. As some examples, the plate 1806 may be made from a thin, rigid, lightweight material, such as plastic materials (e.g., PEBAX, etc.), carbon fiber reinforced polymer materials, fiberglass materials, aluminum or aluminum alloy materials, titanium or titanium alloy materials, or the like. While any appropriate thickness plate 1806 may be used without departing from this invention, in some example constructions, the plate 1806 will have a maximum and/or average thickness of less than 4 mm, and in some examples less than 3 mm or even less than 2 mm. The plate 1806 may be rigid, yet flexible, particularly under force from a step or direction change action.

Figure 18J:
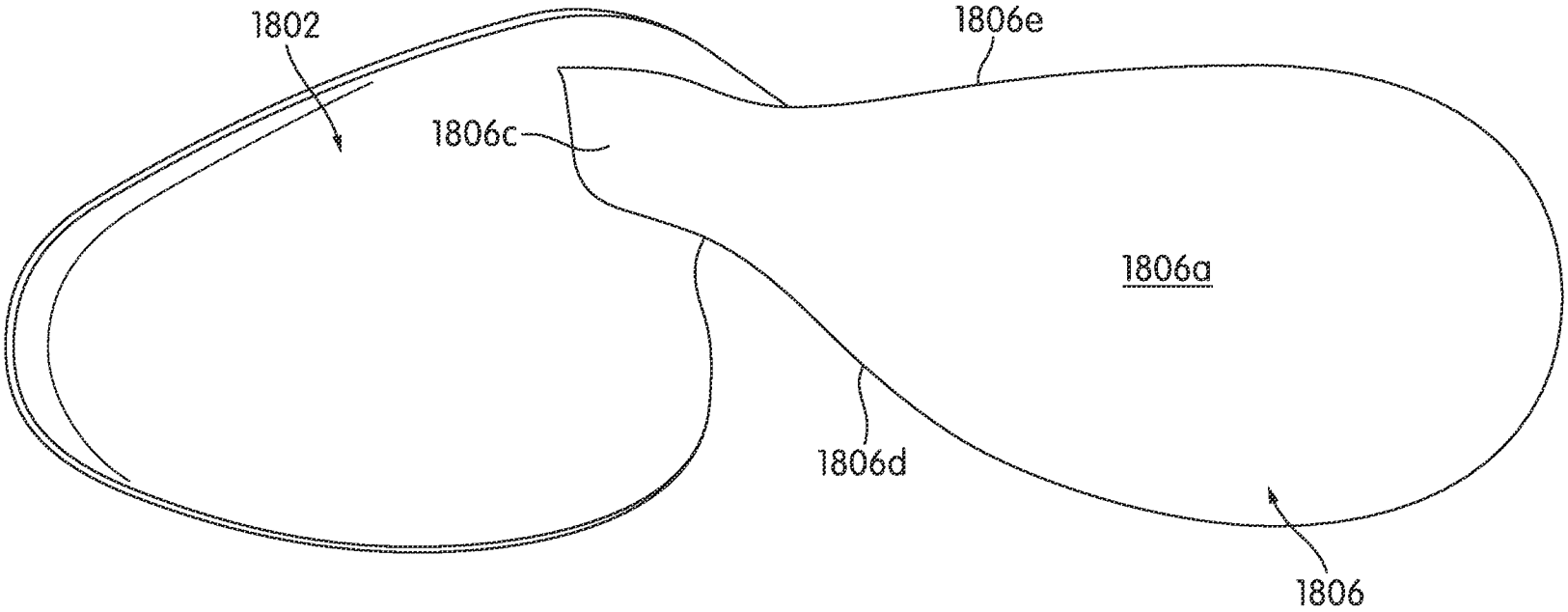
Figure 18K:
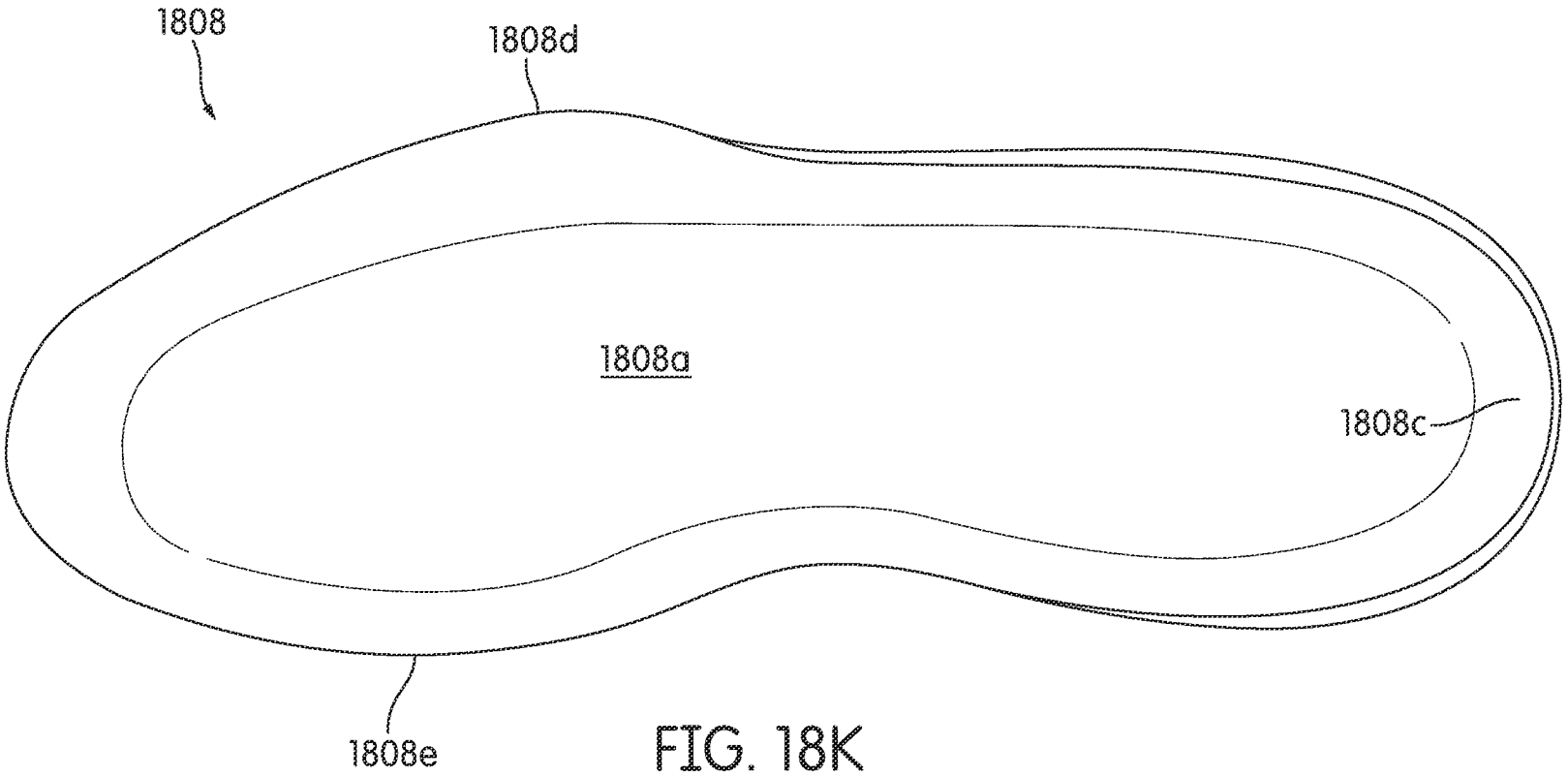

FIG. 18J shows the construction of a portion of the sole structure (top view) including the outsole component 1802 and the plate 1806. Although not a requirement, in this illustrated example, the plate 1806 completely covers the upper surface of the lower foam component 1804 in this top down view (e.g., the plate 1608 extends over the lower foam component 1804 and beyond the lower foam component 1804 in a direction toward the forefoot region of the sole structure). The sides of the lower foam component 1804, however, may remain visible (e.g., see FIGS. 18A and 18B). The plate member 1806 may be joined to the remainder of the sole structure in any desired manner without departing from this invention, including via cements or adhesives, via mechanical connectors, etc.

Also, in this example structure, the free end 1806*c* of the plate 1806 extends predominantly toward the lateral side of the overall sole structure and terminates generally at a forefoot region of the sole structure. This is not a requirement. Rather, if desired, in at least some constructions according to this invention, the plate member 1806 may terminate within the midfoot region, before the midfoot region, or within the forefoot region of the sole structure. As yet another example, if desired, the plate member 1806 may extend substantially an entire longitudinal length of the sole structure.

As also shown in FIG. 18J, this example plate 1806 extends along a lateral side of the overall sole structure for a greater distance than it extends along a medial side of the sole structure. In other words, as shown in the figure, the medial edge 1806*d* of the plate 1806 curves dramatically inward toward the lateral edge 1806*e*, while the lateral edge 1806*e* is much straighter and much more aligned with the overall lateral edge of the sole structure.

The next element as one moves upward in this overall example sole structure 1800 is a midsole component 1808. One example of this component is illustrated in more detail in FIGS. 18K and 18L. While the midsole component 1808 may be made from any desired material, combination of materials, and/or component parts without departing from this invention, in this illustrated example, the midsole component 1808 is primarily and predominantly formed from a foam material, such as polyurethane foam, ethyl vinyl acetate foam, phylon, phylite, etc. As additional options or alternatives, if desired, the midsole component 1808 may include one or more fluid-filled bladders housed or encased therein and/or one or more mechanical type impact force attenuating elements (e.g., foam support pillars, springs, etc.).

In this illustrated example, the foam-containing midsole component 1808 includes an upper major surface 1808*a* for supporting a plantar surface of a foot (directly or indirectly). The rearfoot portion of upper surface 1808*a* may be curved in a manner so as to generally conform to a heel of a user, e.g., as is conventionally known in the art. The midsole component 1808 further includes a lower major surface 1808*b*, wherein a rearfoot area of this lower major surface 1808*b* also is curved. The side wall 1808*c* around the rear perimeter heel area of the midsole component 1808 may be somewhat thinner than a thickness of the midsole component 1808 through the bottom heel surface. The relatively thick bottom heel area of midsole component 1808 provides added impact force attenuation and comfort features directly beneath the wearer's heel.

The curved lower major surface 1808*b* at the rearfoot area of the midsole component 1808 is shaped to fit within and be supported by the curved upper surface 1806*a* of the plate member 1806. The perimeter edges of the midsole component 1808 in this illustrated example curve upward to create raised sidewalls at least at some portions of the midsole component 1808 to help better hold the wearer's foot on the sole structure 1800. Specifically, at least the perimeter edges around the rear heel area form the raised side wall 1808*c* that helps maintain the wearer's foot in the proper position at the heel area. Raised side walls also may be provided at other areas, such as at the lateral forefoot and midfoot areas (particularly side wall 1808*d* at the little toe area and side wall 1808*e* at the medial forefoot area). Likewise, these side walls 1808*d* and 1808*e* help maintain proper foot position on the plantar surface 1808*a* of the midsole component 1808.

Figure 18L:
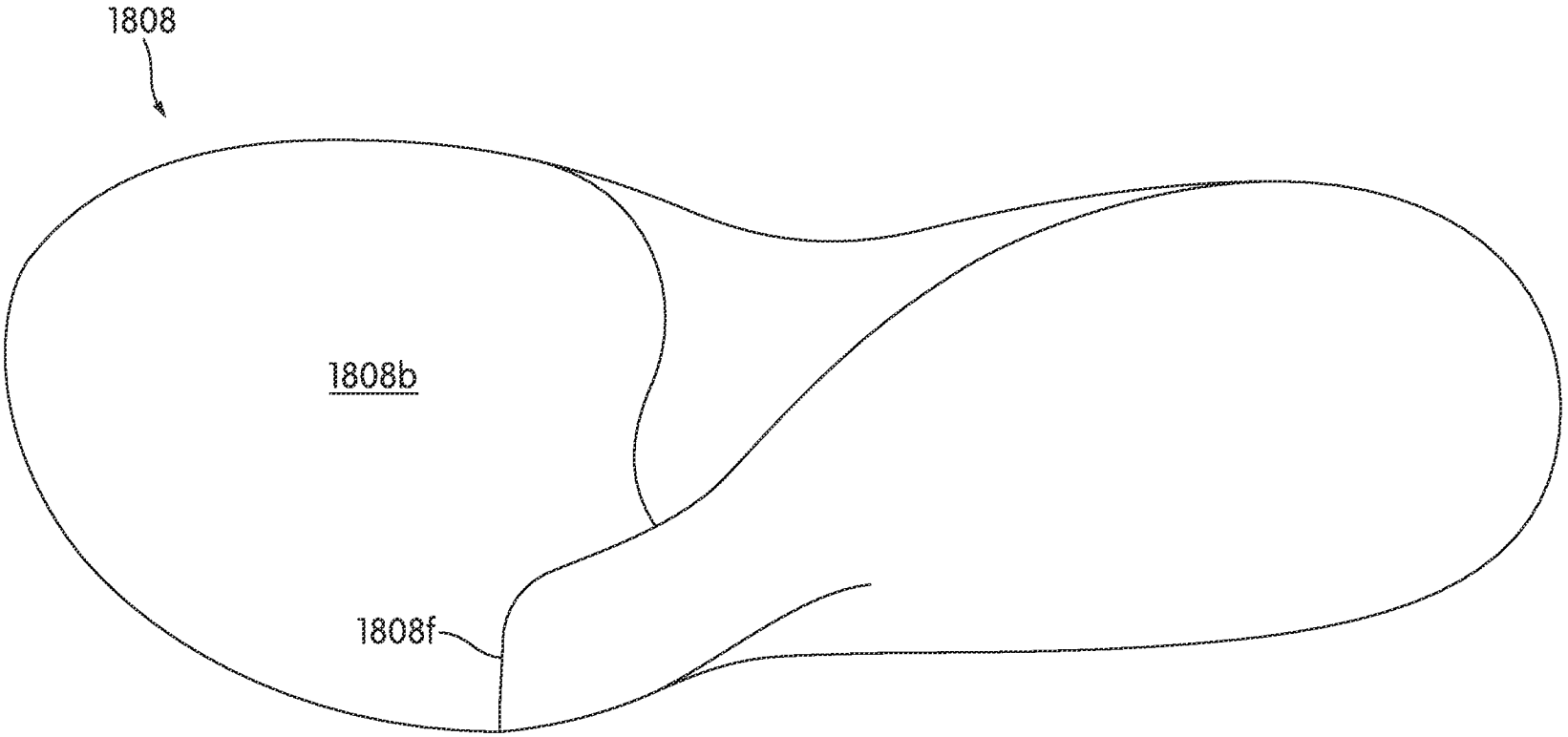

FIG. 18L further shows that the bottom surface 1808*b* of the midsole component 1808 may include recessed areas, raised areas, or other structures to better fit with and join to other component parts of the sole structure. As a more specific example, FIG. 18L shows that the bottom surface 1808*b* has recessed area 1808*f* for engaging the top surface 1806*a* of the plate 1806 and making a substantially flush joint between the plate 1806 and the midsole component 1808. Other features may be provided to enable a smooth junction between the various parts of the sole structure.

Figure 18M:
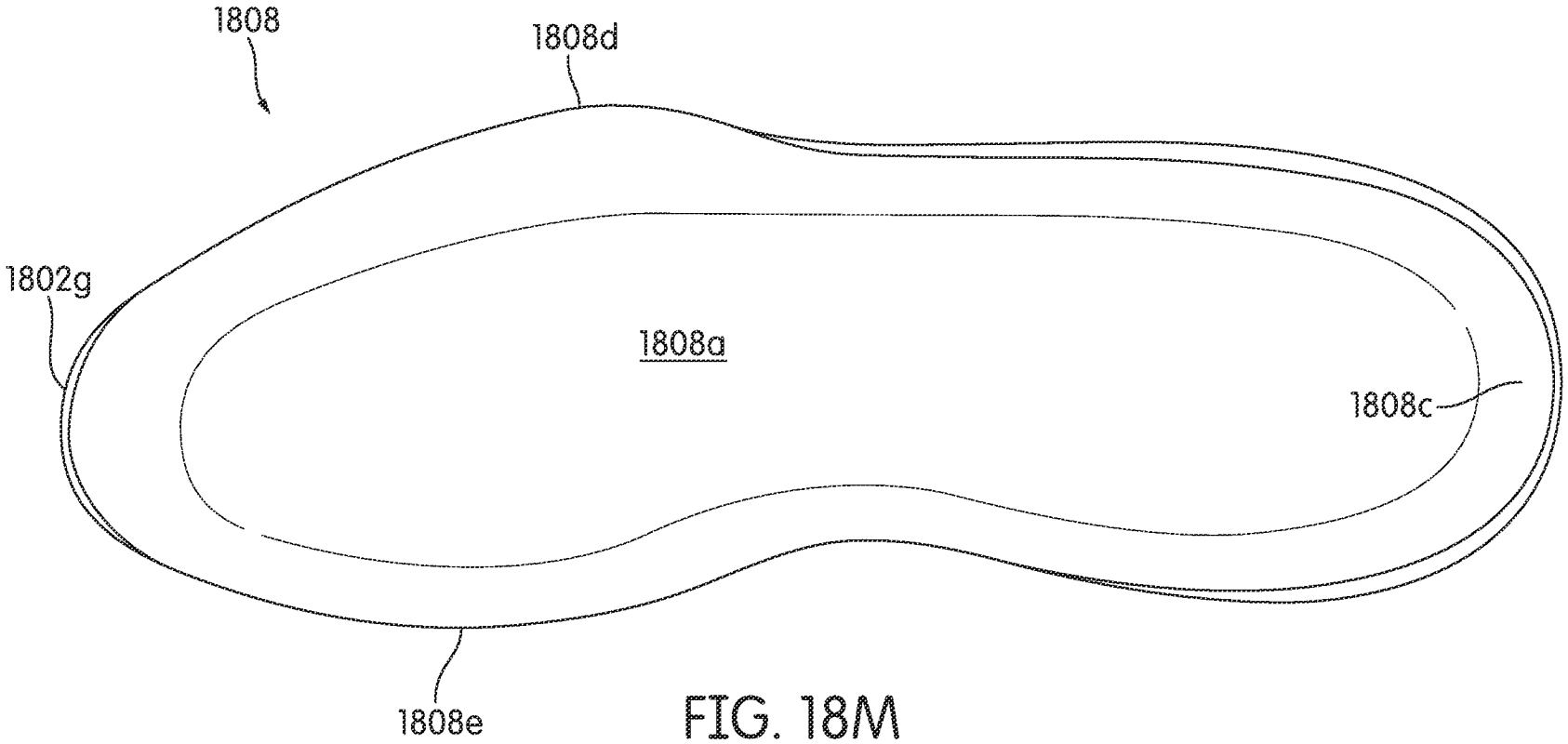

Returning to FIGS. 18A through 18C and looking at FIG. 18M provides views of the assembled sole structure 1800 with the midsole component 1808 in place atop the plate member 1806. The midsole component 1808 may be engaged with the other elements of the sole structure 1800 in any desired manner without departing from this invention, including in conventional manners as are known and used in the art (e.g., cements or adhesives, mechanical connectors, fusing techniques, sewing or stitching, etc.).

Notably, in this example structure 1800, the midsole component 1808 forms all or substantially all of the upper surface of the overall sole structure 1800 for engaging the upper and supporting the plantar surface of the wearer's foot. Note FIG. 18M. As can be seen from the various figures, the rearfoot area of this example sole structure 1800 includes four stacked or nested components, namely: the outsole component 1802, the lower foam component 1804, the plate 1806, and the midsole component 1808. This example outsole component 1802 extends substantially the entire length of the sole structure 1800 (with the optional, relatively narrow connection member 1802*c*); the lower foam component 1804 is contained fully or primarily within the rearfoot area of the sole structure 1800; the plate member 1806 substantially covers the rearfoot area and extends at least into the midfoot area and optionally into the forefoot area of the sole structure; and the midsole component 1808 provides all or substantially all of the entire foot-supporting surface (and it extends beyond a forward-most location of the plate 1806). Accordingly, the bottom surface 1808*b* of the midsole component 1808 directly contacts (or engages) the upper surface 1806*a* of the plate 1806 at the rearfoot area of the sole structure 1800 and directly contacts (or engages) the upper surface 1802*a* of the outsole component 1802 at the forefoot region of the sole structure 1800.

In sole structures 1800 according to at least some examples of this invention, the lower foam component 1804 (or at least an outer perimeter portion of a medial side 1804*d* of the lower foam component 1804) may be made from a softer, less dense, or otherwise more compressible foam material than the foam material contained in midsole component 1808 (if any). In other examples, the lower foam component 1804 (or at least an outer perimeter portion of a medial side 1804*d* of the lower foam component 1804) may be made from a softer, less dense, or otherwise more compressible foam material than the foam material making up a majority of the volume of the midsole component 1808 (and particularly softer, less dense, or otherwise more compressible than the foam material(s) in the rearfoot area of the midsole component 1808). As another example feature in accordance with at least some examples of this invention, the lower foam component 1804 (or at least a medial side 1804*d* thereof) will be made from a softer, less dense, or more compressible material than any foam material of the midsole component 1808, and the midsole component 1808 will be made from a softer material than the plate 1806.

While not a requirement (and while not shown), if desired, sole structures 1800 of the types described above in conjunction with FIGS. 18A through 18M may be used in combination with a heel securing strap component, e.g., of the types illustrated in FIGS. 2A through 2C and 4. For example, if desired, the heel securing strap component 211 may extend at least partially around and optionally attach to a lower surface of the midsole component 1808 or the plate member 1806 (in the heel area of either of these components). As another alternative, if desired, the heel securing strap component may extend around a portion of the sole structure or upper structure that lies above (and optionally rests on) the heel support area of midsole component 1808. Any desired location and connection of a heel securing strap component 211 to a shoe including the sole structure 1800 may be used without departing from this invention.

Figure 19A:
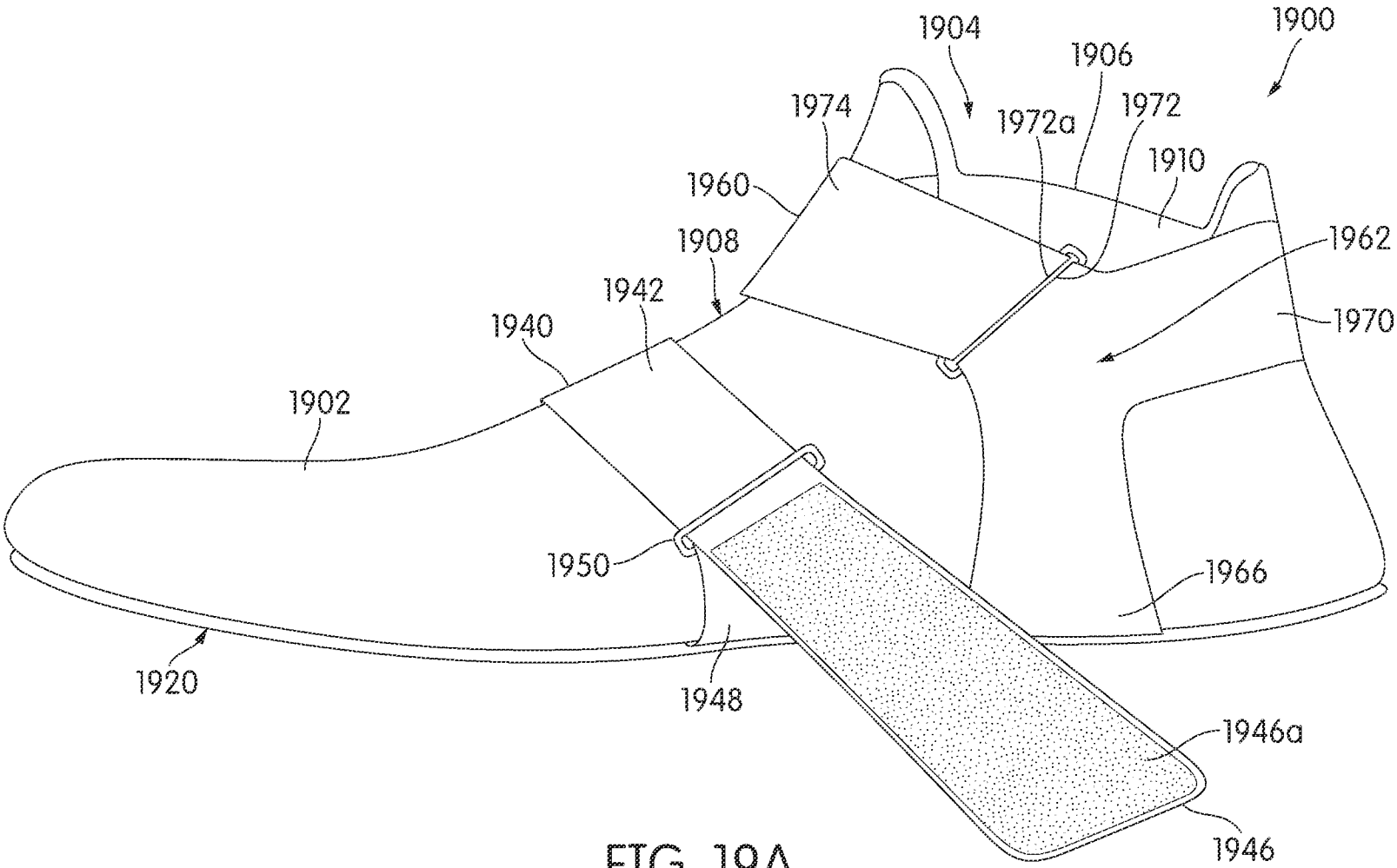
FIGS. 19A through 19D illustrate various views of an upper bootie and strap assembly that may be used with the sole structure of FIGS. 18A through 18M (or other sole structures described above) in accordance with at least some embodiments.
Figure 19B:
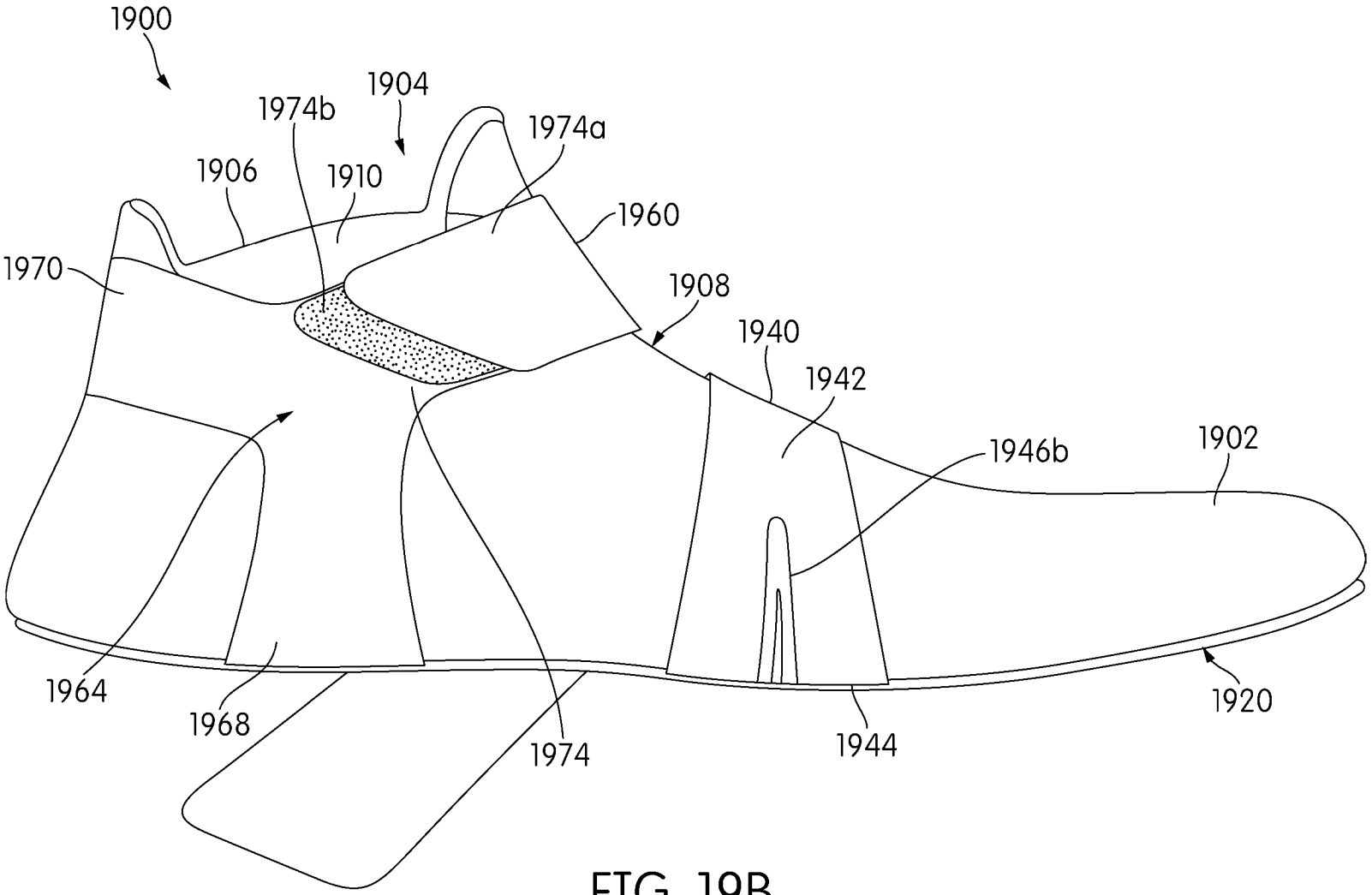
Figure 19C:
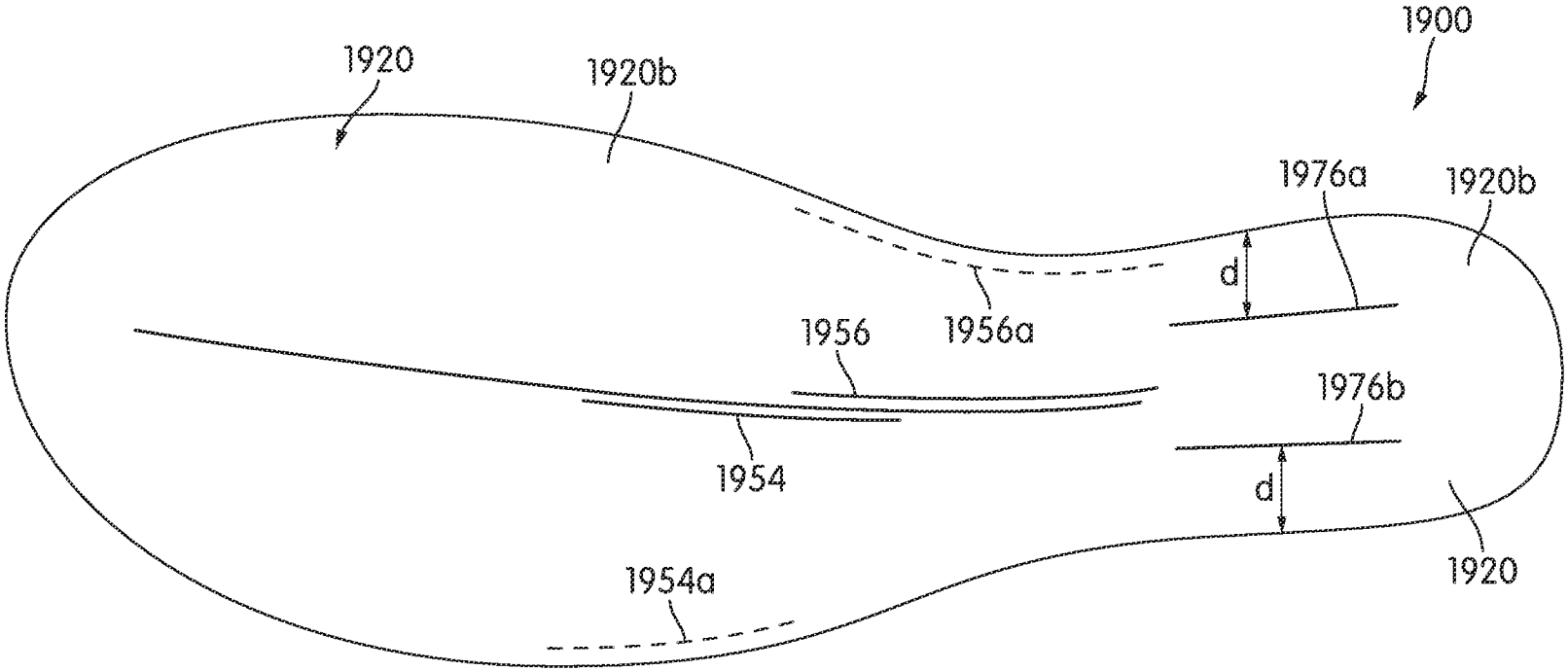

FIGS. 19A through 19C illustrate a medial side view, a lateral side view, and a bottom view, respectively, of a bootie and strap assembly 1900 that may be included in articles of footwear in accordance with at least some examples of this invention. This example assembly 1900 includes a bootie portion 1902, two strap securing systems 1940 and 1960 engaged with the bootie portion 1902, and a strobel member 1920 engaged with the bootie portion 1902. These various parts will be described in more detail below.

The bootie portion 1902 of this example assembly 1900 is made from one or more pieces of textile material. While any type of textile material may be used without departing from this invention, in this illustrated example, the bootie portion 1902 includes multiple layers of fabric sandwiching a spacer mesh material to provide excellent breathability. The textile and the strobel member 1920 define an enclosed interior chamber 1904 for receiving a user's foot (through ankle opening 1906). Rather than conventional laces, lace engaging structures, and a tongue member, the instep or vamp area 1908 of this example bootie portion 1902 is enclosed. To allow for easy insertion of a wearer's foot, each side of the ankle opening 1906 in this example structure includes a stretchable or elastic portion 1910. Additionally or alternatively, however, a more conventional lacing system and structure could be provided without departing from this invention.

The forefoot portion of this example bootie and strap assembly 1900 includes a first strap securing system 1940. This strap securing system 1940 includes a first strap member 1942 that extends from the lateral forefoot area (e.g., at a location near or surrounding the wearer's little toe) somewhat diagonally across the instep or vamp area 1908 to the medial midfoot area. The lateral forefoot end 1944 of the first strap member 1942 may be engaged between the bootie portion 1902 and the strobel 1920 (e.g., at the extreme lateral edge of the bootie, somewhat underneath the foot support surface, generally at the center line of the bootie (see seam 1954 in FIG. 19C) or at any desired location). The second end 1946 of the first strap member 1942 is a free end (and may include a securing structure, such as a portion of a hook-and-loop fastener 1946*a*, a portion of a buckle assembly, etc.). One end of the second strap member 1948 of the first strap securing system 1940 is secured at the medial midfoot area of the shoe (e.g., one end may be secured at the extreme medial edge of the bootie, somewhat underneath the foot surface, generally at the center line of the bootie (see seam 1956 in FIG. 19C) or at any desired location), and the other end of the second strap member includes a tensioning element 1950. As is conventional, the free end 1946 of the first strap member 1942 feeds through and folds around the tensioning element 1950 so that the hook-and-loop fastener portion 1946*a* (or other securing structure) of the free end 1946 can engage a complementary securing structure (e.g., another portion of the hook-and-loop fastener, a buckle assembly, etc.) provided on the bootie or some other portion of the shoe structure (as will be described in more detail below).

Any size or dimension straps may be provided for the first strap securing system 1940 without departing from this invention. If necessary or desired, as shown in FIGS. 19A and 19B, the ends of one or both of strap members 1942 and 1948 may be cut or split (and optionally the slit or cut may be covered with an elastic material 1946*b*) to allow more natural freedom of movement in the forefoot area. Also, while this illustrated example shows the ends of strap members 1942 and 1948 secured generally at the center line of the bootie (see seams 1954 and 1956 of FIG. 19C), additionally or alternatively, they may be attached more at the side edges of the bootie (closer to where the bootie portion 1902 and strobel 1920 meet). This arrangement can put somewhat less pressure and force on the sides of the foot when the strap securing system 1940 is fully tightened and fully secured.

The rearfoot area of this example bootie and strap assembly 1900 includes a second strap securing system 1960, which may constitute a strap assembly of the types described above in conjunction with FIGS. 2A-4. In this illustrated example, the heel strap securing system 1960 includes: a medial side junction area 1962, a lateral side junction area 1964, a lower medial strap component 1966 that extends from the medial side junction area 1962 and beneath the footbed, a lower lateral strap component 1968 that extends from the lateral side junction area 1964 and beneath the footbed, a rear heel strap component 1970 that extends from the medial side junction area 1962 to the lateral side junction area 1964 to engage around a rear heel portion of a wearer's foot, an upper medial strap component 1972 that extends from the medial side junction area 1962 toward a medial instep area of the bootie, and an upper lateral strap component 1974 that extends from the lateral side junction area 1964 toward a lateral instep area of the bootie.

The upper medial strap component 1972 and the upper lateral strap component 1974 further may include structures for securing the strap around the wearer's foot. While any desired type of securing structure(s) may be provided without departing from this invention, in the illustrated example, the free end of the upper lateral strap component 1974 includes a portion 1974*a* of a hook-and-loop fastener and the free end of the upper medial strap component 1972 includes a tensioning element 1972*a*. As is conventional, the free end of the upper lateral strap component 1974 feeds through and folds around the tensioning element 1972*a* so that the hook-and-loop fastener portion 1974*a* of the free end of the upper lateral strap component 1974 can engage another portion 1974*b* of the hook-and-loop fastener (in this illustrated example, provided on the surface of the upper lateral strap component 1974). Other fastener arrangements and/or structures may be used without departing from this invention, including, for example, buckles, clamps, or other mechanical connectors.

Figure 19D:
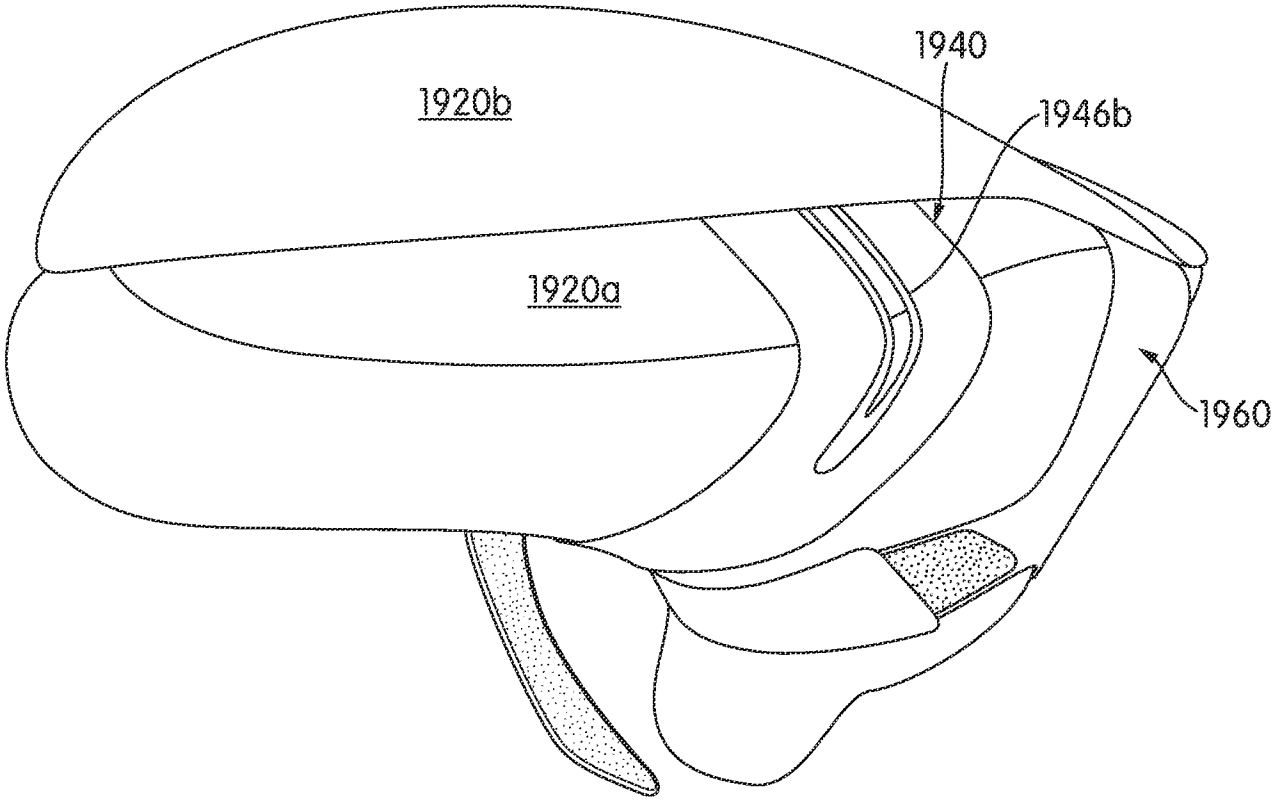

FIGS. 19C and 19D show the bottom of this example bootie and strap assembly 1900. As shown, the bottom surface of the bootie and strap assembly 1900 includes a first strobel layer 1920*a* closing off and partially defining the foot-receiving chamber 1904 and a second strobel layer 1920*b*. The strobel layer(s) 1920*a* and/or 1920*b* may be engaged with the material of the upper 1902 in any desired manner, including in conventional manners as are known and used in the art, including via sewing or stitching as shown.

Portions of the strap member 1940 extend between the strobel layers 1920*a* and 1920*b* and are engaged with the strobel layers 1920*a* and 1920*b* by sewn seams 1954 and 1956, as mentioned above. While FIG. 19C shows these seams 1954 and 1956 substantially along the centerline of the strobel member 1920, if desired, the seams may be moved closer to the longitudinal edges of the strobel member, as shown by broken lines 1954*a* and 1956*a*. The seams 1976*a* and 1976*b* for holding the free ends of strap member 1960 are located underneath the footbed so as to partially wrap around the underside of the wearer's heel. Preferably the distance d between the seams 1976*a* and 1976*b* (i.e., where the seams 1976*a* and 1976*b* are engaging and holding the strap member 1960) and the side edge of the strobel member 1920 will be at least 6 mm, and in some examples, at least 8 mm or even at least 10 mm. In other words, preferably the free ends of strap member 1960 extend underneath the footbed and are secured underneath the footbed a distance of at least 6 mm (and in some examples, at least 8 mm or even at least 10 mm).

If desired, the free ends of the strap member 1960 beneath the footbed may meet together such that a single seam can hold both straps to the strobel member 1920. As yet another example, if desired, the lower medial strap component 1966 that extends from the medial side junction area 1962 and beneath the footbed may be formed as a single piece with the lower lateral strap component 1968 that extends from the lateral side junction area 1964 and beneath the footbed. In such a construction, it may be possible that no seam would be needed to engage the strap member 1960 to the strobel member 1920 (although a seam and engagement of these parts may be provided, if desired).

Figure 20A:
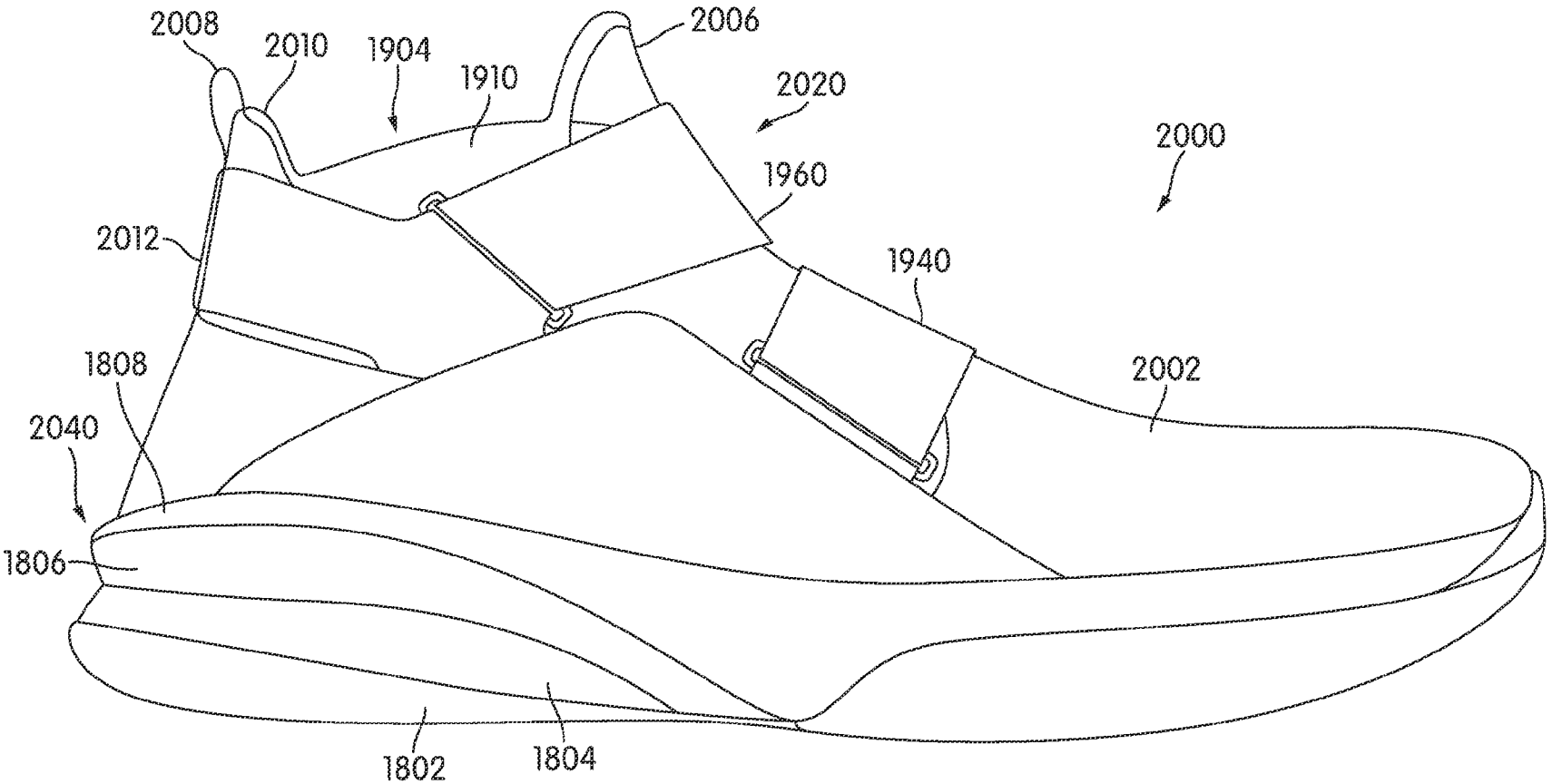
FIGS. 20A through 20C show various views of an example upper incorporating the bootie and strap construction of FIGS. 19A through 19D and the sole structure of FIGS. 18A through 18M.
Figure 20B:
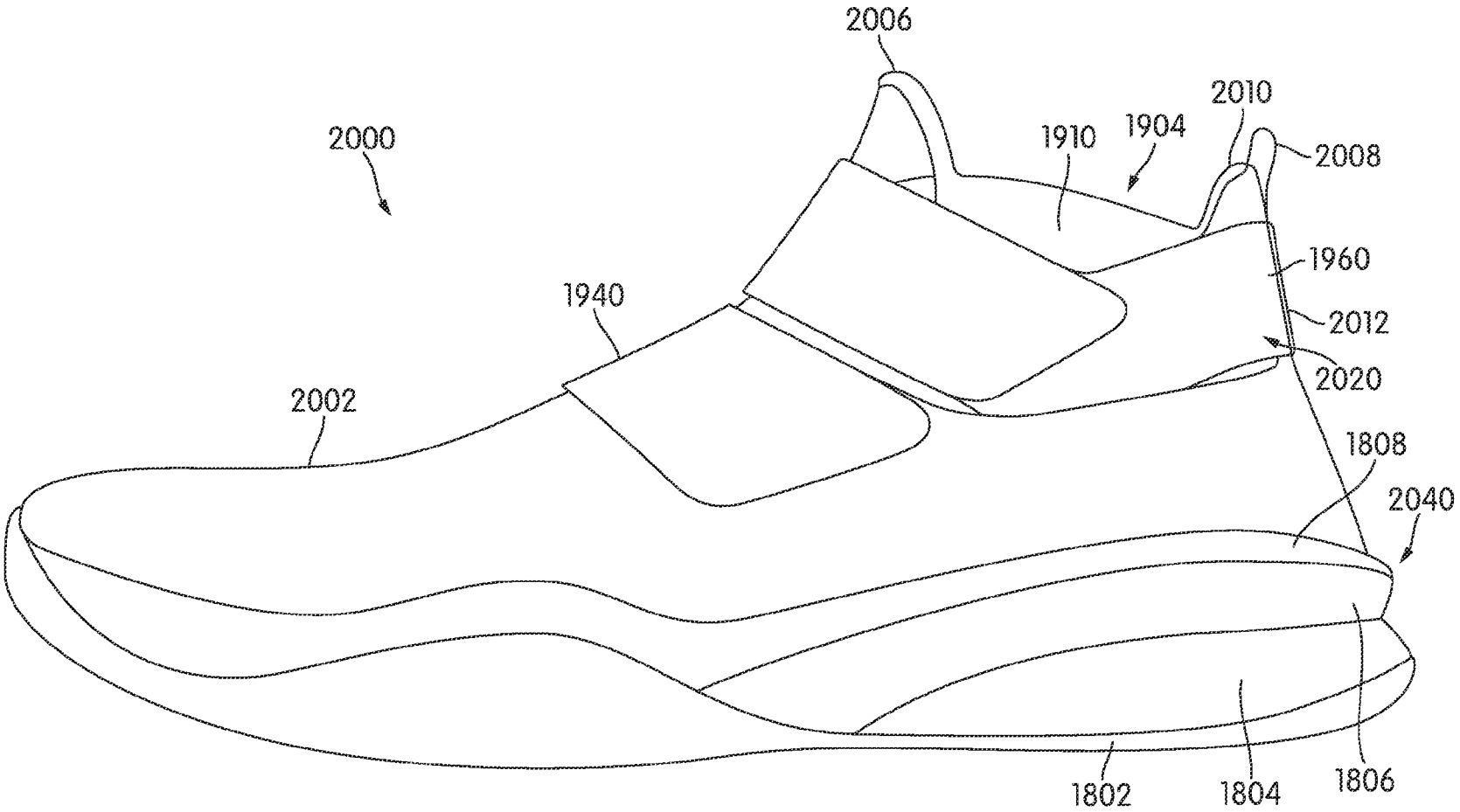
Figure 20C:
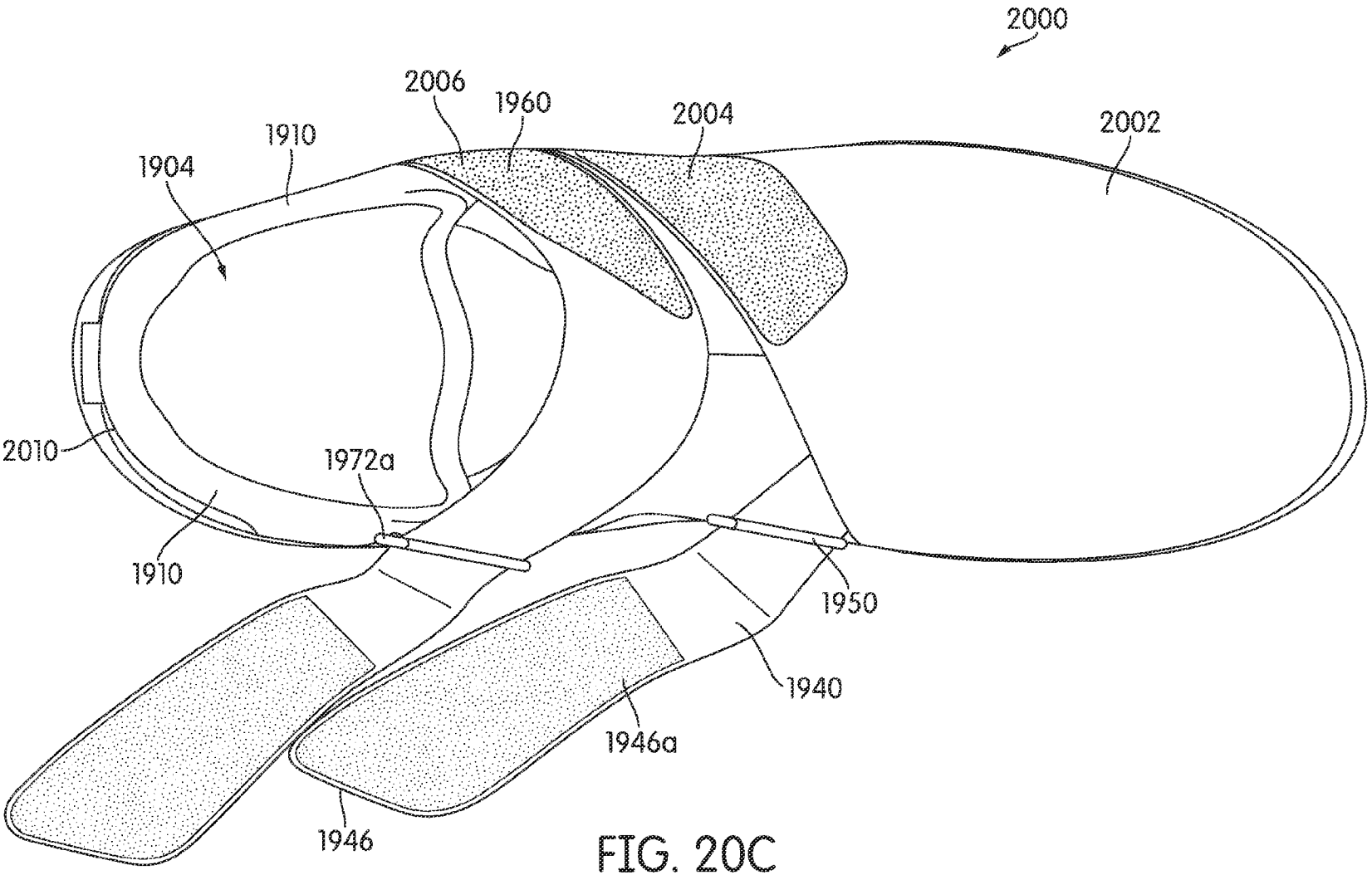

FIGS. 20A through 20C illustrate an example article of footwear 2000 that includes a bootie and strap assembly 2020 like that described above in conjunction with FIGS. 19A through 19D and a sole assembly 2040 like that described above in conjunction with FIGS. 18A through 18ML. For ease of description, the same or similar parts shown in FIGS. 20A through 20C will be labeled with the same reference numbers as used in FIGS. 18A through 19D, and much of the corresponding description of these parts and their construction will be omitted. The strap members 1940 and 1960 of this illustrated bootie and strap assembly 2020 may be reinforced with inelastic fiber or wire elements (e.g., fibers or textile embroidered into the material of the straps 1940 and 1960, structures akin to the reinforcements provided in NIKE's FLYWIRE® technology, etc.).

In addition to the bootie and strap assembly 2020, this example article of footwear includes a synthetic leather member 2002 (including one or more component parts) that covers selective portions of the bootie and strap assembly and forms a portion of the overall footwear upper. This synthetic leather member 2002 is provided to improve the durability and/or abrasion resistance of the article of footwear, and may be located at selected positions that tend to experience greater wear or impacts. As shown, in this example construction 2000, the leather member 2002 surrounds all or substantially all of the shoe perimeter immediately above the sole assembly 2040. The leather member 2002 also covers all or substantially all of the upper toe and vamp/instep portions of the bootie and strap assembly, terminating or providing an opening at the medial side so as to allow the strap member 1940 to freely pass. The surface of the leather member 2002 includes a portion 2004 of a hook-and-loop fastener that engages with the hook-and-loop fastener portion 1946*a* provided at the free end 1946 of strap member 1940. The rear lateral side of the leather member 2002 also terminates a short distance up (below the ankle area of the foot) to expose the strap member 1960 of the heel and strap assembly 1900. The leather member 2002 also may include numerous openings (e.g., in the vamp or instep area, along the medial and lateral sides, etc.) to provide improved ventilation and breathability. Also, while the above description identifies member 2002 as being made from synthetic leather, other materials also may be used without departing from this invention, such as natural leather, thermoplastic polyurethanes, other polymers or textiles, etc.

As noted above, rather than a conventional lace system, the bootie and strap assembly 2020 of this example includes stretchable material portions 1910 along the medial and lateral sides of the shoe that enable expansion of the ankle opening 1904 to a sufficient extent to allow a wearer to insert his/her foot. Also, to assist in donning the shoe 2000, the front portion 2006 of the ankle opening 1904 includes a raised portion that can act as a handle for the user when putting on the shoe. Additionally or alternatively, if desired, a rear handle (e.g., fabric loop 2008) can be provided to assist in the shoe donning process. The rear portion 2010 of the ankle opening 1904 also may include a raised area to which loop 2008 is attached. If desired, the loop 2008 also may extend downward (optionally to the leather member 2002) and form a "belt-loop" type structure 2012 through which a portion of the strap member 1960 extends.

In use, an article of footwear 2000 with a sole structure 1800/2040 like that described and illustrated above in conjunction with FIGS. 18A through 18M and 20A through 20C, can provide certain advantages during a rapid, hard direction change or cutting maneuver. More specifically, as the wearer's heel hits the ground, the softer lower foam component 1804 substantially collapses or compresses on the medial side, which allows the lower leg and ankle of the wearer to rotate downward toward the medial side and maintain better alignment, orientation, and/or motion (e.g., more neutral and natural). The amount of this rotation can be controlled, for example, by controlling the thicknesses, stiffnesses, hardnesses, and positioning of the various materials and components in the sole structure 1800/2040, including by controlling the thickness, hardness, density, or compressibility of the lower foam component 1804. The rigid plate 1806 serves to more evenly disperse the force applied to the lower foam component 1804 and produce a more consistent feel.

In addition to articles of footwear, aspects of this invention can be practiced with other types of "foot-receiving devices" (i.e., any device into which a user places at least some portion of his or her foot). In addition to all types of footwear or shoes (e.g., as described above), foot-receiving devices include, but are not limited to: boots, bindings and other devices for securing feet in snow skis, cross country skis, water skis, snowboards, and the like; boots, bindings, clips, or other devices for securing feet in pedals for use with bicycles, exercise equipment, and the like; boots, bindings, clips, or other devices for receiving feet during play of video games or other games; and the like. Such foot-receiving devices may include: (a) a foot-covering component (akin to a footwear upper) that at least in part defines an interior chamber for receiving a foot; and (b) a foot-supporting component (akin to the footwear sole structure) engaged with the foot-covering component. Structures for providing the desired relative rearfoot movement with respect to the forefoot, as described above, may be incorporated in the foot-covering and/or foot-supporting component of any desired type of foot-receiving device.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. As but one example, techniques such as are described herein can be used to fabricate articles other than footwear uppers. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from above-described embodiments are the within the scope of the invention. With regard to claims directed to an apparatus, an article of manufacture or some other physical component or combination of components, a reference in the claim to a potential or intended wearer or a user of a component does not require actual wearing or using of the component or the presence of the wearer or user as part of the claimed component or component combination. With regard to claims directed to methods for fabricating an component or combination of components, a reference in the claim to a potential or intended wearer or a user of a component does not require actual wearing or using of the component or the participation of the wearer or user as part of the claimed process.

The invention claimed is:

1. A support member for a plantar surface of a foot, comprising:

a heel support region in a rear portion of the support member;

a forefoot support region in a front portion of the support member;

a lateral side member extending between and fixed to the heel support region and the forefoot support region; and a medial side member extending between the heel support region and the forefoot support region, wherein the medial side member is fixed to the heel support region at a rear end of the medial side member, wherein the medial side member includes a free end that is not fixed to the forefoot support region and partially overlaps with a major surface of the forefoot support region, wherein an intermediate portion of the medial side member separates the rear end and the free end, and wherein the intermediate portion extends forward from the rear end.

2. The support member of claim 1, wherein the heel support region, the forefoot support region, the lateral side member, and the medial side member are formed as a unitary, one-piece construction.

3. The support member of claim 1, wherein the heel support region, the forefoot support region, the lateral side member, and the medial side member are formed as one or more pieces from a rigid polymeric material.

4. The support member of claim 1, wherein the medial side member partially overlaps with a bottom major surface of the forefoot support region.

5. The support member of claim 4, wherein a medial side of the bottom major surface of the forefoot support region includes a recessed area for receiving the free end of the medial side member.

6. The support member of claim 4, wherein the free end of the medial side member can flex in a direction away from the bottom major surface of the forefoot support region but flex in a direction toward the bottom major surface of the forefoot support region is limited by the overlap between the free end of the medial side member and the bottom major surface of the forefoot support region.

7. The support member of claim 1, wherein at least the heel support region and the medial side member are formed from rigid polymeric materials.

8. The support member of claim 1, wherein the medial side member and the lateral side member are separated from one another by a space.

9. The support member of claim 1, wherein the heel support region includes a raised perimeter wall at a rear heel area thereof.

10. The support member of claim 1, wherein the heel support region includes a raised perimeter wall that extends around a rear heel area of the heel support region from a medial side area of the heel support region to a lateral side area of the heel support region.

11. The support member of claim 1, wherein the lateral side member includes a side wall at an outside perimeter edge thereof.

12. The support member of claim 1, wherein the forefoot support region includes a side wall on a lateral edge thereof.

13. The support member of claim 1, wherein the forefoot support region includes a flexion zone that allows flex of a lateral toe area of the forefoot support region with respect to a lateral ball area of the forefoot support region.

14. The support member of claim 1, wherein a lateral side of the forefoot support region includes a lateral toe support region and a lateral ball support region.

15. The support member of claim 14, wherein the lateral toe support region and the lateral ball support region are separated from one another by a space.

16. The support member of claim 14, wherein the lateral toe support region includes a side wall on a lateral edge thereof.

17. The support member of claim 14, wherein the lateral ball support region includes a side wall on a lateral edge thereof.

18. The support member of claim 14, wherein the lateral toe support region and the lateral ball support region are separated from one another by a space, wherein the lateral toe support region includes a side wall on a lateral edge thereof, and wherein the lateral ball support region includes a side wall on a lateral edge thereof.

19. A foot-receiving device, comprising:

a foot-covering member; and a foot-supporting member including the support member of claim 1.

20. An article of footwear, comprising:

an upper; and a sole structure engaged with the upper, wherein the sole structure includes the support member of claim 1, and wherein the support member is included in a midsole element of the sole structure.

21. A support member for a plantar surface of a foot, comprising:

a heel support region;

a forefoot support region, wherein a bottom major surface of a medial side of the forefoot support region includes a recessed area;

a lateral side member extending between the heel support region and the forefoot support region; and a medial side member extending between the heel support region and the forefoot support region, wherein the medial side member includes a free end that is not fixed to the forefoot support region, and wherein the free end partially overlaps with the recessed area of the forefoot support region, wherein the heel support region, the forefoot support region, the lateral side member, and the medial side member are formed as a unitary, one-piece construction that is constructed and arranged such that the free end of the medial side member can flex in a direction away from the bottom major surface of the forefoot support region but flex in a direction toward the bottom major surface of the forefoot support region is limited by the overlap between the free end of the medial side member and the recessed area of the forefoot support region.

22. The support member of claim 21, wherein the medial side member and the lateral side member are separated from one another by a space.

23. The support member of claim 21, wherein the heel support region includes a raised perimeter wall that extends around a rear heel area of the heel support region from a medial side area of the heel support region to a lateral side area of the heel support region.

24. The support member of claim 21, wherein the lateral side member includes a side wall at an outside perimeter edge thereof.

25. The support member of claim 21, wherein the forefoot support region includes a side wall on a lateral edge thereof.

26. The support member of claim 21, wherein the forefoot support region includes a flexion zone that allows flex of a lateral toe area of the forefoot support region with respect to a lateral ball area of the forefoot support region.

27. The support member of claim 21, wherein a lateral side of the forefoot support region includes a lateral toe support region and a lateral ball support region.

28. The support member of claim 27, wherein the lateral toe support region and the lateral ball support region are separated from one another by a space.

29. The support member of claim 27, wherein the lateral toe support region includes a side wall on a lateral edge thereof.

30. The support member of claim 27, wherein the lateral ball support region includes a side wall on a lateral edge thereof.

31. The support member of claim 27, wherein the lateral toe support region and the lateral ball support region are separated from one another by a space, wherein the lateral toe support region includes a side wall on a lateral edge thereof, and wherein the lateral ball support region includes a side wall on a lateral edge thereof.

32. A foot-receiving device, comprising:

a foot-covering member; and a foot-supporting member including the support member of claim 21.

33. An article of footwear, comprising:

an upper; and a sole structure engaged with the upper, wherein the sole structure includes the support member of claim 21, and wherein the support member is included in a midsole element of the sole structure.

* * * * *